US005584151A

United States Patent [19]

Abou-Rached

[11] Patent Number: 5,584,151

[45] Date of Patent: Dec. 17, 1996

[54] EARTHQUAKE, WIND RESISTANT AND FIRE RESISTANT PRE-FABRICATED BUILDING PANELS AND STRUCTURES FORMED THEREFROM

[75] Inventor: Roger G. Abou-Rached, Vancouver, Canada

[73] Assignee: R.A.R. Consultants Ltd., Vancouver, Canada

[21] Appl. No.: 441,574

[22] Filed: May 15, 1995

Related U.S. Application Data

[62] Division of Ser. No. 169,891, Dec. 20, 1993, Pat. No. 5,548,935.

[51] Int. Cl.[6] ..... E02D 27/34

[52] U.S. Cl. ..... 52/293.2; 52/167.1; 52/167.4; 52/292; 52/293.3

[58] Field of Search ..... 52/292, 293.1, 52/293.2, 293.3, 294, 285.3, 583.1, 295, 592.6, 601, 605, 167.4, 167.1

[56] References Cited

U.S. PATENT DOCUMENTS

| | | | |
|---|---|---|---|
| 1,378,928 | 5/1921 | Witzel . | |
| 1,721,198 | 7/1929 | Athey . | |
| 1,891,934 | 12/1932 | Joy et al. | 52/293.2 X |
| 2,147,035 | 2/1939 | Henderson | 52/293.2 |
| 2,298,184 | 10/1942 | Von Rosenberg | 52/167.1 |
| 2,882,712 | 4/1959 | Carlson . | |
| 3,064,392 | 11/1962 | Avril . | |
| 3,066,449 | 12/1962 | Cramer, Jr. | 52/294 |
| 3,391,507 | 7/1968 | Downing | 52/605 X |
| 3,760,540 | 9/1973 | Latoria et al. | 52/125 |
| 3,854,256 | 12/1974 | Wilce | 52/122 |
| 3,855,744 | 12/1974 | Miram | 52/293.1 X |
| 3,874,139 | 4/1975 | Landwoski | 52/293.1 X |
| 3,950,902 | 4/1976 | Stout | 52/295 X |
| 4,110,949 | 9/1978 | Cambiuzzi et al. | 52/605 X |
| 4,578,915 | 4/1986 | Schneller | 52/309.12 |
| 4,625,484 | 12/1986 | Oboler | 52/251 |
| 4,841,702 | 6/1989 | Huettemann | 52/309.12 |
| 4,937,993 | 7/1990 | Hitchins | 52/455 |
| 5,029,423 | 7/1991 | Kornylak | 52/293 |
| 5,048,243 | 9/1991 | Ward | 52/584.1 |
| 5,065,558 | 11/1991 | Boatsman | 52/239 |
| 5,119,606 | 6/1992 | Graham | 52/125.4 |
| 5,224,799 | 7/1993 | Parker | 52/294 X |
| 5,279,088 | 1/1994 | Heydon | 52/241 |
| 5,367,845 | 11/1994 | Hartling | 52/293.1 |

FOREIGN PATENT DOCUMENTS

| | | |
|---|---|---|
| 1475808 | 4/1967 | France . |
| 3612132 | 10/1987 | Germany . |
| 2103259 | 2/1983 | United Kingdom . |

*Primary Examiner*—Carl D. Friedman
*Assistant Examiner*—Winnie Yip
*Attorney, Agent, or Firm*—Fetherstonhaugh & Co.

[57] ABSTRACT

An earthquake, fire and wind resistant pre-fabricated building panel comprises a plurality of frame members. The frame members are connected together to form a frame lying in a frame plane, the frame defining a perimeter of the panel, the perimeter bounding an interior portion of the panel. At least some of the frame members are biased inwardly, generally in the frame plane, towards the interior portion of the panel. A first solidified castable substance is cast in the interior portion of the frame, between the frame members. A three-dimensional structure such as a house is formed by connecting the panels together. The connections absorb and distribute seismic forces to the entire three-dimensional structure and the biased frame members act to absorb residual seismic forces reaching the individual panels. The castable substance and biased frame members permit the panel to withstand both positive and negative loading and render the panel fire resistant.

14 Claims, 71 Drawing Sheets

EARTHQUAKE, WIND RESISTANT AND FIRE RESISTANT PRE-FABRICATED BUILDING PANELS AND STRUCTURES FORMED THEREFROM

This application is a divisional of application Ser. No. 08/169,891, filed Dec. 20, 1993, now U.S. Pat. No. 5,548, 935.

BACKGROUND OF THE INVENTION

This invention relates to an earthquake, fire and wind resistant pre-fabricated building panel for use in making a three-dimensional structure such as a house, apartment, office building or the like. A plurality of panels according to the invention is illustrated and described, a method of making such panels is described, examples of three dimensional structures according to the invention are described and a specially adapted shipping container for shipping components to build a three-dimensional structure is described.

Prefabricated Panels

Prefabricated building panels, in general, act as building components which can be quickly and easily fastened to a pre-erected frame structure. Many man-hours, however, are required to pre-erect the frame structure and prepare such structure for receipt of prefabricated panels. Dimension tolerances in both the pre-erected frame and the prefabricated panels can accumulate over large spans and ultimately, the panels may not properly fit on the pre-erected frame.

In addition, conventional pre-fabricated panels are normally fastened to the exterior side of the pre-erected frame which enables such panels to withstand positive wind loading, however, negative wind loading such as created by hurricanes cannot be withstood.

Negative loading normally results in the exteriorally fastened panels being ripped off of the frame structure. This also occurs with conventional plywood board sheathing which is also fastened to the exterior side of the frame. Examples of such prior art prefabricated panels susceptible to negative wind loading are given in U.S. Pat. No. 4,841, 702 to Huettemann and in U.S. Pat. No. 4,937,993 to Hitchins. What is desirable therefore is a building panel or building system which can withstand both positive and negative dynamic loading.

Three Dimensional Structure

A consideration in most building designs is the susceptibility of the building to seismic forces such as created by earthquake activity. Many conventional building designs include a solid, unitary cast concrete foundation with engineered footings suitable for the soil upon which the building is to be erected. The building frame, in the form of integral wall portions connected together, is built upon the solid unitary foundation and plywood board sheathing or prefabricated panels are fastened to the frame. (Of course the plywood board sheathing and prefabricated panels suffer from the disadvantages pointed out above).

The solid unitary foundation presents a problem under seismic forces because it is unitary and rigid. Although this permits such forces to be transmitted throughout the foundation, such a rigid foundation is unable to act sufficiently resiliently and elastically to absorb such forces without cracking or breaking. Cracks or breaks in the foundation are susceptible to water ingress which can have a tendency to cause the crack or break to propagate through the foundation resulting in degradation of the foundation.

In addition, the integral wall portions of the frame of the structure typically are formed of wood which is nailed together. Often seismic forces are sufficient to rip apart nailed walls resulting in localized failure of the frame leading to collapse of a wall and potential collapse of the building. While a wood frame of this type presents a relatively resilient elastic structure, typically the joints between frame portions are not sufficiently strong to hold the frame portions together under such loading and thus seismic forces cannot be properly distributed to other portions of the frame to help share the load. What is desirable therefore is a sufficiently resilient elastic building foundation and a sufficiently resiliently elastic frame structure able to withstand and distribute seismic forces.

Hi-rise apartment or office buildings sometimes also suffer from a lack of a sufficiently resiliently elastic foundation and frame structure and, wall panels and partitions able to withstand and distribute earthquake forces. Thus it is desirable to provide such ability in hi-rise apartment and office buildings or virtually in any structure exposed to such forces.

In addition to the need to withstand earthquake forces, there exists a need to provide prefabricated building structures capable of quick and easy erection with minimal labour requirements. Presently, conventional easily erected building structures include prefabricated structures such as trailers, mobile homes etc., which are transported to the erection site. Transporting such structures is costly and requires an enormous amount of space on a ship, for example. If it were possible to ship individual components of a structure and then erect the structure quickly and easily, shipping or transportation costs would be reduced, labour requirements for erecting the structure would be reduced and the cost of erecting the structure itself would be reduced. Thus it is desirable to provide building components which are capable of providing these advantages.

Transportation

Further to the transportation of conventional prefabricated building structures such as trailers, mobile homes and modular houses, such items are normally stacked one upon the other during shipping. Typically, however, these structures are designed only to bear their own weight and cannot bear the weight of other such structures, especially while the ship on which they are carried is travelling in rough seas. Thus, additional structural support is required to stack such prefabricated structures or stacking must be eliminated, resulting in inefficient use of cargo space on the ship.

What is desirable, therefore, is a prefabricated building system which can be shipped and stacked without requiring additional structure, without damaging components of the building system and which makes efficient use of cargo space on a ship or other mode of transportation.

SUMMARY OF THE INVENTION

The above problems in the prior art are addressed by providing an earthquake-resistant, fire-resistant and wind-resistant pre-fabricated building panel comprising a plurality of frame members. The frame members are connected together to form a frame lying in a frame plane, the frame defining a perimeter of the panel, the perimeter bounding an interior portion of the panel. At least some of the frame members are biased inwardly, generally in the frame plane, towards the interior portion of the panel. A first solidified castable substance is cast in the interior portion of the frame, between the frame members.

Preferably, the frame members are biased inwardly by a resiliently extendable tension link extending between at least two of the frame members. More preferably, the flexible tension link has perpendicular portions lying in a first plane between the frame members and has diagonal portions lying in a second plane between the frame members, the second plane being spaced apart from the first plane. The castable substance is east about the perpendicular and diagonal portions such that loads imposed on the castable substance, such as wind loads, are transferred to the tension link and hence are transferred to the frame members of the panel.

Also preferably, the panel includes a layer of flexible mesh material extending between at least two frame members and tensioned therebetween to further bias the frame members inwardly. The castable substance is cast about the flexible mesh material to further distribute forces imposed on the castable substance to the frame members.

Also preferably, at least two opposite frame members are loosely connected to adjacent frame members of the same panel such that the two opposite frame members are able to move relative to the adjacent frame members, at least in a direction parallel to the axes of the adjacent members.

A three-dimensional structure such as a house is formed by connecting panels, as described above, together. Connecting the panels together essentially connects together the individual frame members of each panel thereby forming a three-dimensional space-frame with the castable substance of each panel occupying the spaces between the frame members. The space frame is elastic and ductile and therefore is operable to distribute seismic and wind forces throughout the entire structure thus reducing the concentration of such forces at any given location and reducing the possibility of failure of any given member of the structure. In particular, the connections of the panels absorb and distribute seismic forces to the entire three-dimensional structure and the biased frame members act to absorb residual seismic forces reaching the east portions of the individual panels. The castable substance, in cooperation with the biased frame members, permits the panel to withstand both positive and negative dynamic loading. Yet only a minimal amount of castable substance is used, in strategic locations which enhance the structural integrity of the panel. The castable substance also provides a fire-resistant layer operable to protect the panel and provides an excellent base for any architectural finish.

Transportation of the panels and components necessary to form a three-dimensional structure such as a house is preferably accomplished by forming a container by connecting together a plurality of panels, ultimately destined for use in fabrication of the structure, to form a rigid container into which the remaining panels and components necessary to form the structure may be placed. At least some of the panels of the structure therefore act as wall portions of a container used to transport the remaining panels and components necessary to build the structure. Some panels of the structure thus can be used to fulfill two different purposes; forming a container and forming portions of a structure whose components are transported in the container so formed.

Foundation

Figure 2:
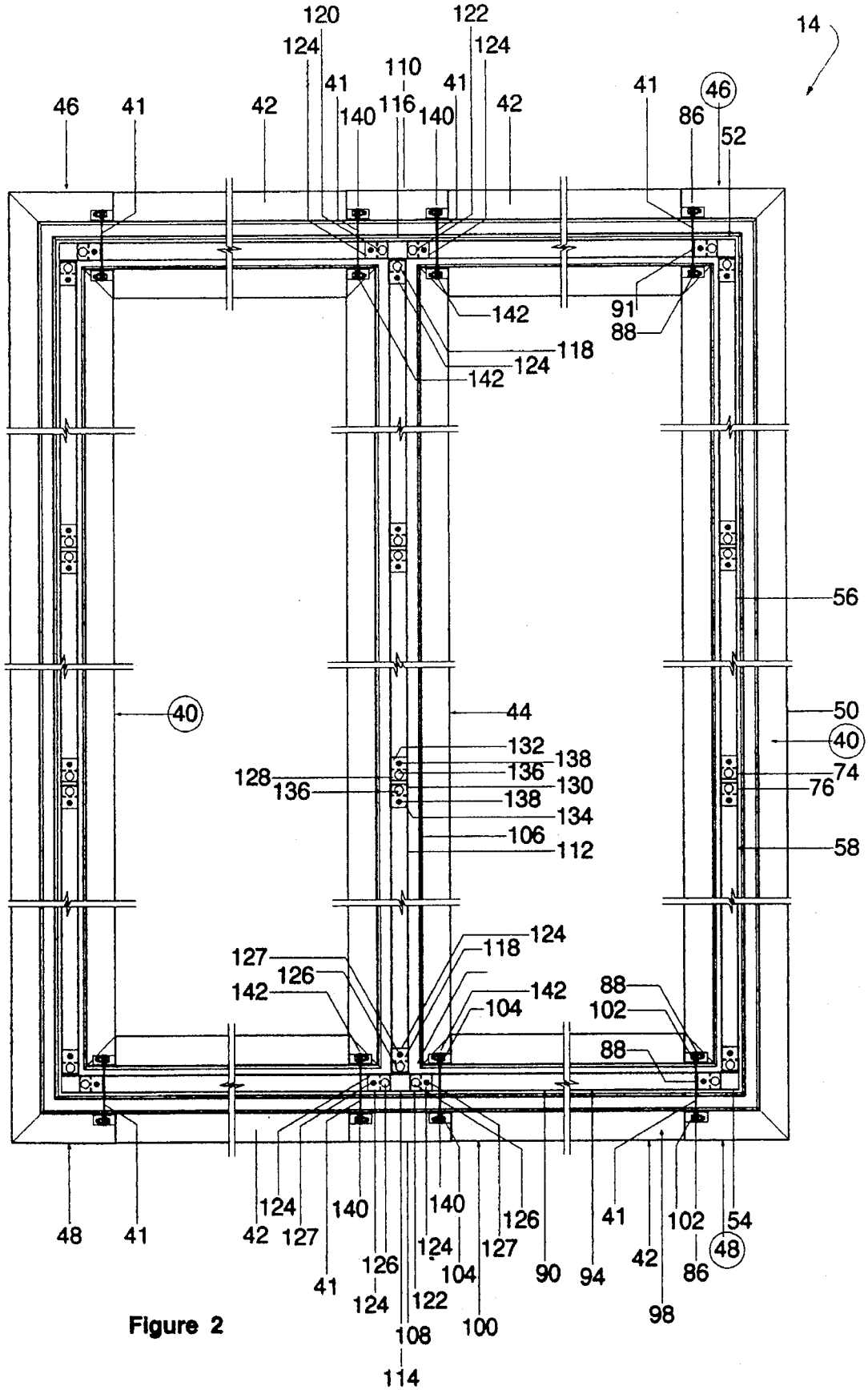
Figure 3:
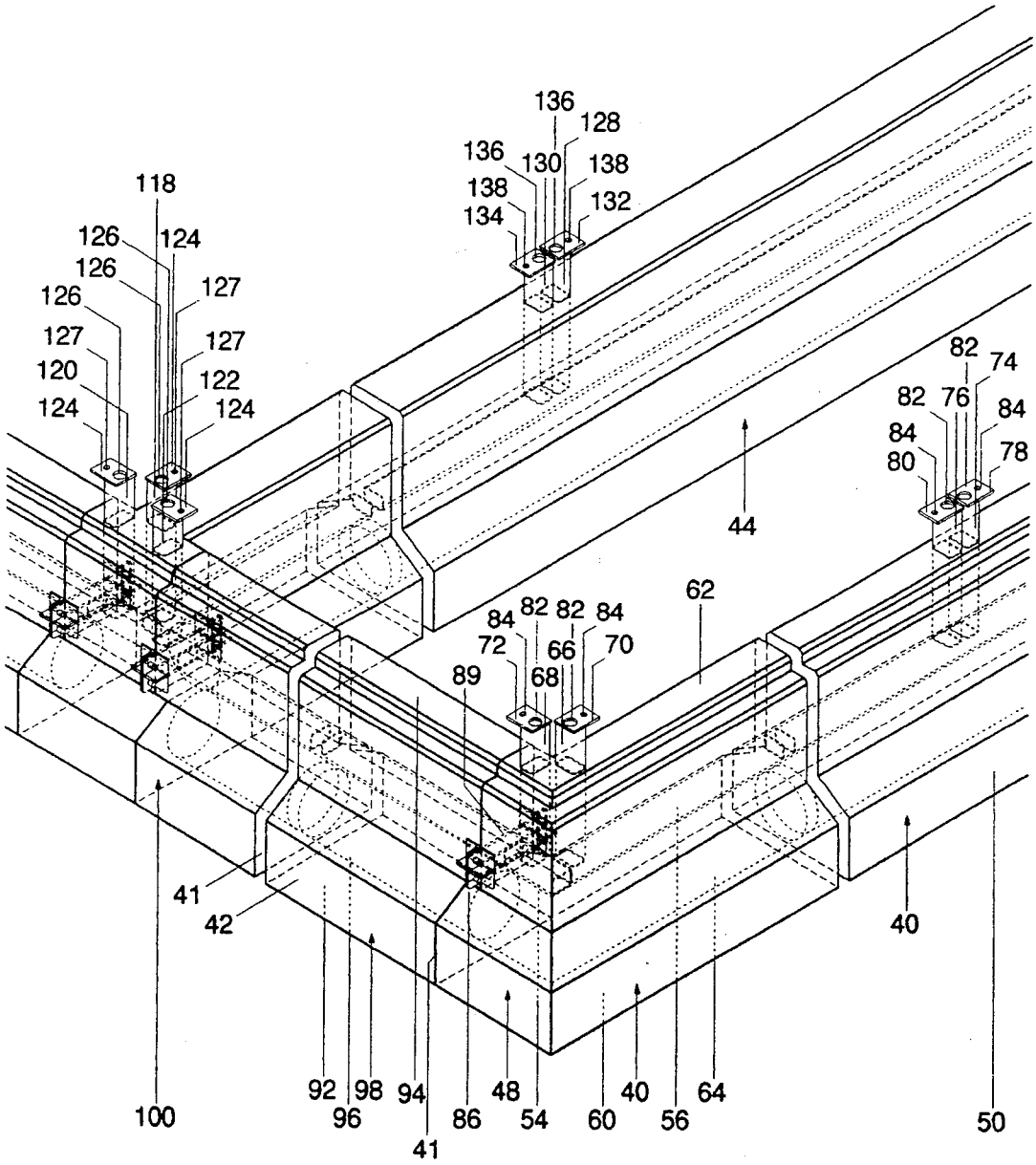

FIG. 2 is a plan view of a foundation according to a first embodiment of the invention;

FIG. 3 is a perspective view of a portion of the foundation shown in FIG. 2;

Floor Panel

Figure 4:
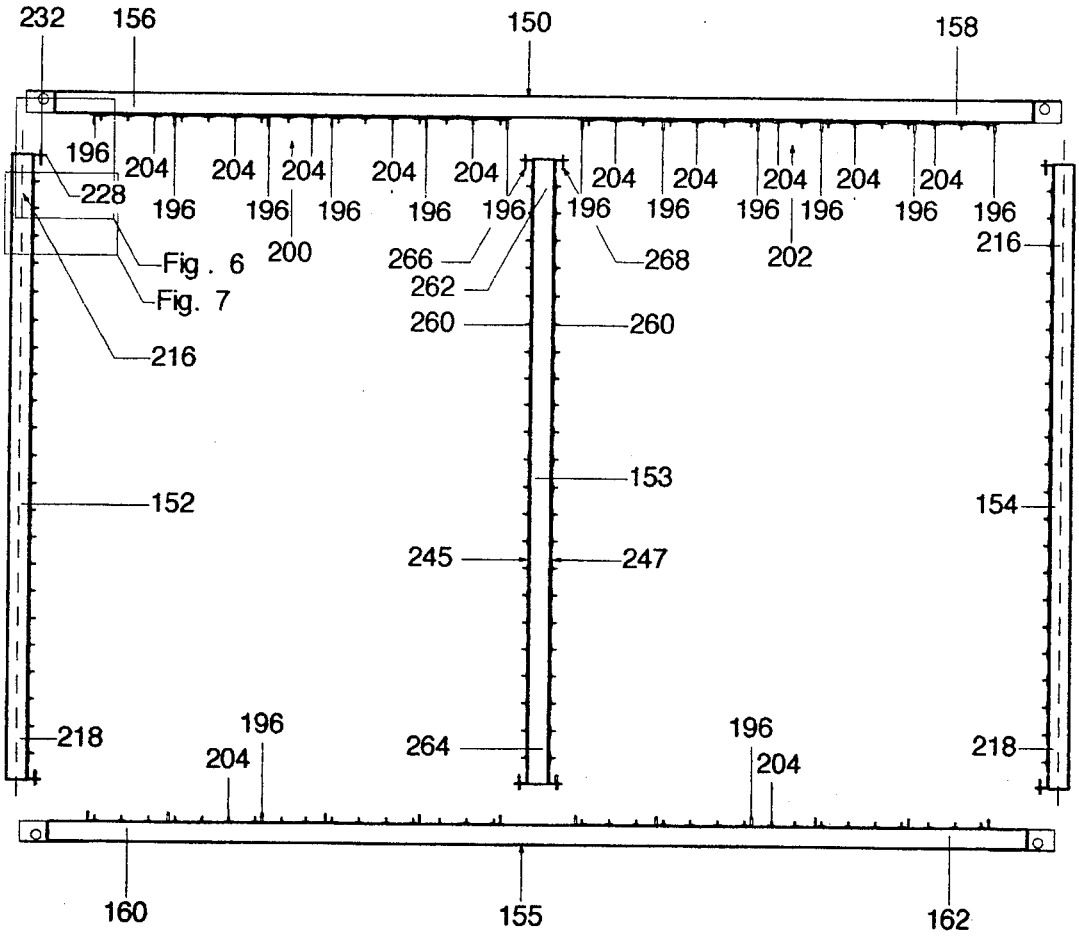
Figure 5:
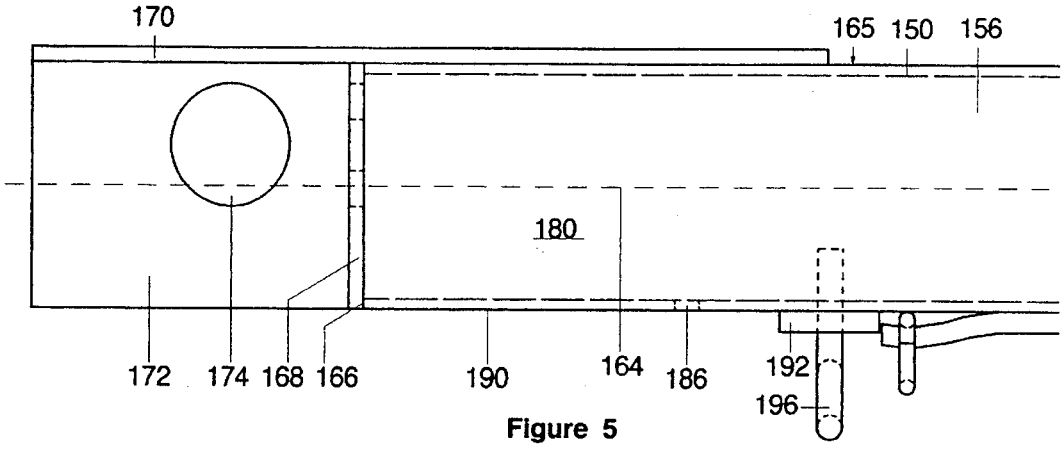
Figure 6:
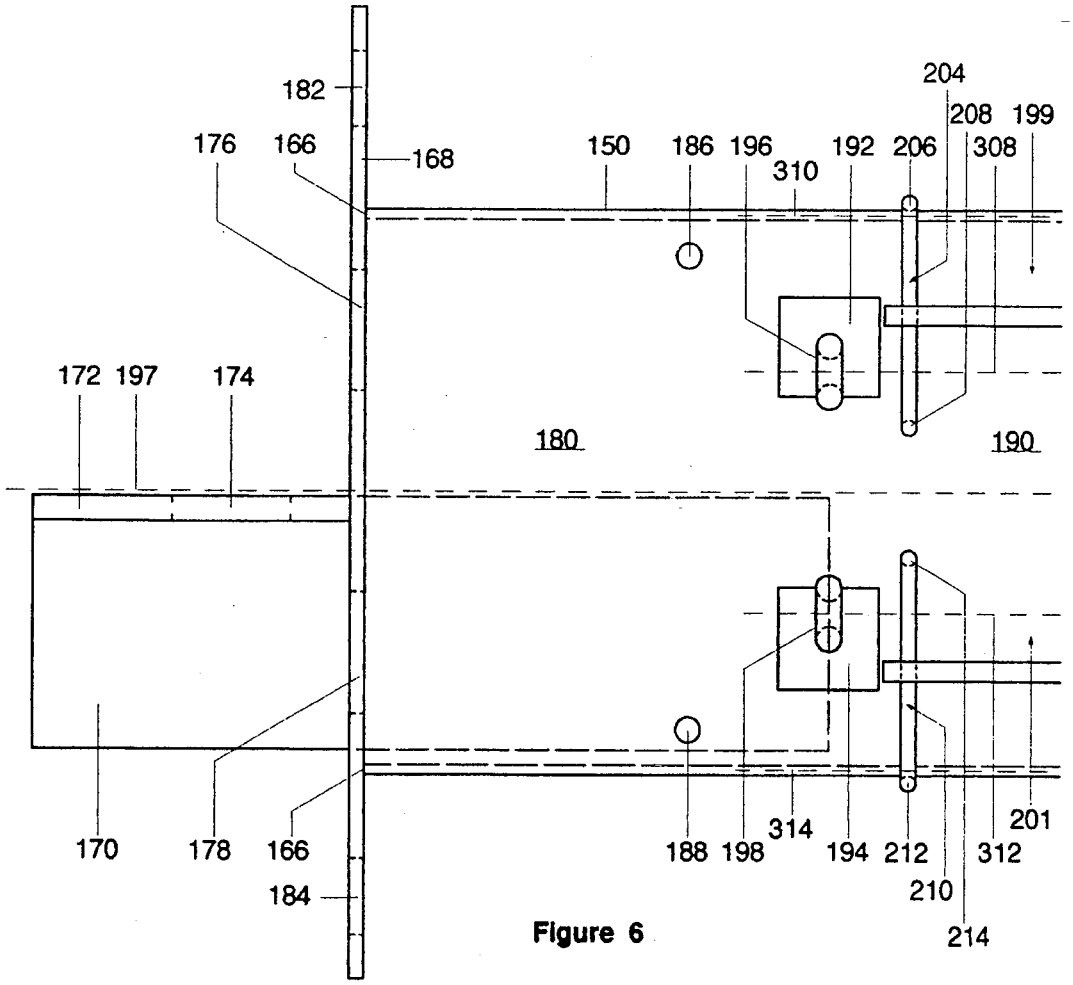
Figure 7:
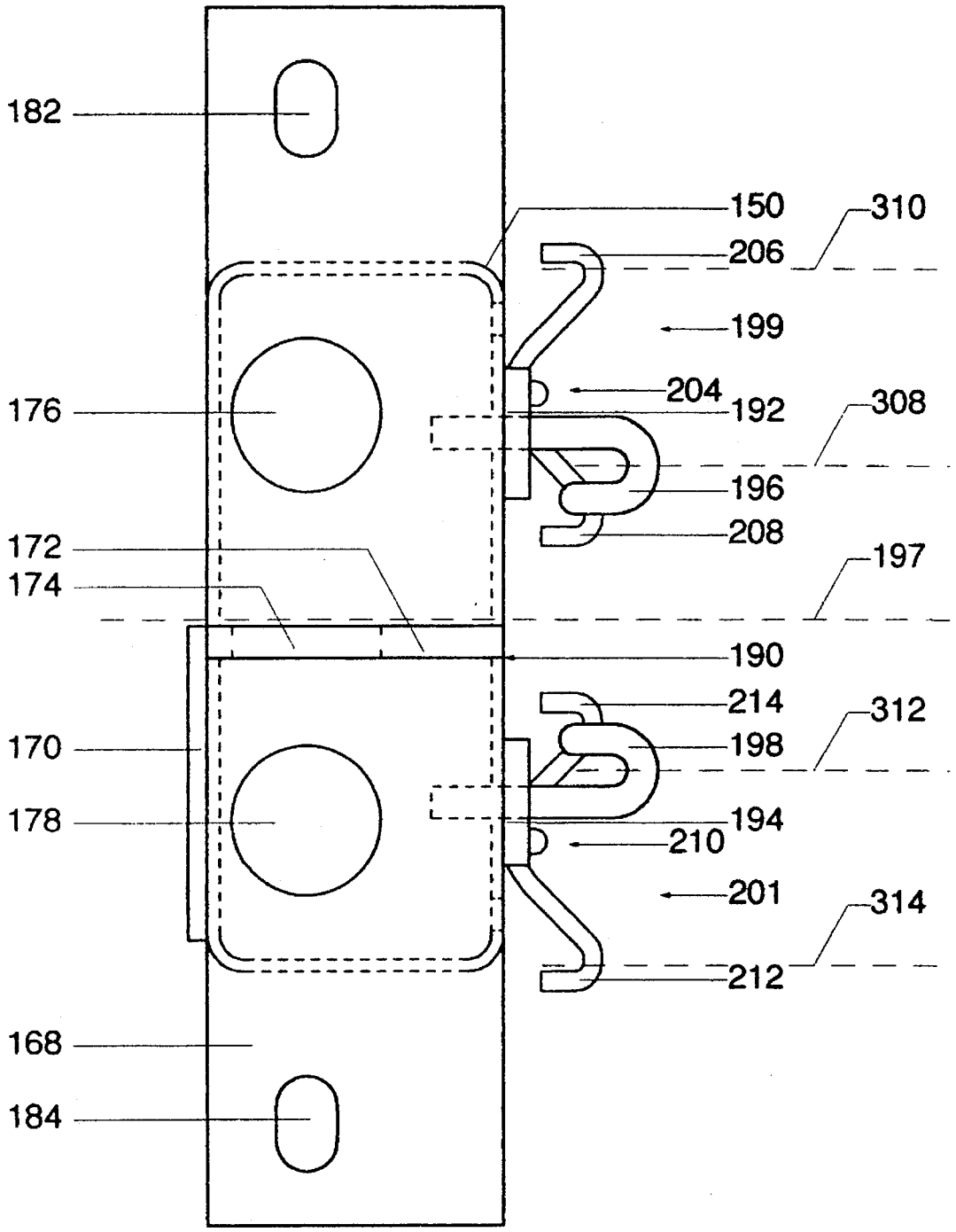
Figure 8:
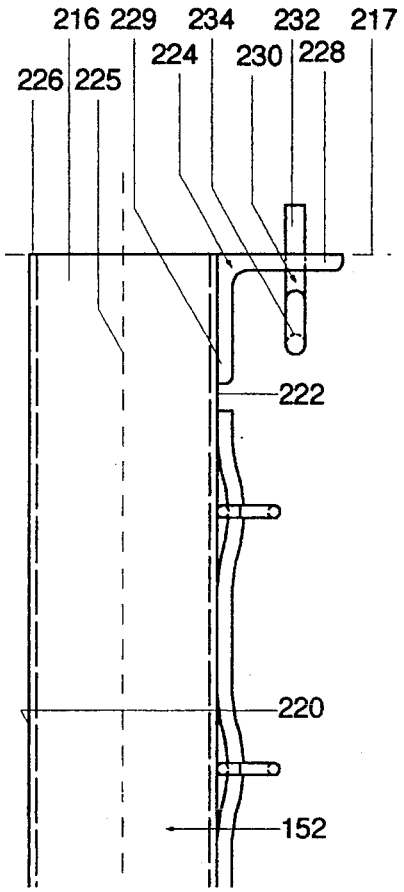
Figure 9:
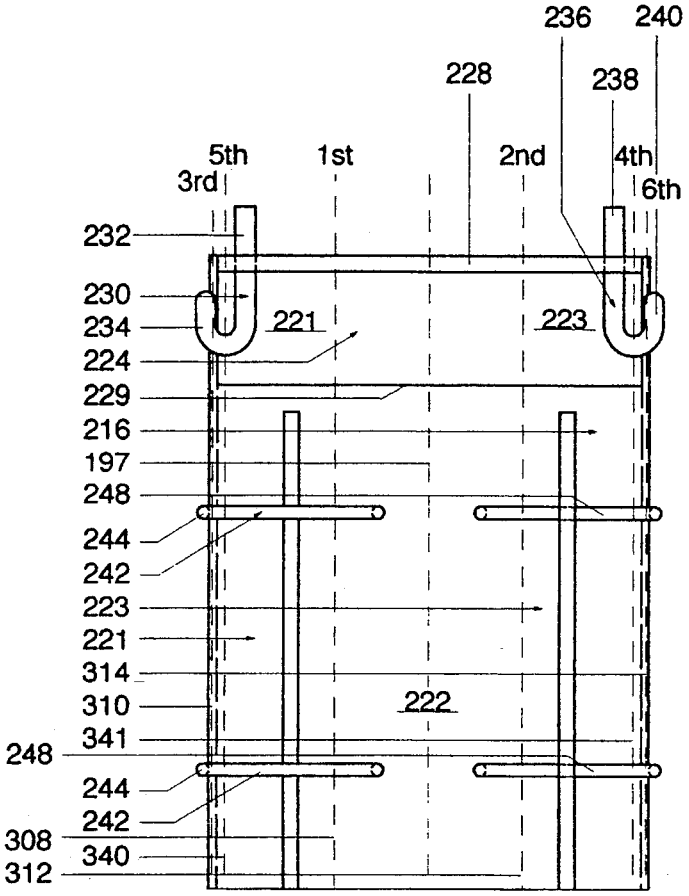
Figure 10:
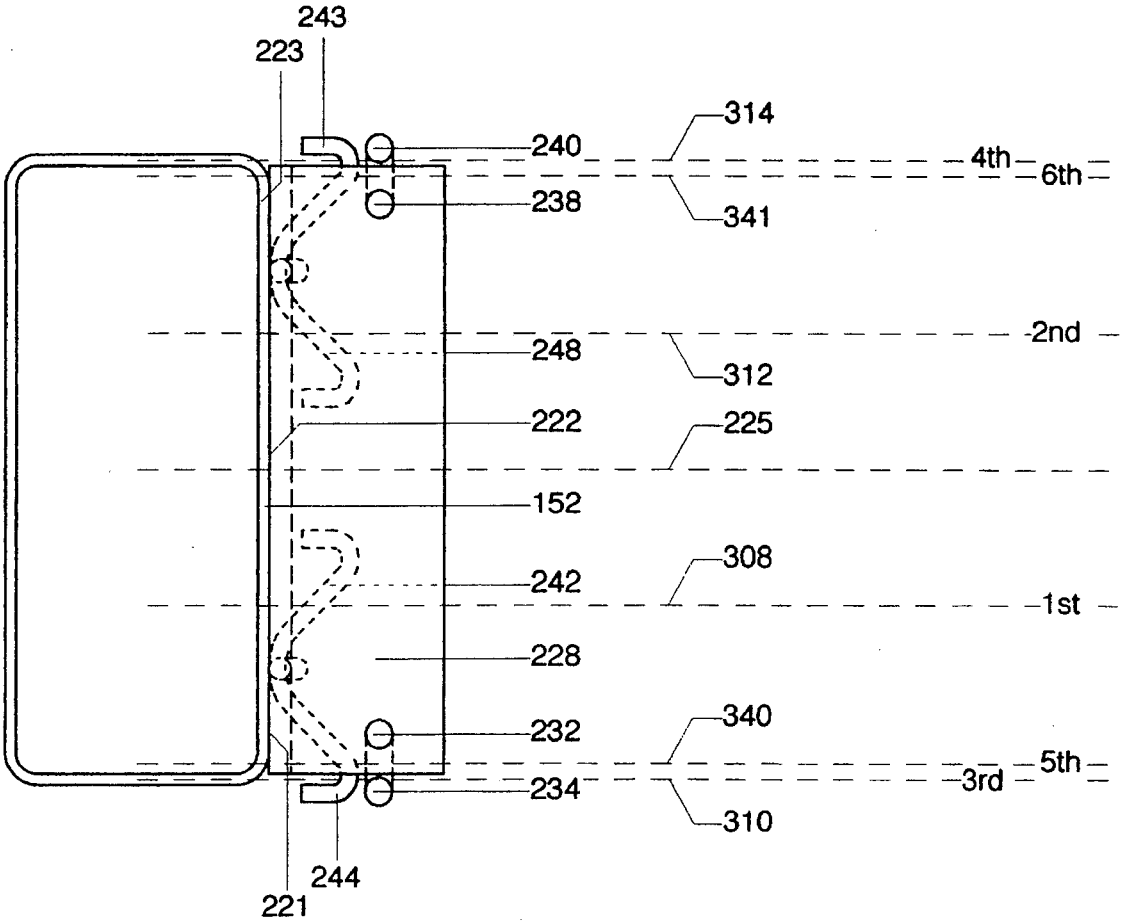
Figure 11:
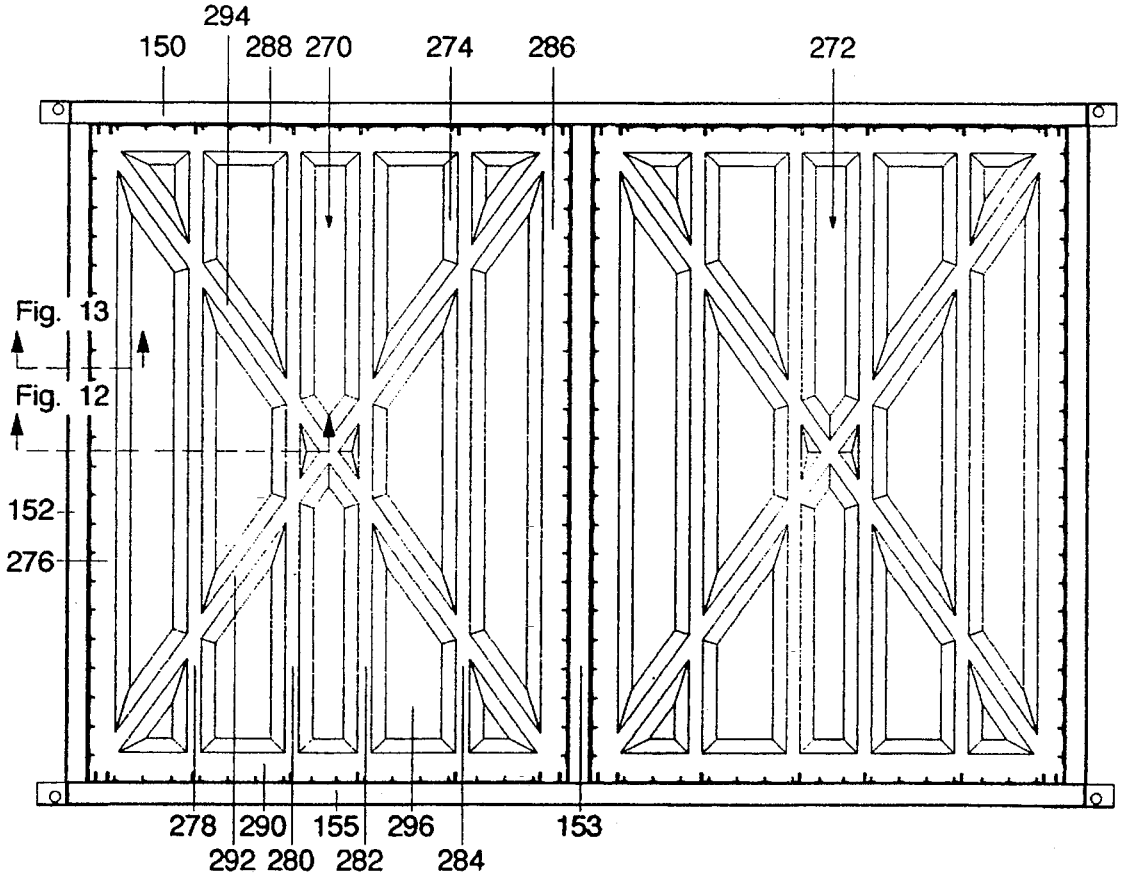
Figure 12:
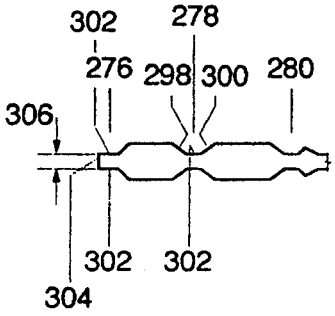
Figure 13:
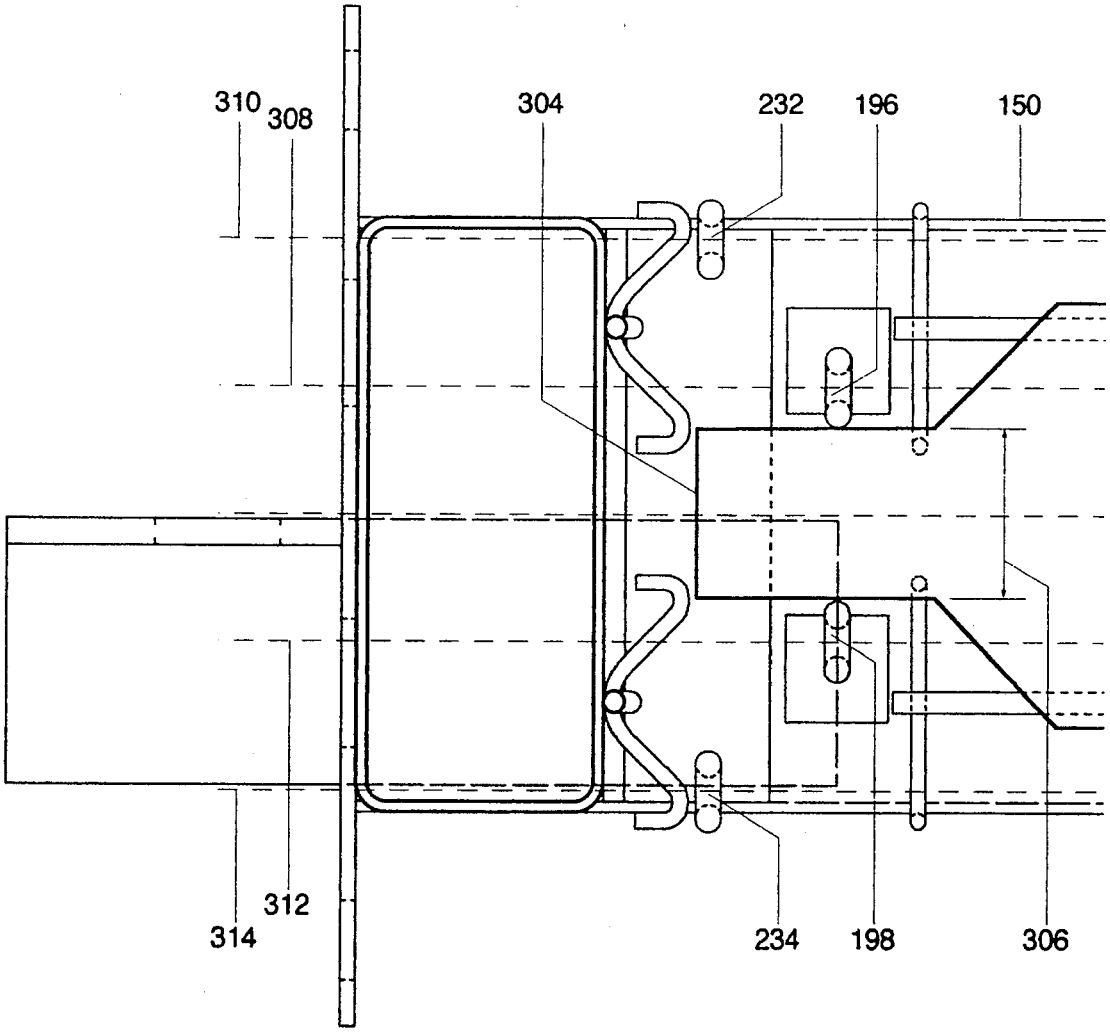
Figure 14:
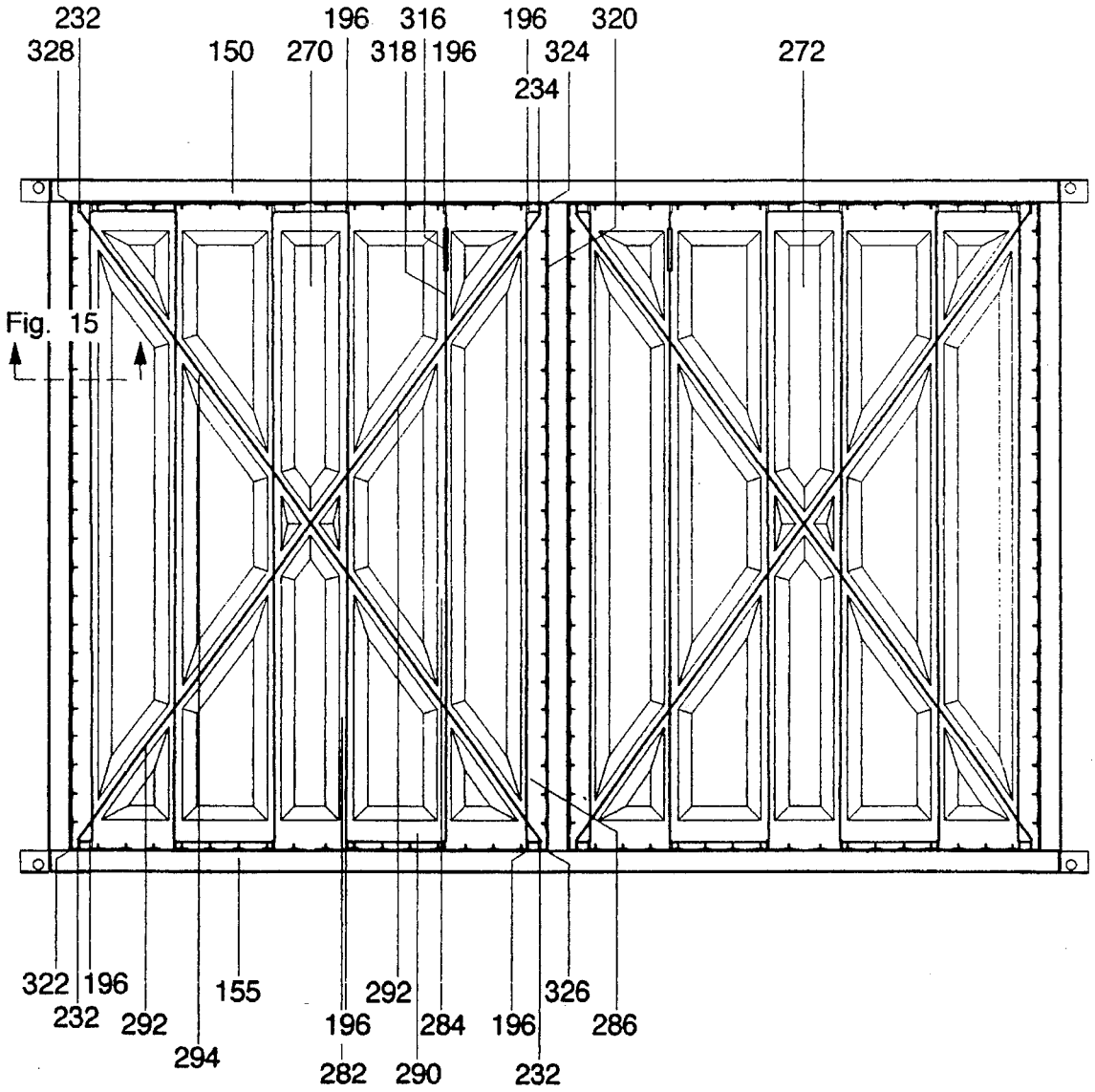
Figure 15:
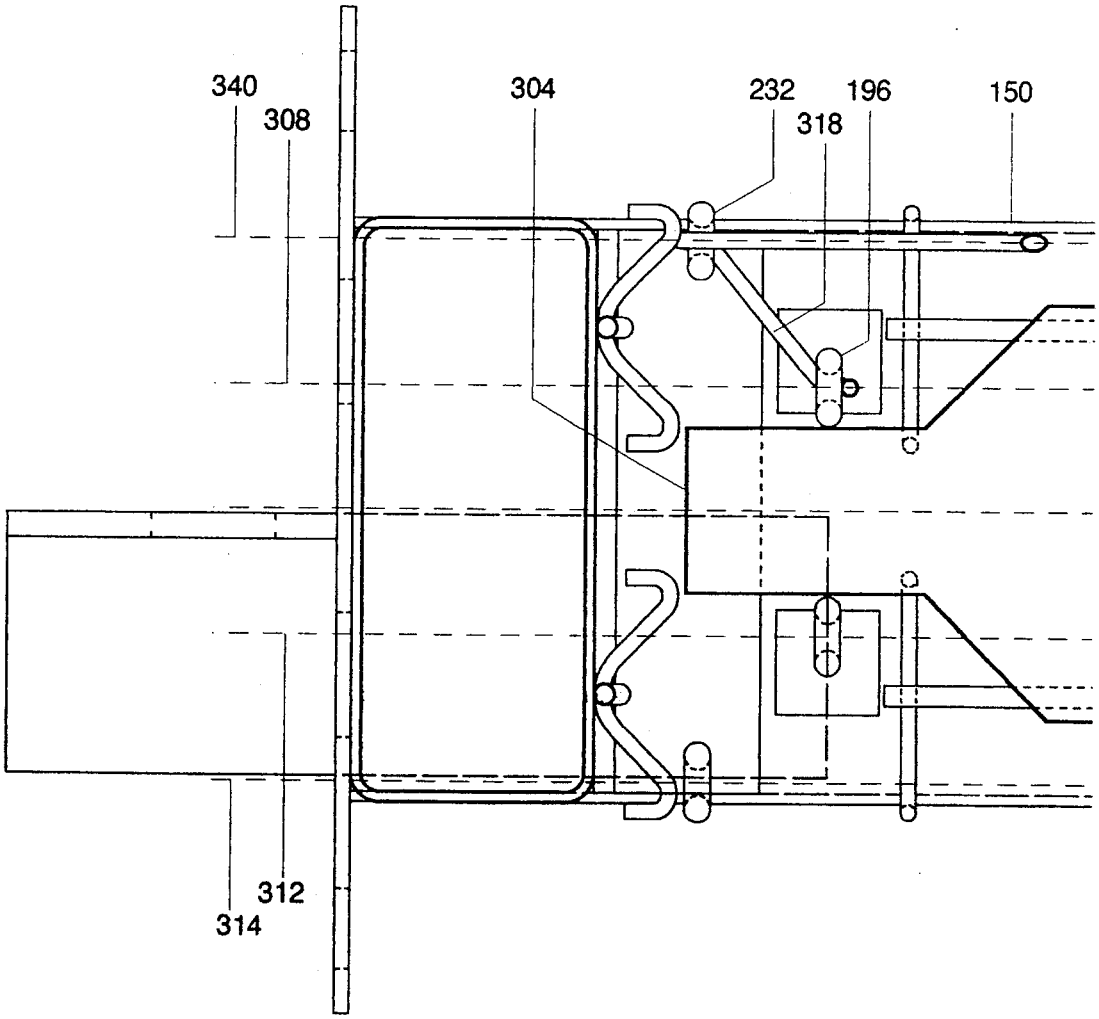
Figure 16:
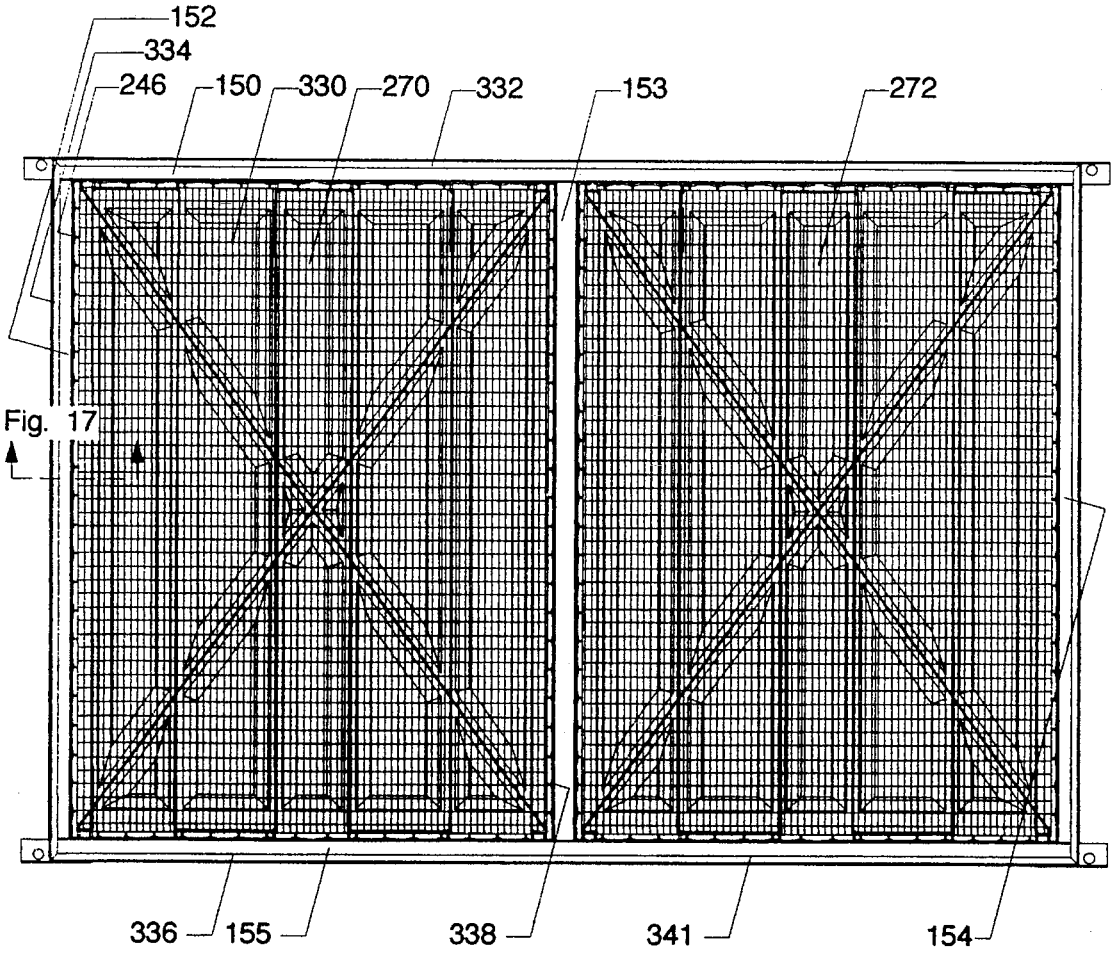
Figure 17:
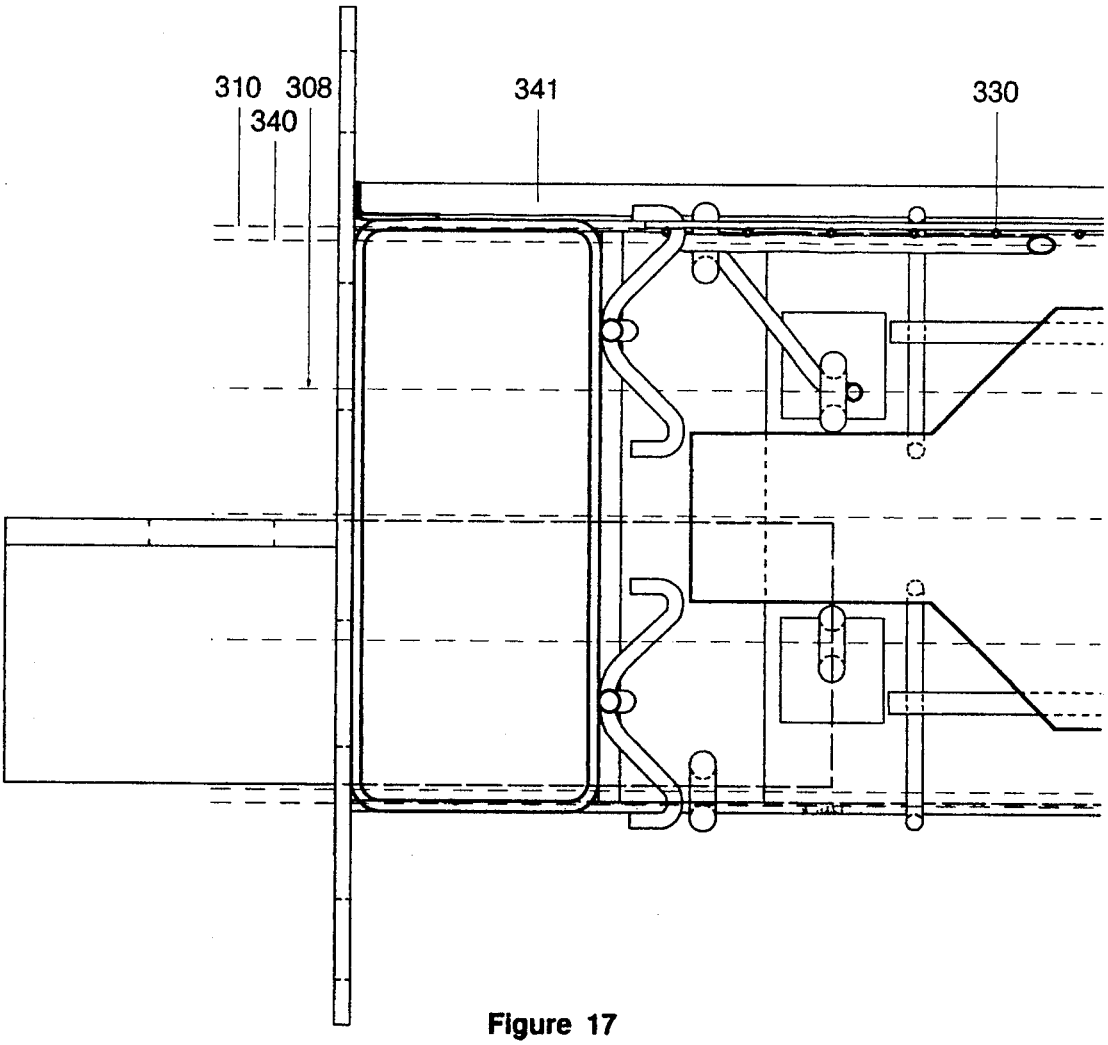
Figure 18:
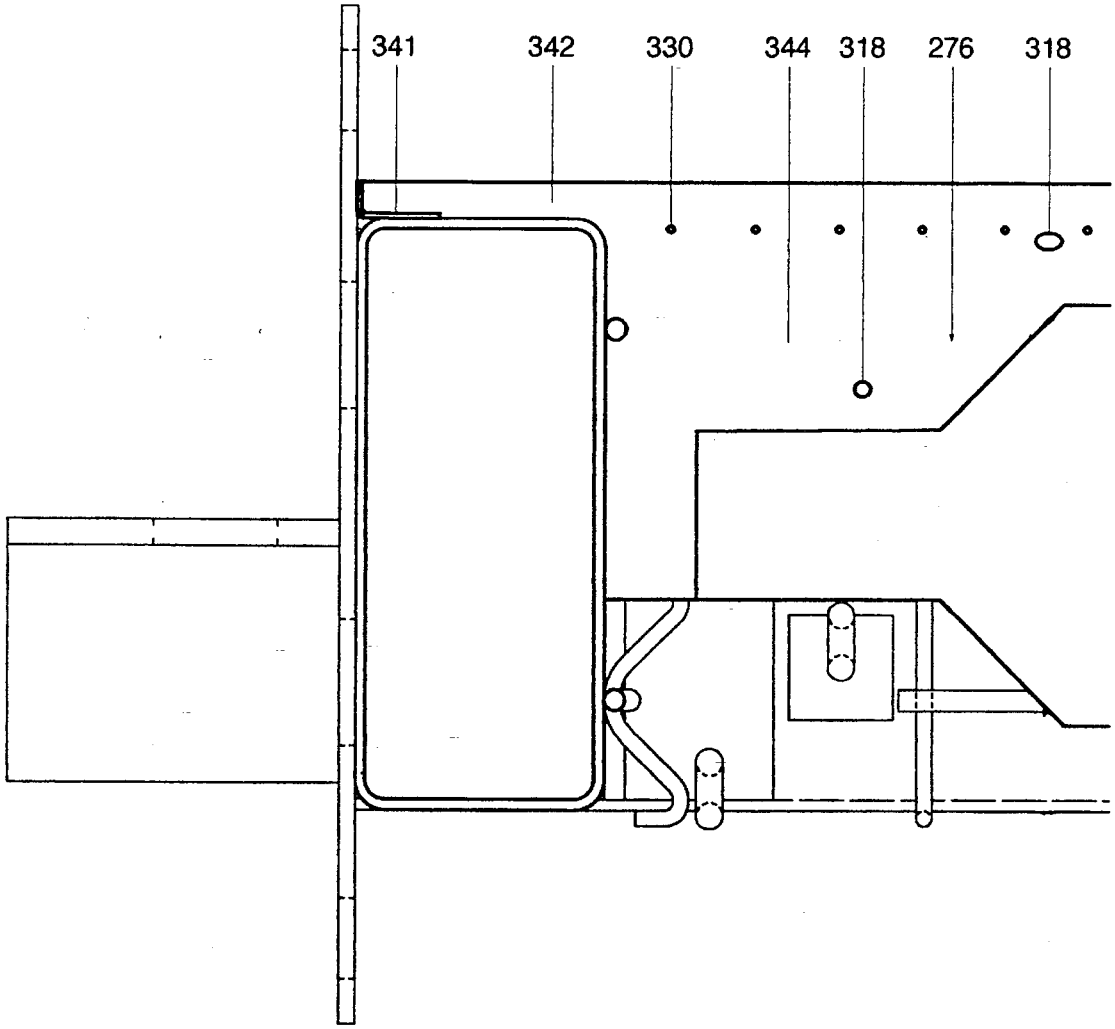
Figure 19:
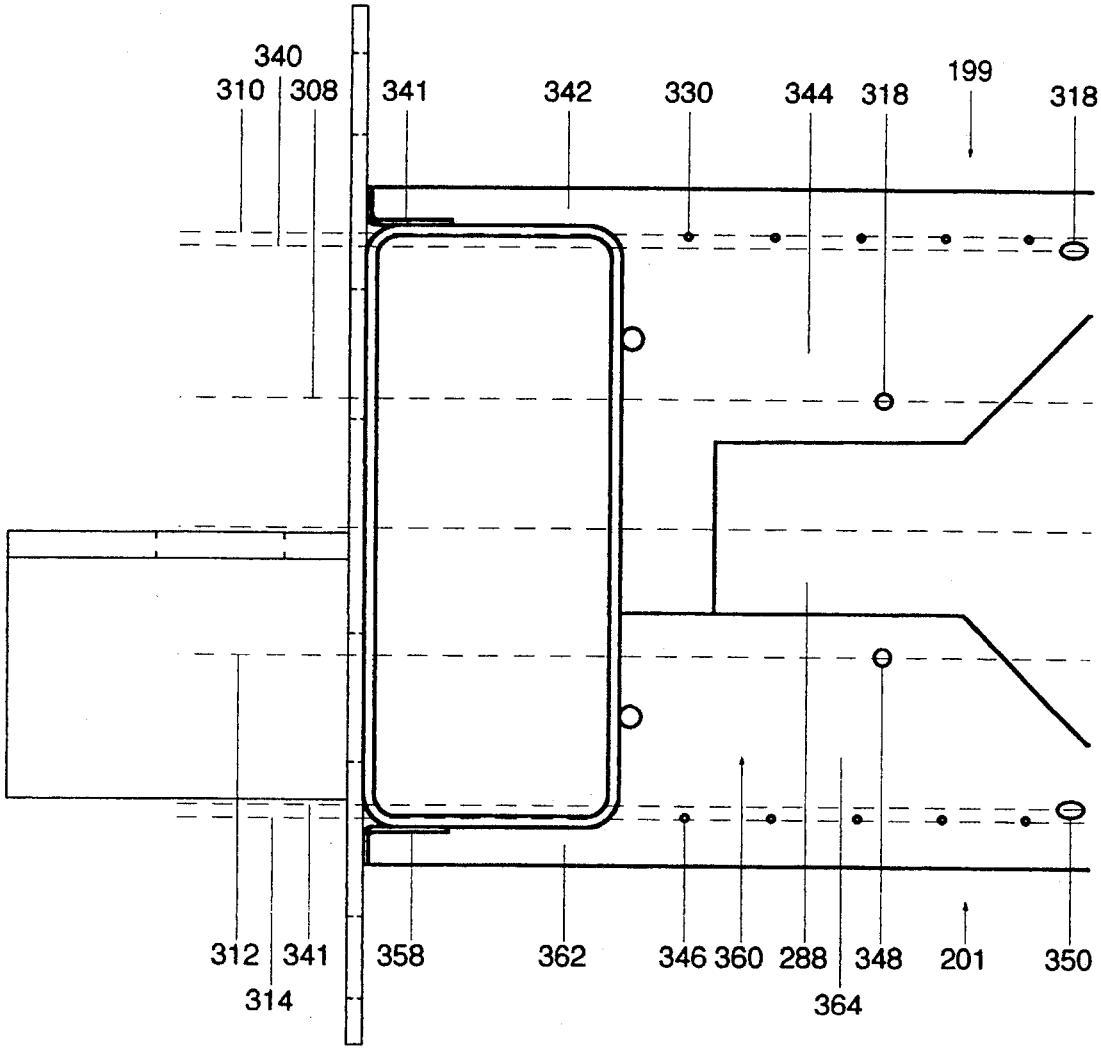
Figure 20:
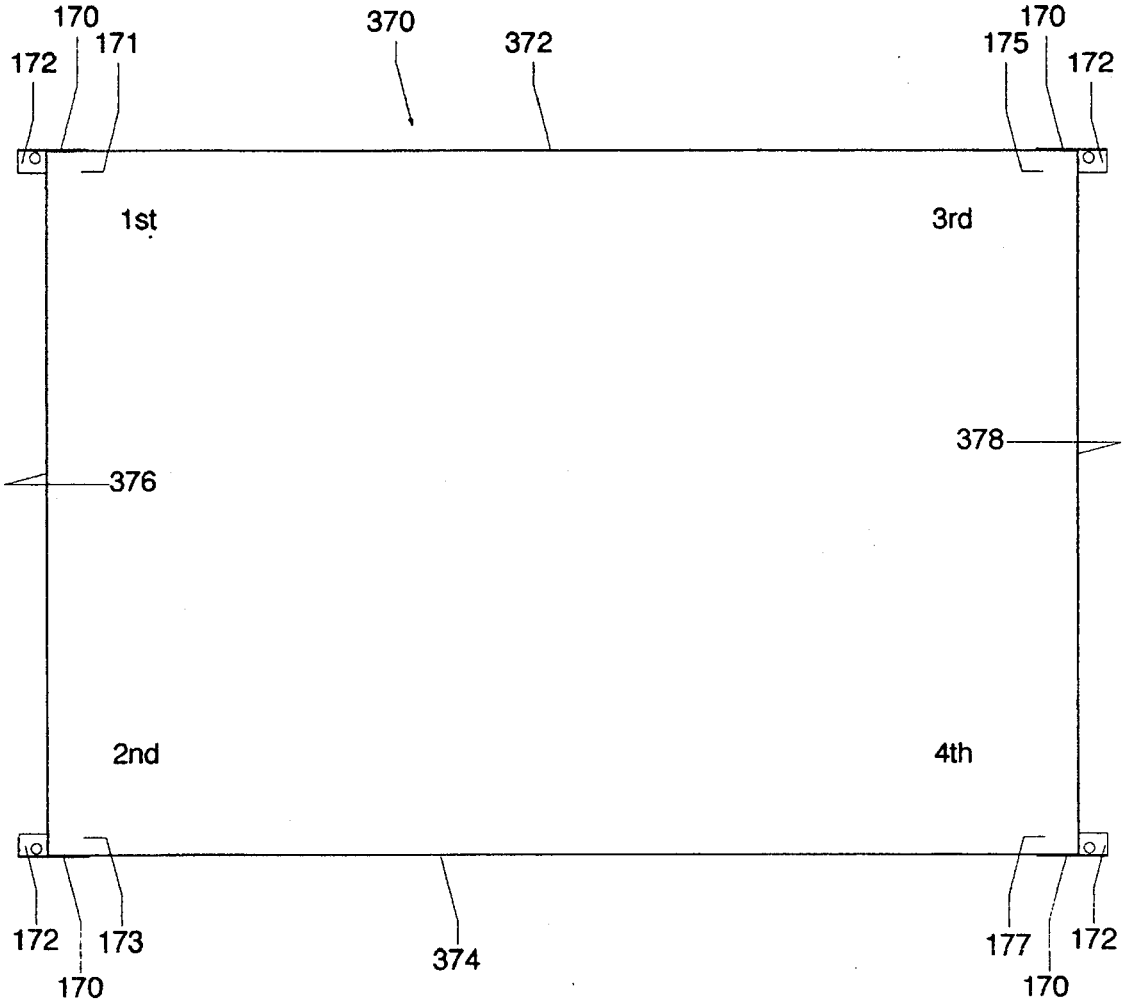
Figure 21:
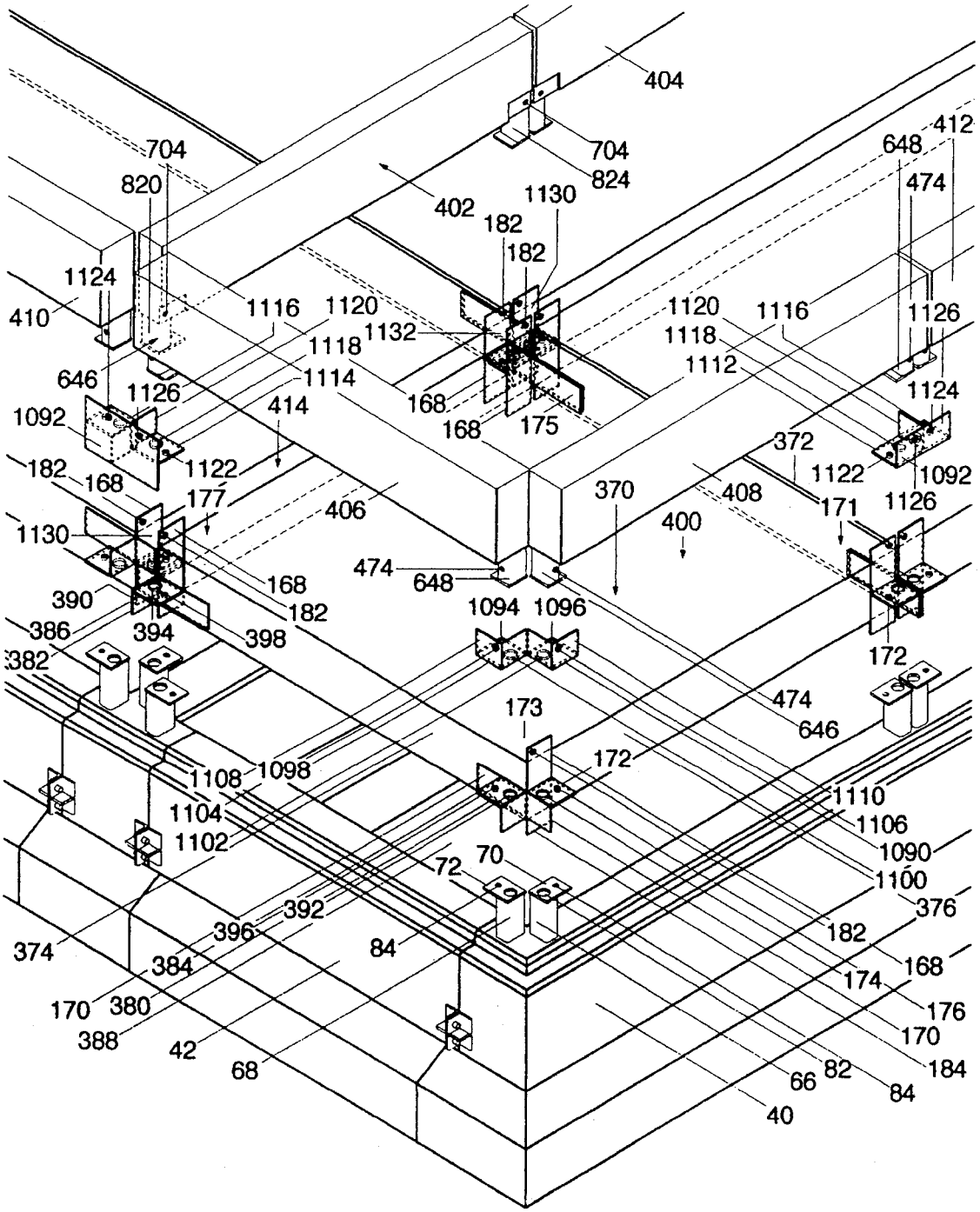

FIG. 4 is an exploded view of frame members included in a floor panel according to a second embodiment of the invention;

FIG. 5 is a side view of an end portion of a top frame member shown in FIG. 4;

FIG. 6 is a bottom view of the end portion shown in FIG. 5;

FIG. 7 is an end view of the end portion shown in FIG. 5;

FIG. 8 is a side view of an end portion of a side frame member shown in FIG. 4;

FIG. 9 is a face view of the end portion shown in FIG. 8;

FIG. 10 is an end view of the end portion shown in FIG. 8;

FIG. 11 is a plan view of the floor panel with insulation installed between the frame members;

FIG. 12 is a cross-sectional view taken along lines 12—12 of FIG. 11;

FIG. 13 is a cross-sectional view taken along lines 13—13 of FIG. 11;

FIG. 14 is a plan view of the floor panel illustrating horizontal, vertical and diagonal tension wire portions;

FIG. 15 is a cross-sectional view taken along lines 15—15 of FIG. 14;

FIG. 16 is a plan view of the floor panel with mesh portions covering the insulating material;

FIG. 17 is a cross-sectional view taken along lines 17—17 of FIG. 16;

FIG. 18 is a cross-sectional view of a portion of the floor panel illustrating the formation of a planar portion and a rib portion in cast concrete;

FIG. 19 is a cross-sectional view of a portion of the floor panel illustrating first and second cast portions of concrete;

FIG. 20 is a plan view of the completed floor panel;

FIG. 21 is an exploded view illustrating a connection of the floor panel shown in FIG. 20 with interior and exterior panels according to the invention, and with the foundation shown in FIG. 3;

Exterior Panel

Figure 22:
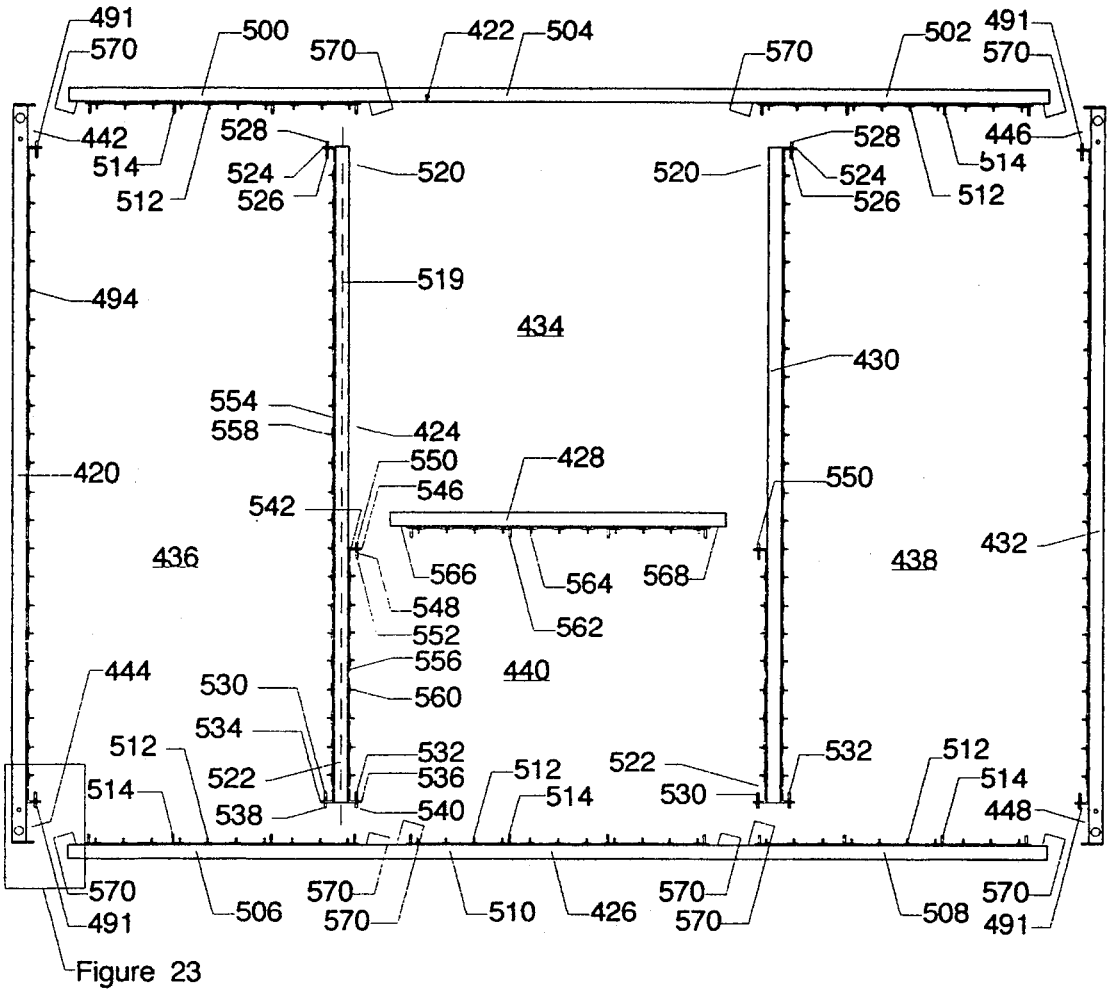
Figure 23:
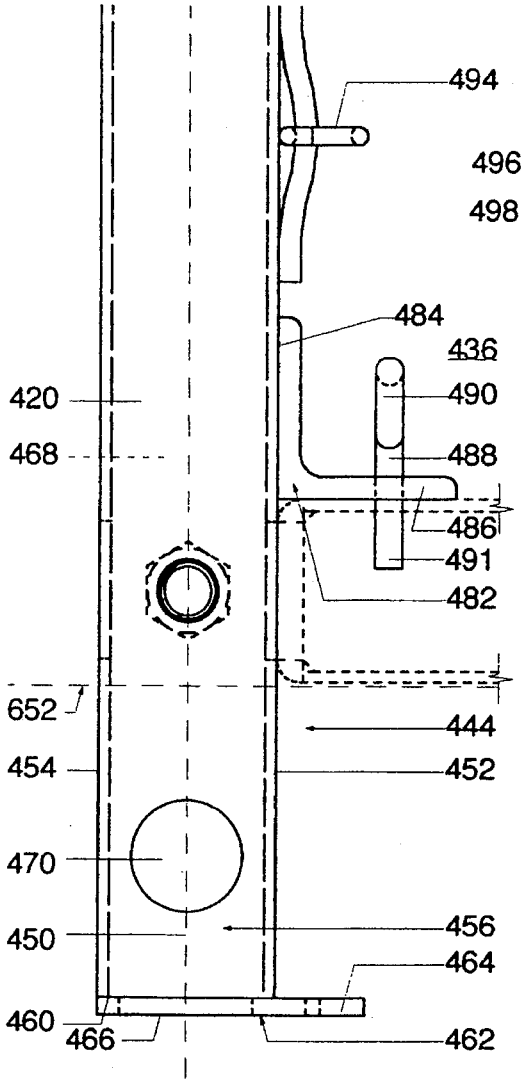
Figure 24:
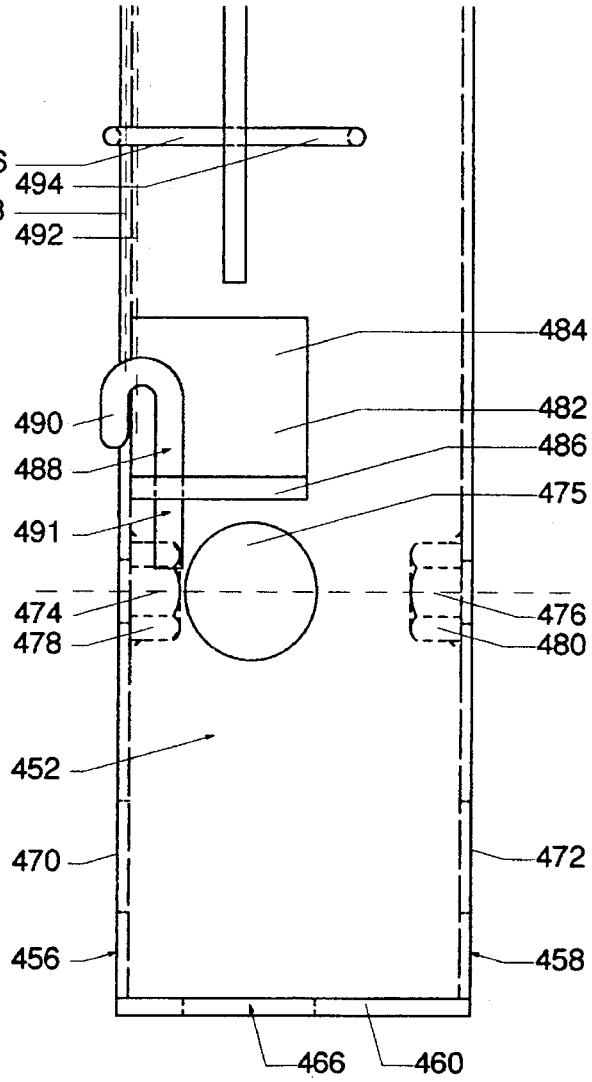
Figure 25:
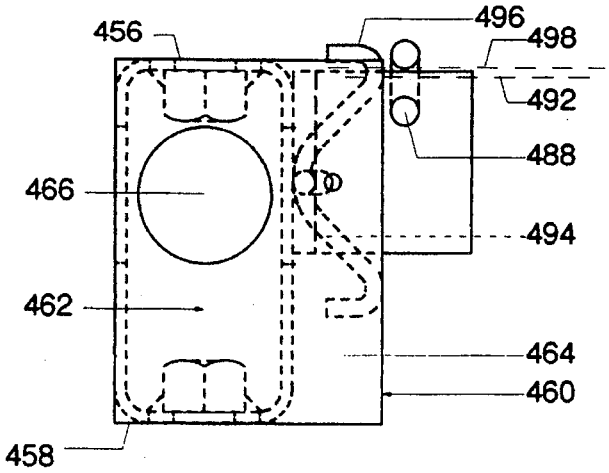
Figure 26:
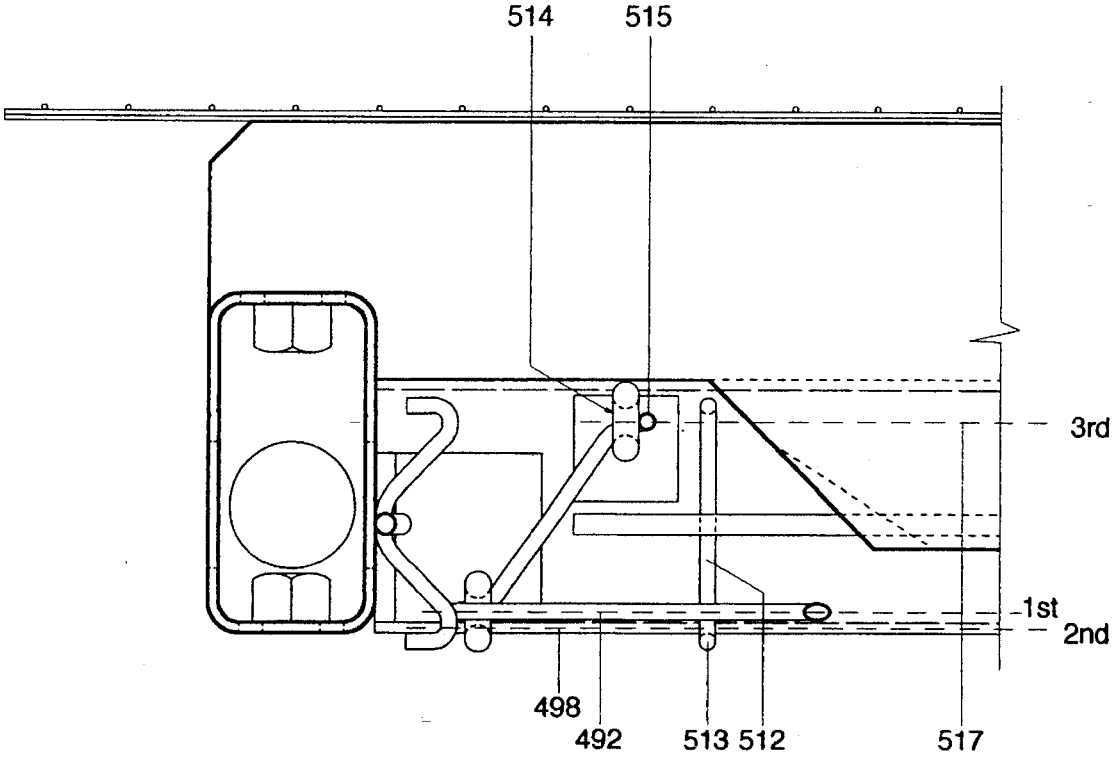
Figure 27:
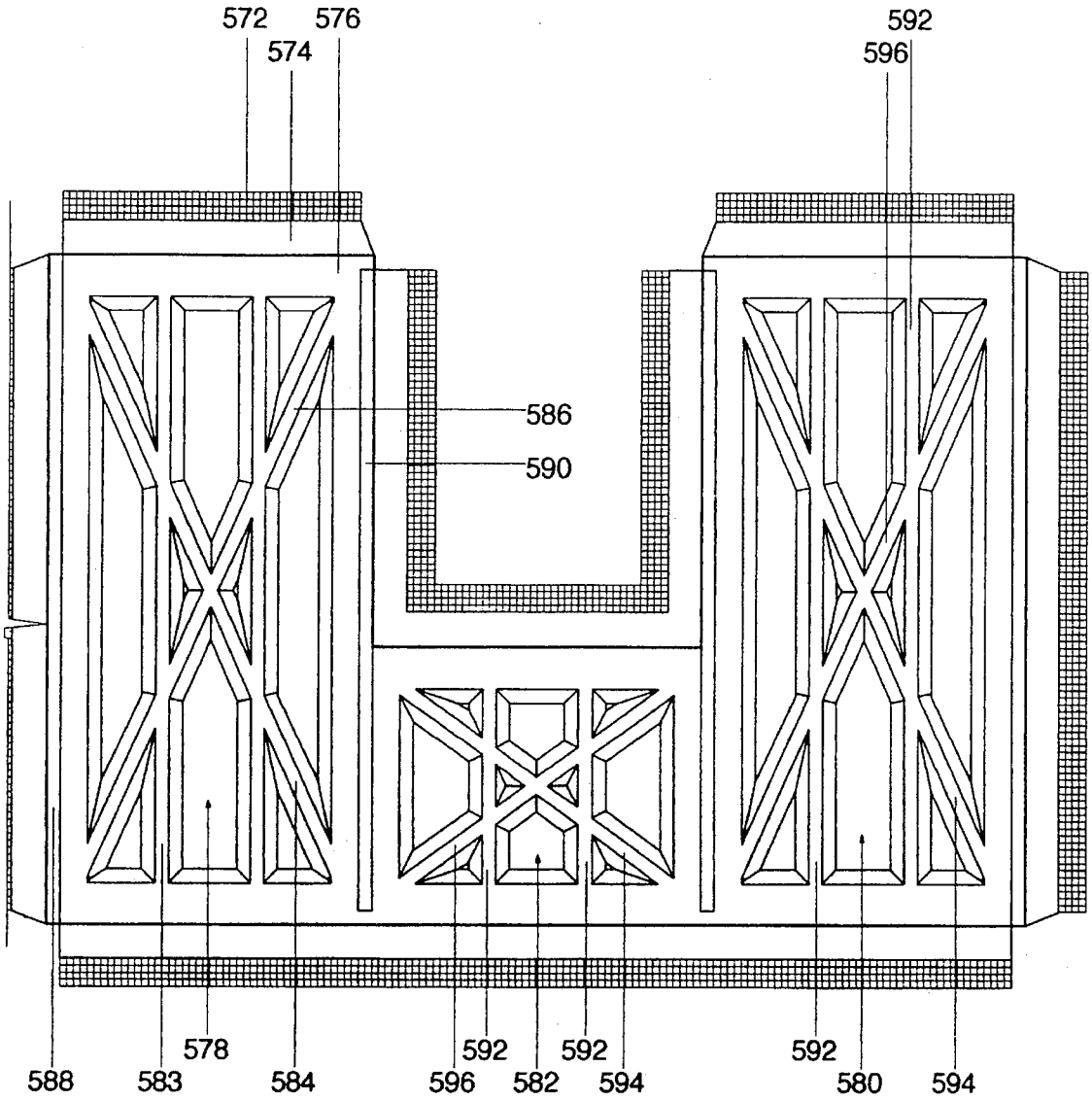
Figure 28:
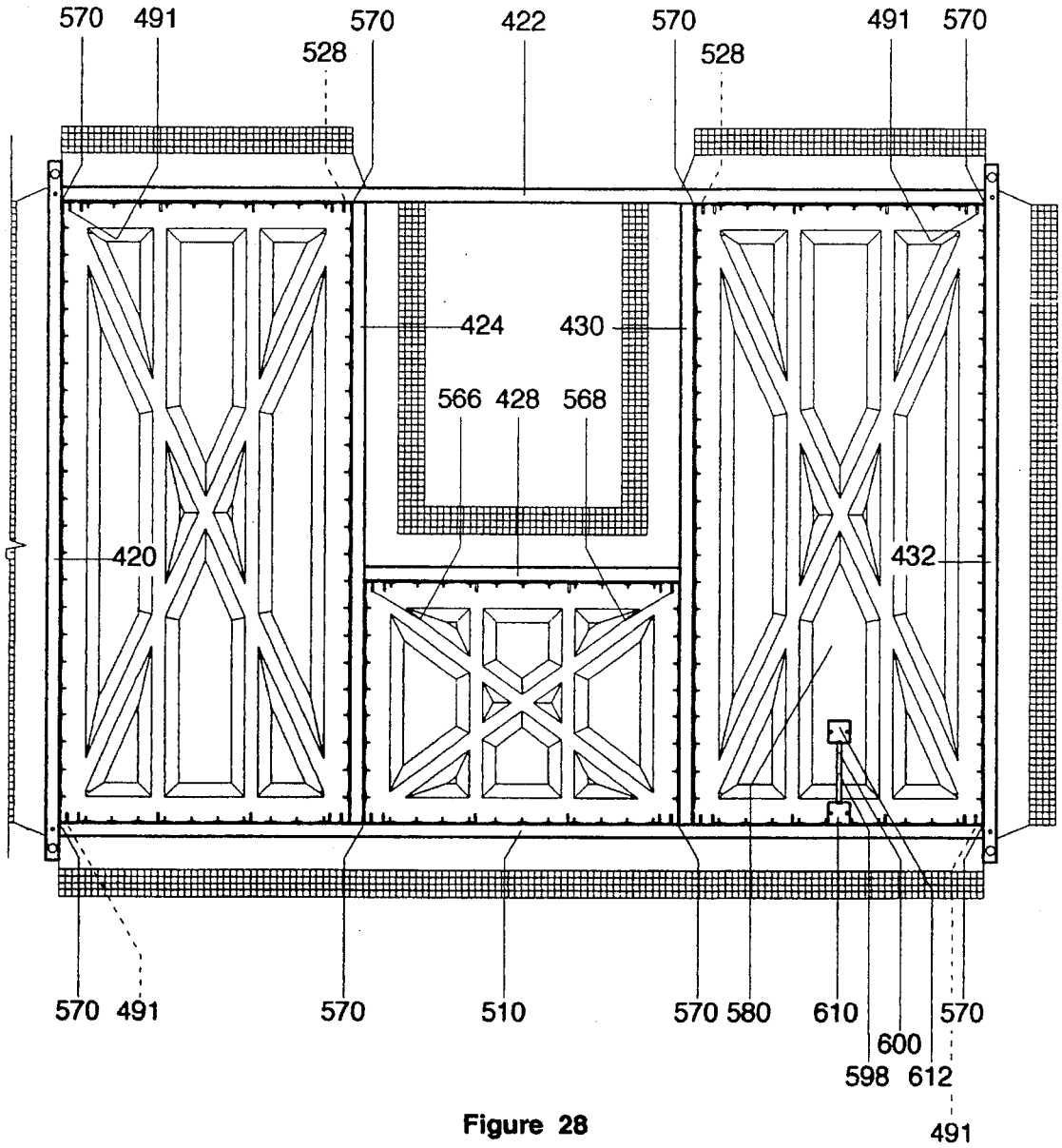
Figure 29:
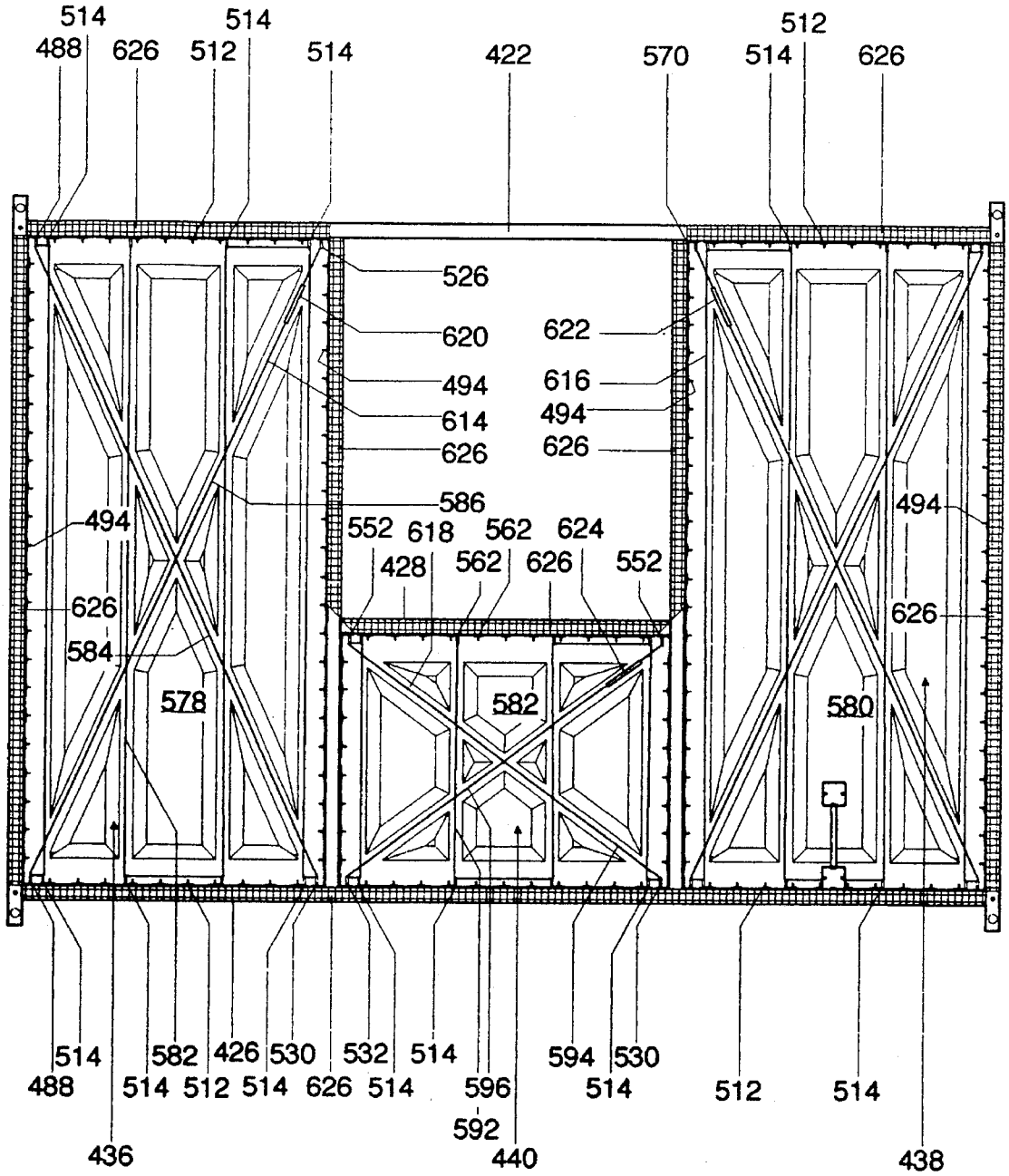
Figure 30:
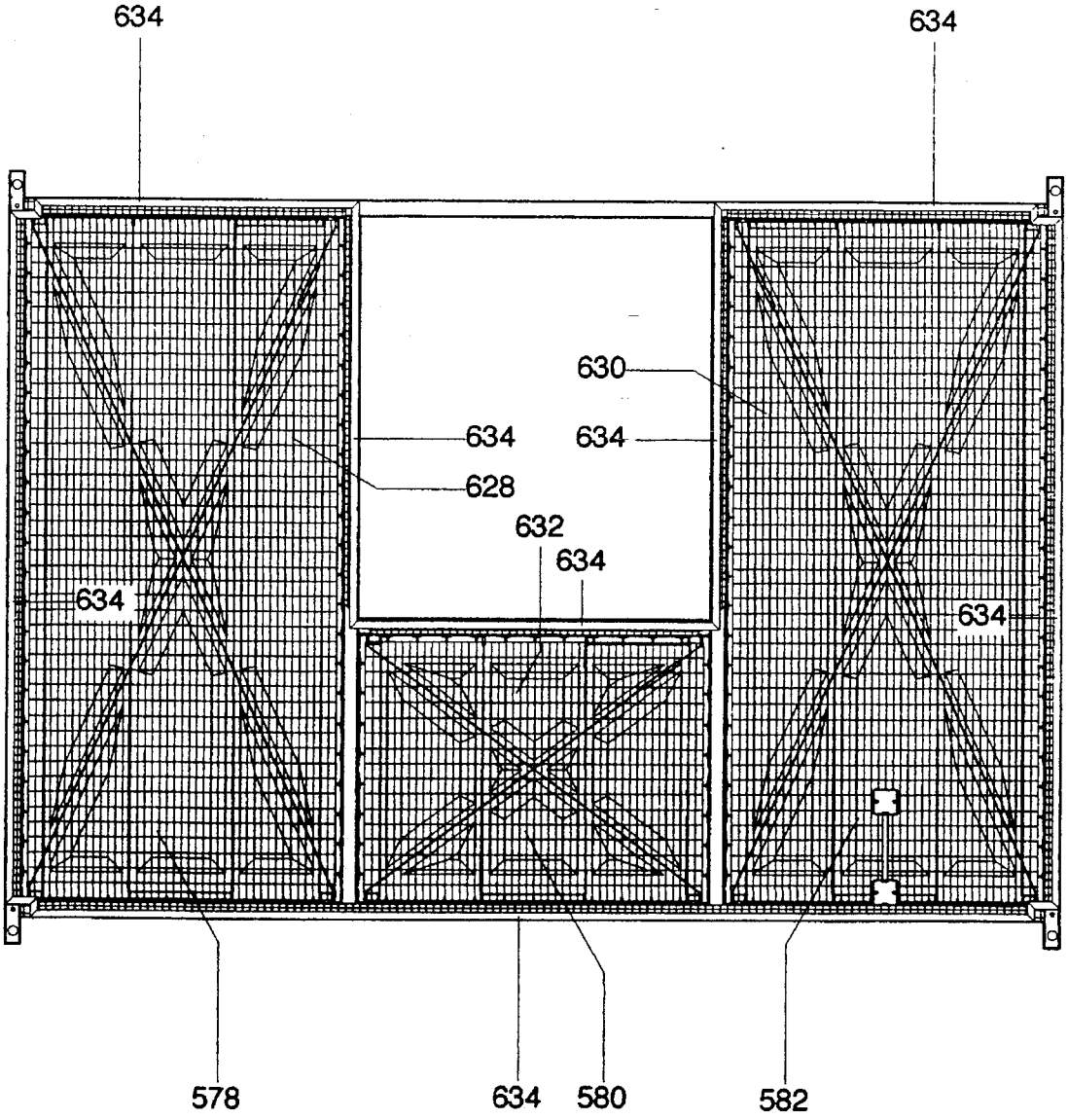
Figure 31:
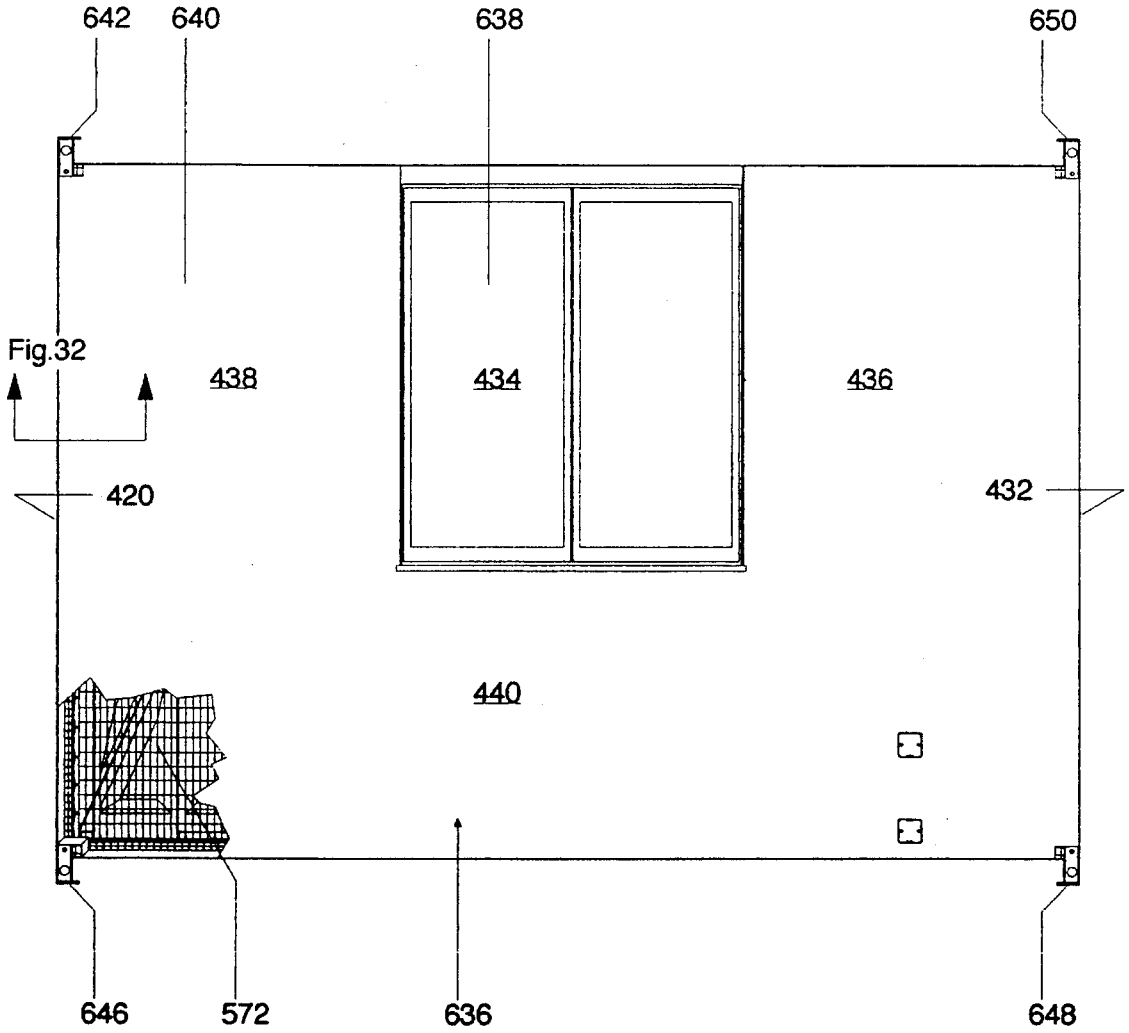
Figure 32:
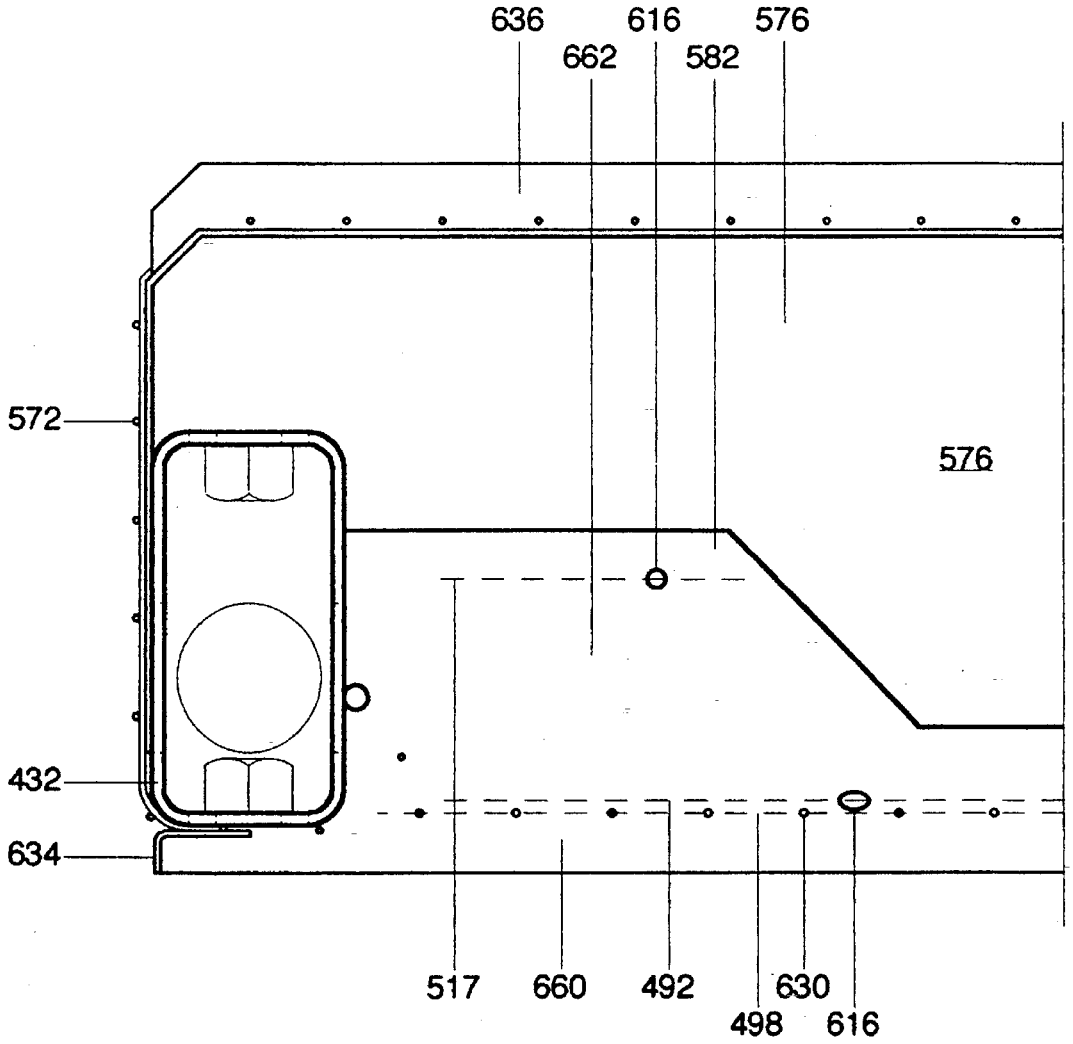

FIG. 22 is a plan view of frame members included in an exterior panel according to a third embodiment of the invention;

FIG. 23 is a side view of a portion of a side frame member shown in FIG. 22;

FIG. 24 is a face view of the frame portion shown in FIG. 23;

FIG. 25 is a bottom view of the frame portion shown in FIG. 23;

FIG. 26 is a face view of a portion of a top frame member shown in FIG. 22;

FIG. 27 is a plan view illustrating a first assembly step in assembling the exterior panel;

FIG. 28 is a plan view illustrating a second assembly step in which the frame members are placed upon an insulating portion;

FIG. 29 is a plan view illustrating a third assembly step in assembling the exterior panel, in which tension cables are routed between frame members;

FIG. 30 is a plan view illustrating a fourth step in assembling the exterior panel, in which mesh portions are connected over panel portions of the panel;

FIG. 31 is a plan view of a completed exterior panel according to the third embodiment of the invention;

FIG. 32 is a cross-sectional view of the completed exterior panel taken along lines 32—32 of FIG. 31.

Interior Panel

Figure 33:
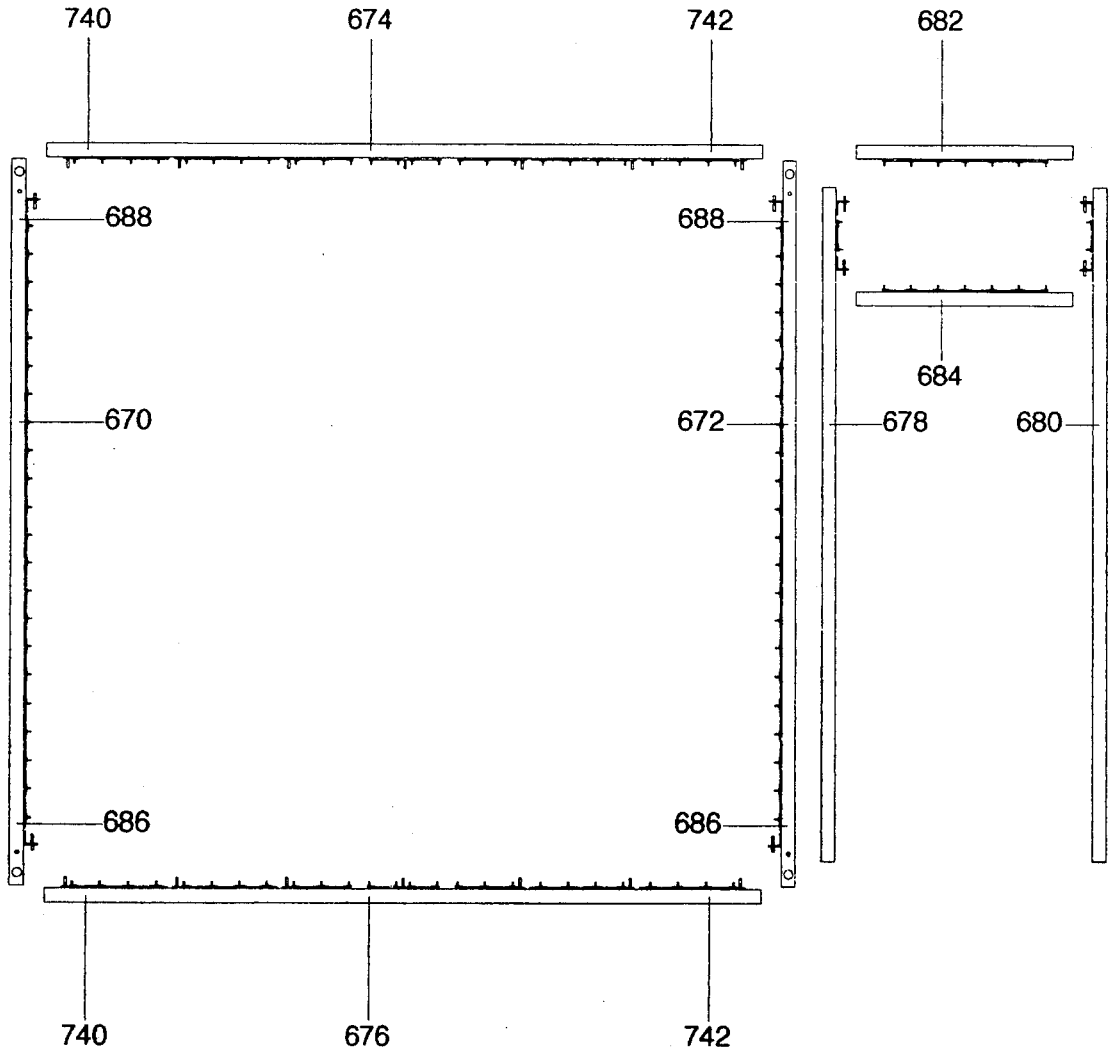
Figure 34:
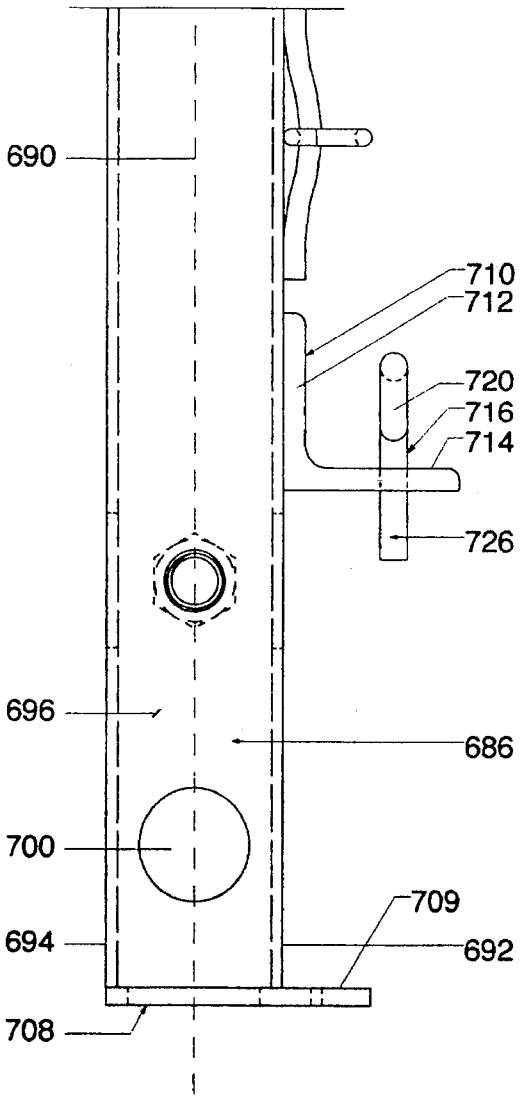
Figure 35:
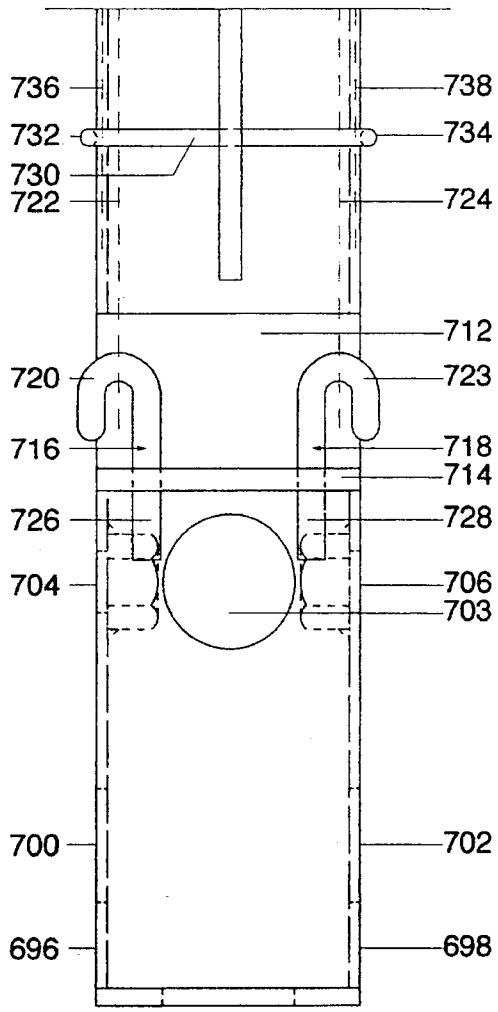
Figure 36:
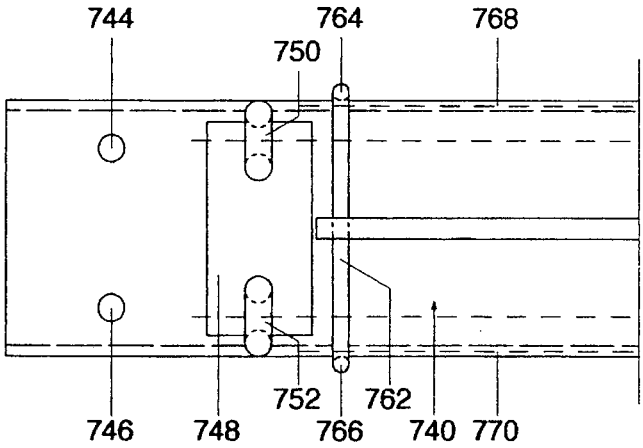
Figure 37:
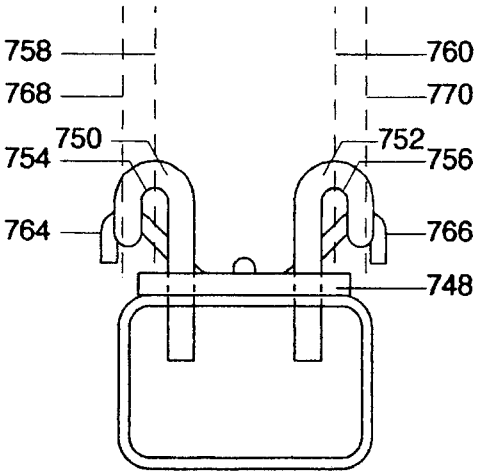
Figure 38:
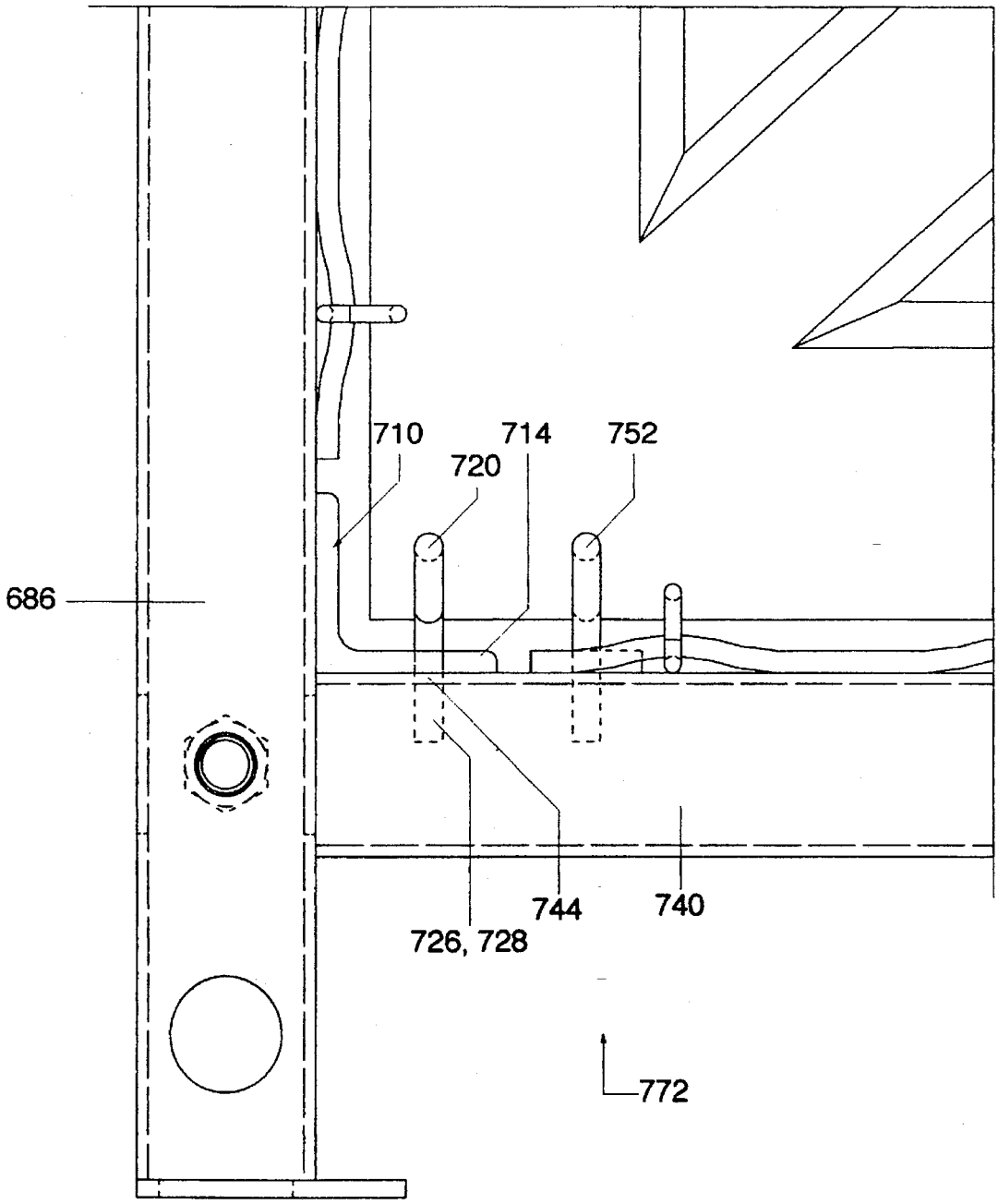
Figure 39:
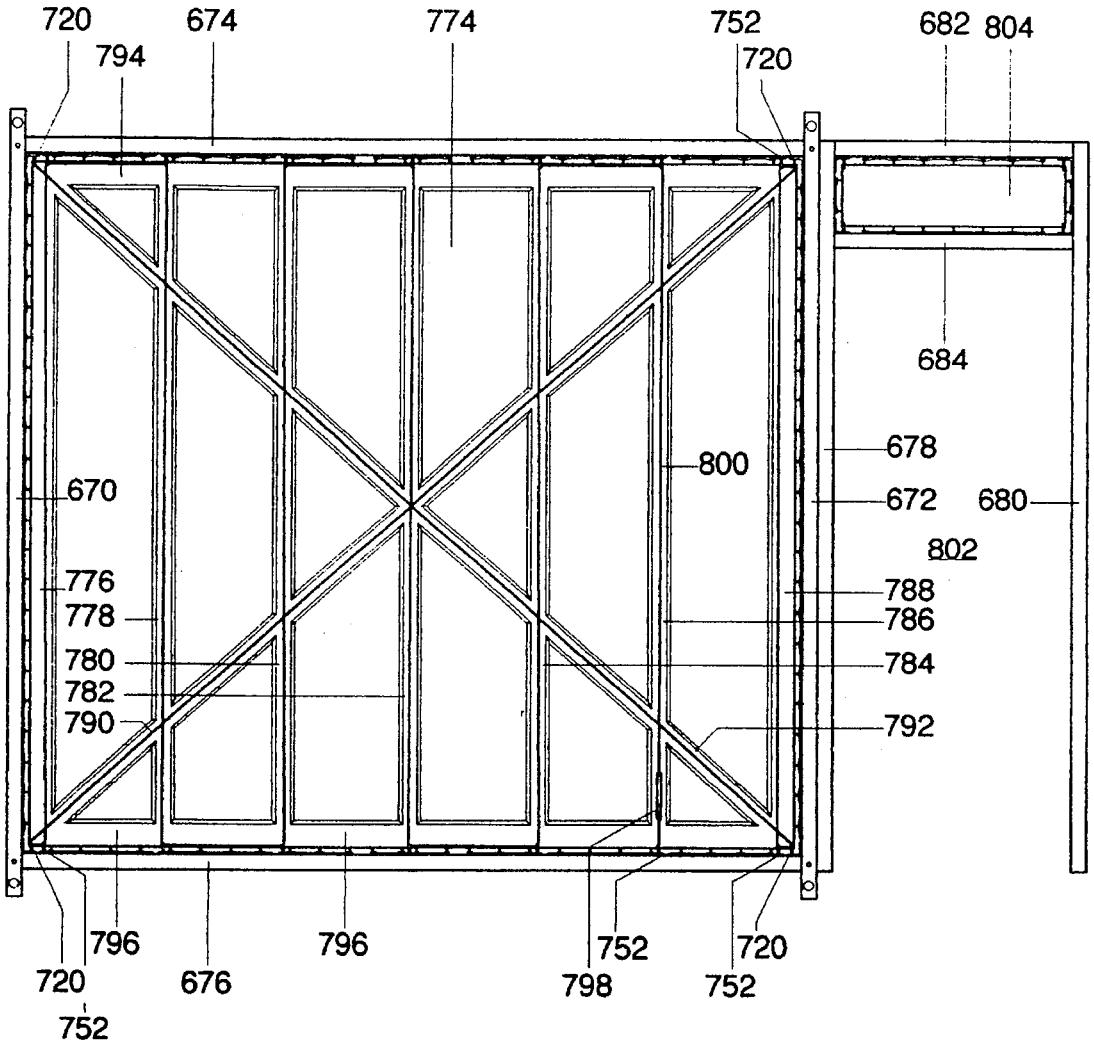
Figure 40:
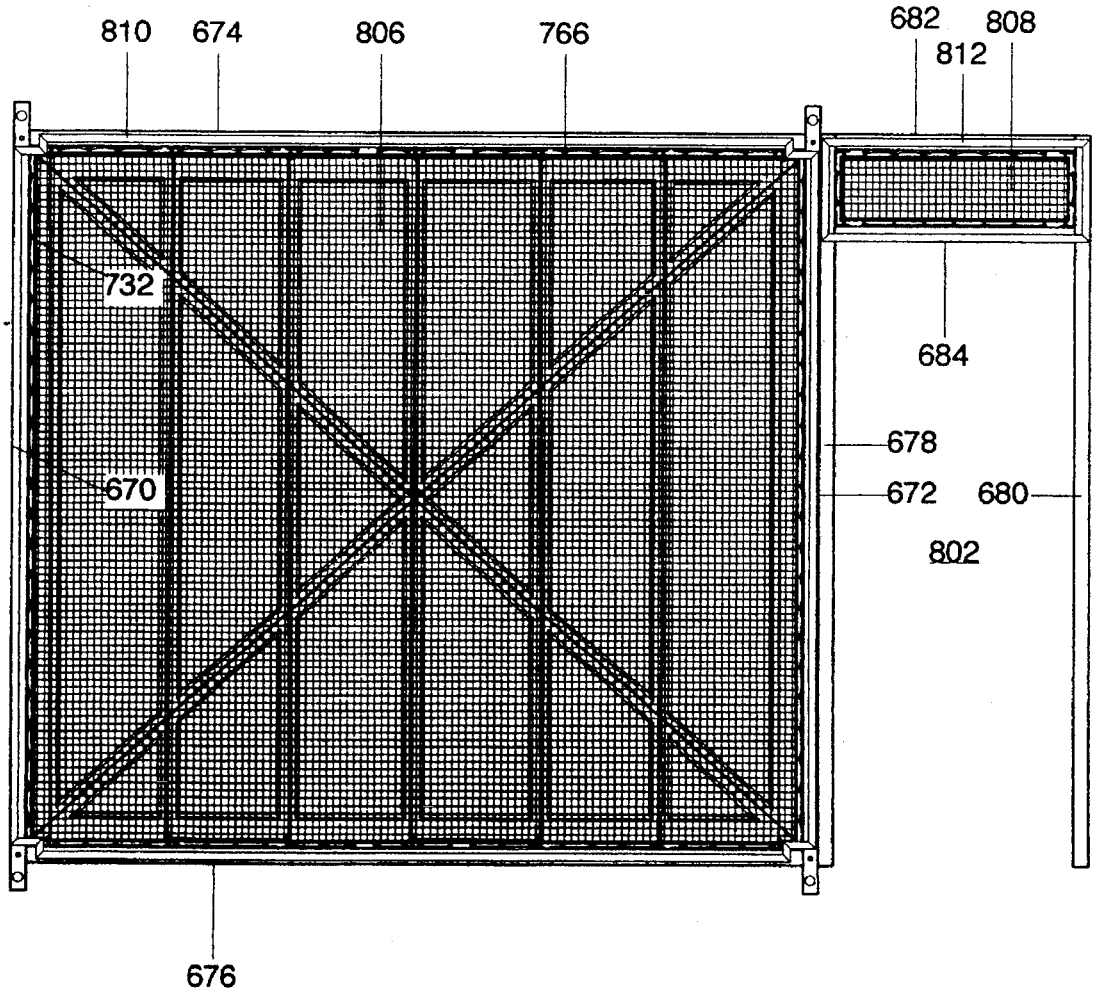
Figure 41:
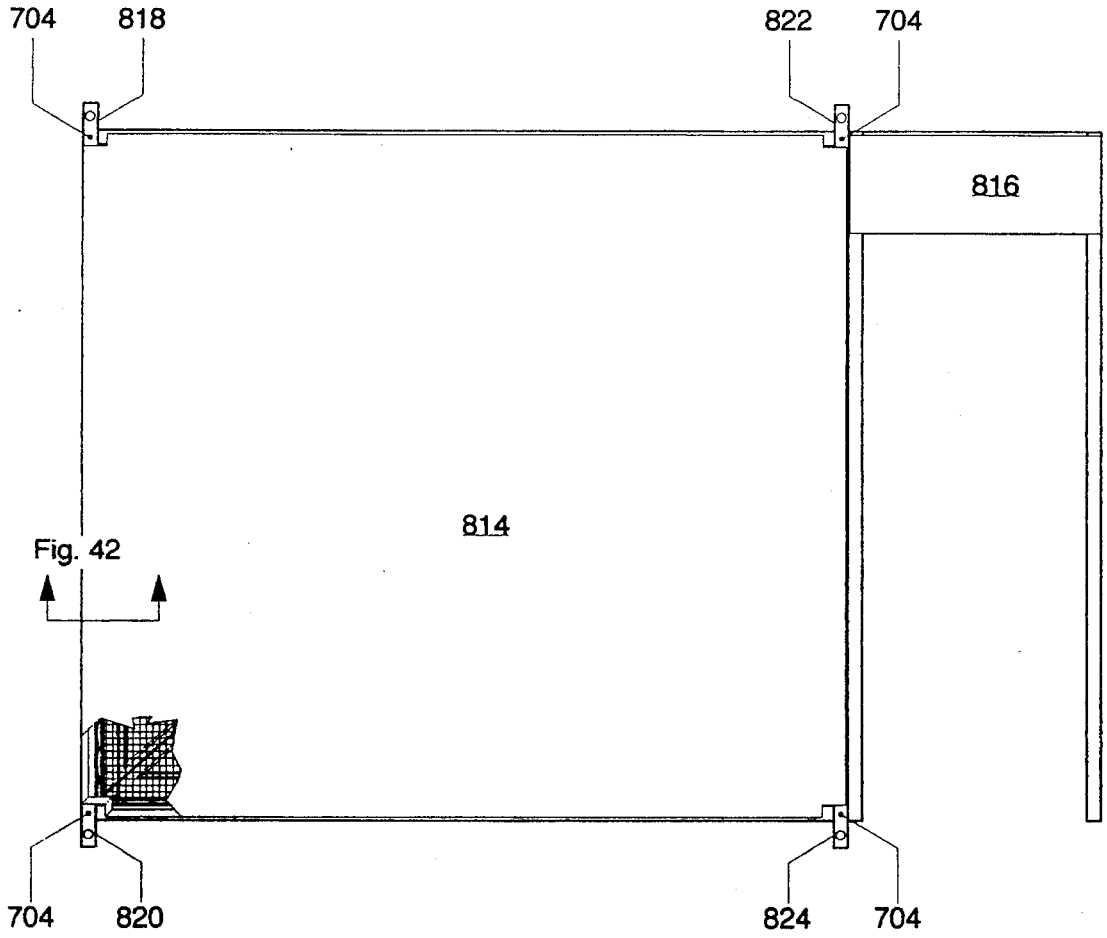
Figure 42:
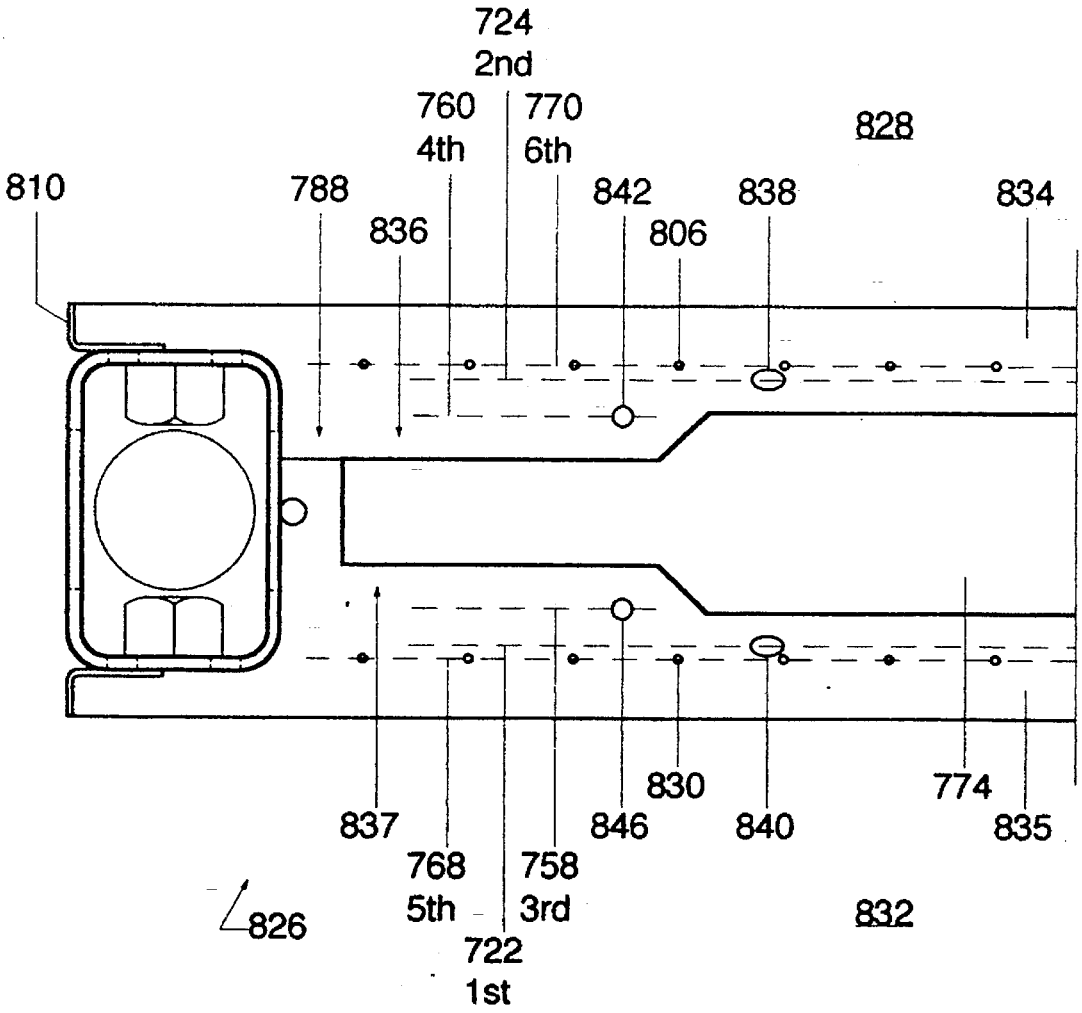

FIG. 33 is a plan view of frame members included in an interior panel according to a fourth embodiment of the invention;

FIG. 34 is a side view of a portion of a side frame member shown in FIG. 33;

FIG. 35 is a face view of the frame portion shown in FIG. 34;

FIG. 36 is a face view of a frame portion of a top frame member shown in FIG. 33;

FIG. 37 is an end view of the frame portion shown in FIG. 36;

FIG. 38 is a plan view illustrating the connection of the frame portion of FIG. 34 with the frame portion of FIG. 36;

FIG. 39 is a plan view of an assembly step in forming the interior panel, including the routing of tension cables between frame members;

FIG. 40 is a plan view of an assembly step in forming the interior panel, including the connection of mesh material between the frame members;

FIG. 41 is a plan view of a finished interior panel;

FIG. 42 is a cross-sectional view taken along lines 42—42 of the interior panel shown in FIG. 41;

Roof Panels

Figure 43:
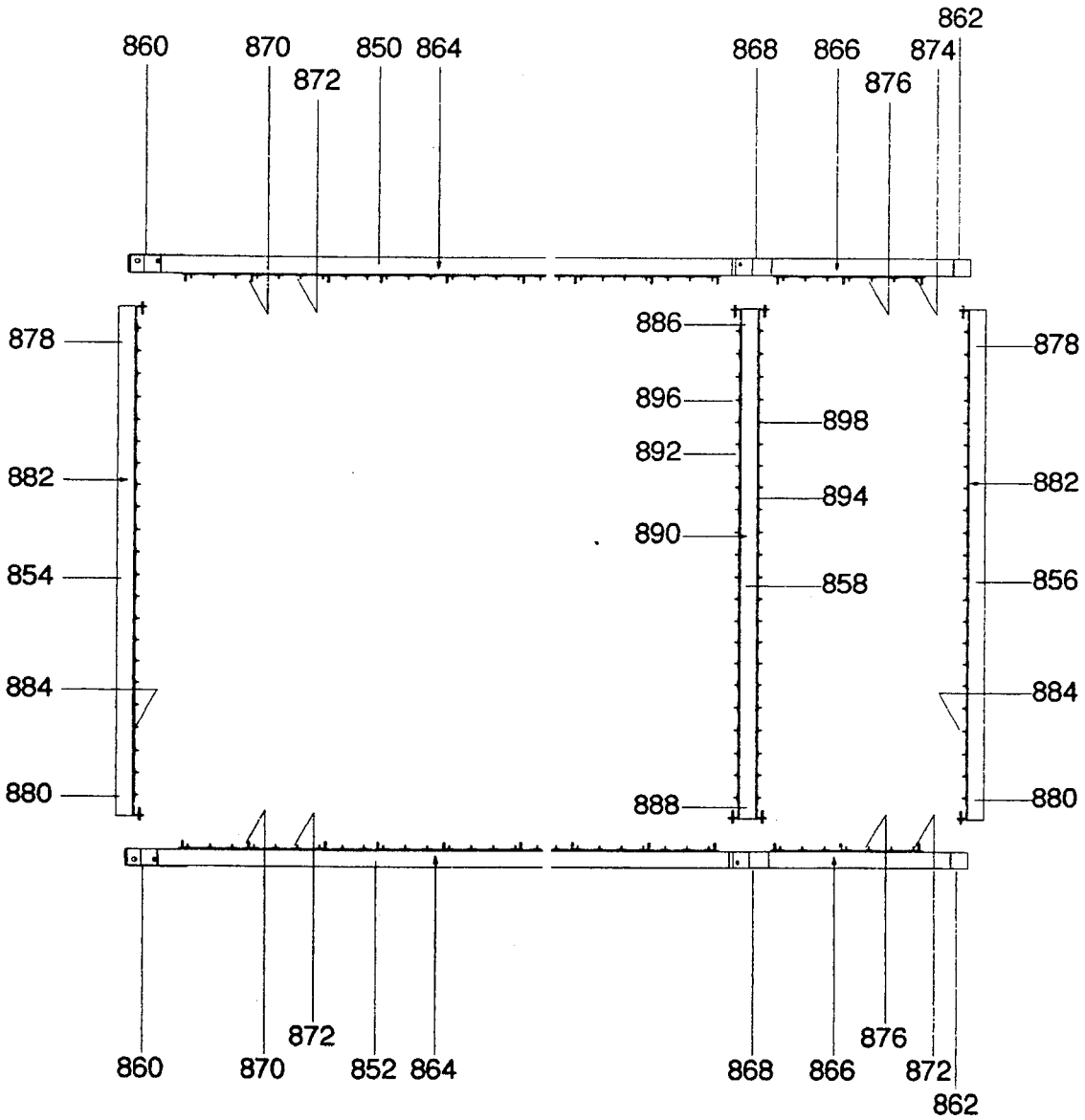
Figure 44:
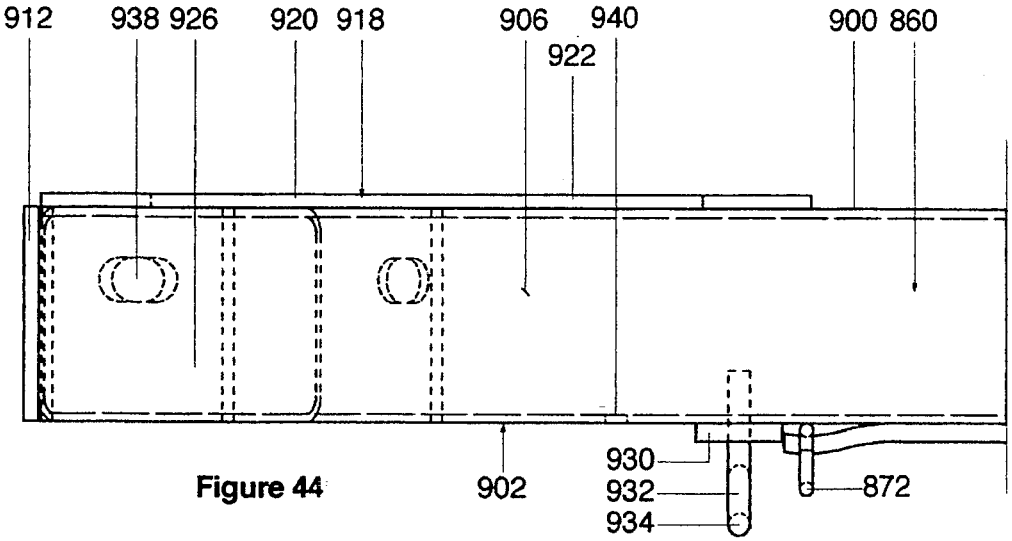
Figure 45:
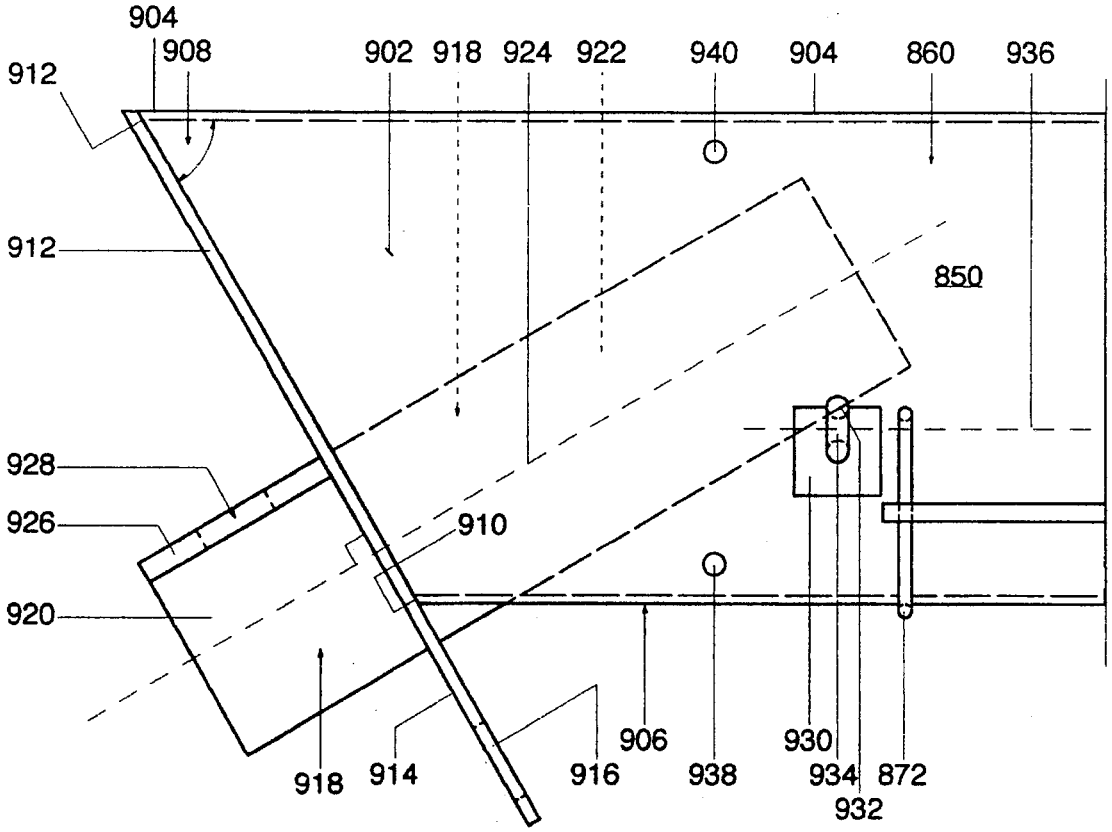
Figure 46:
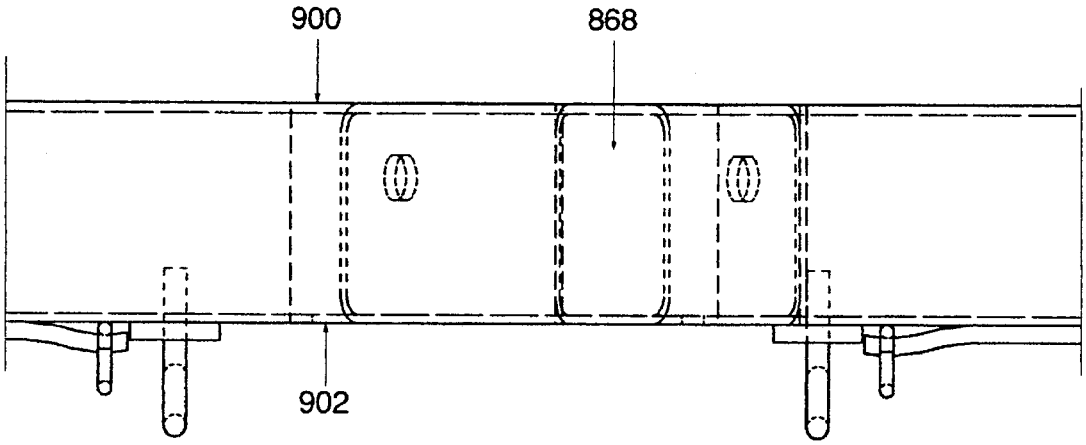
Figure 47:
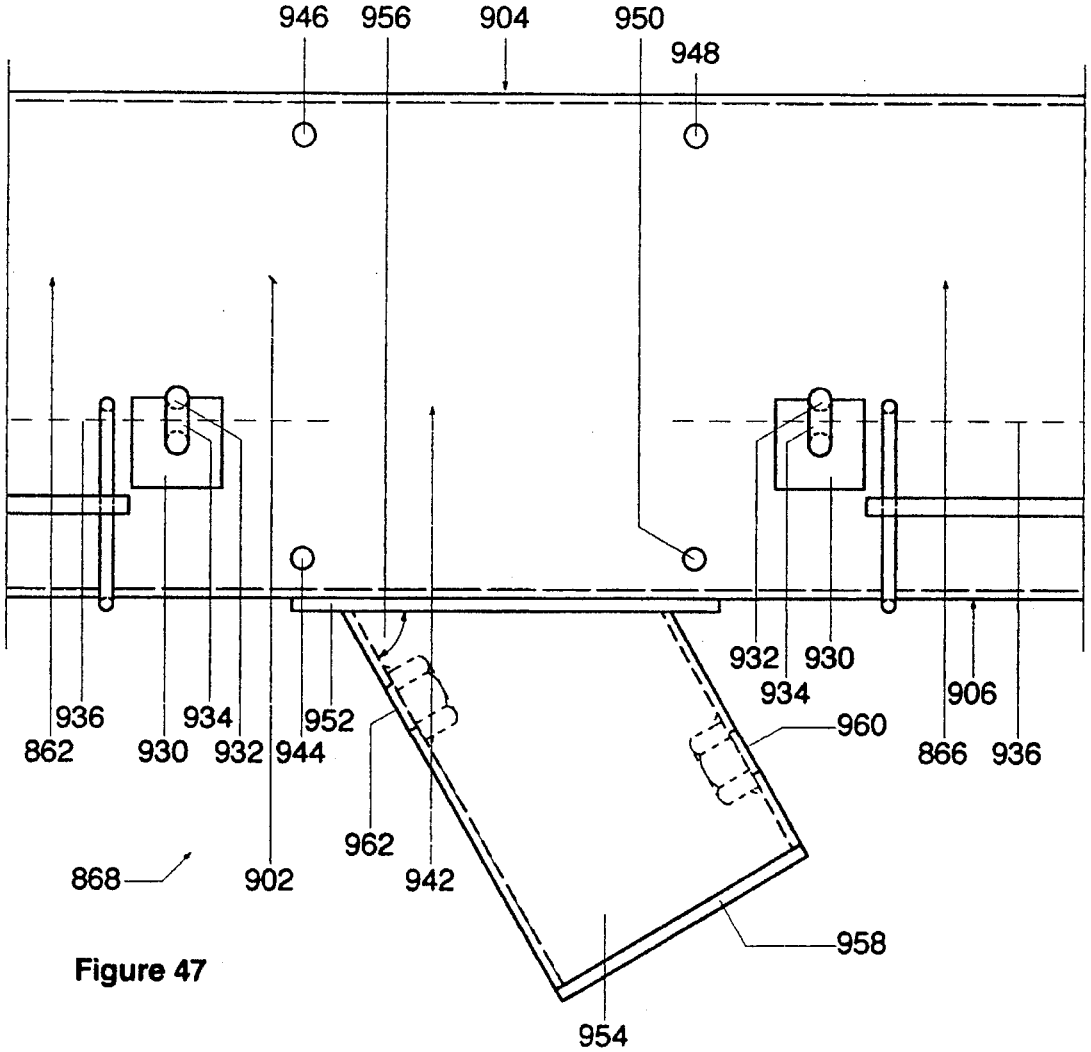
Figure 48:
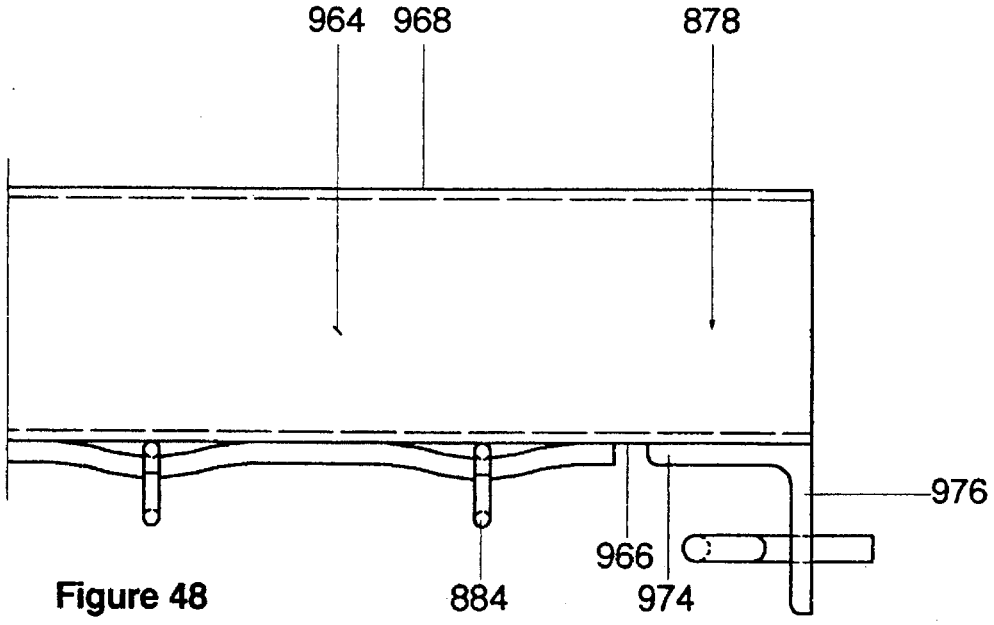
Figure 49:
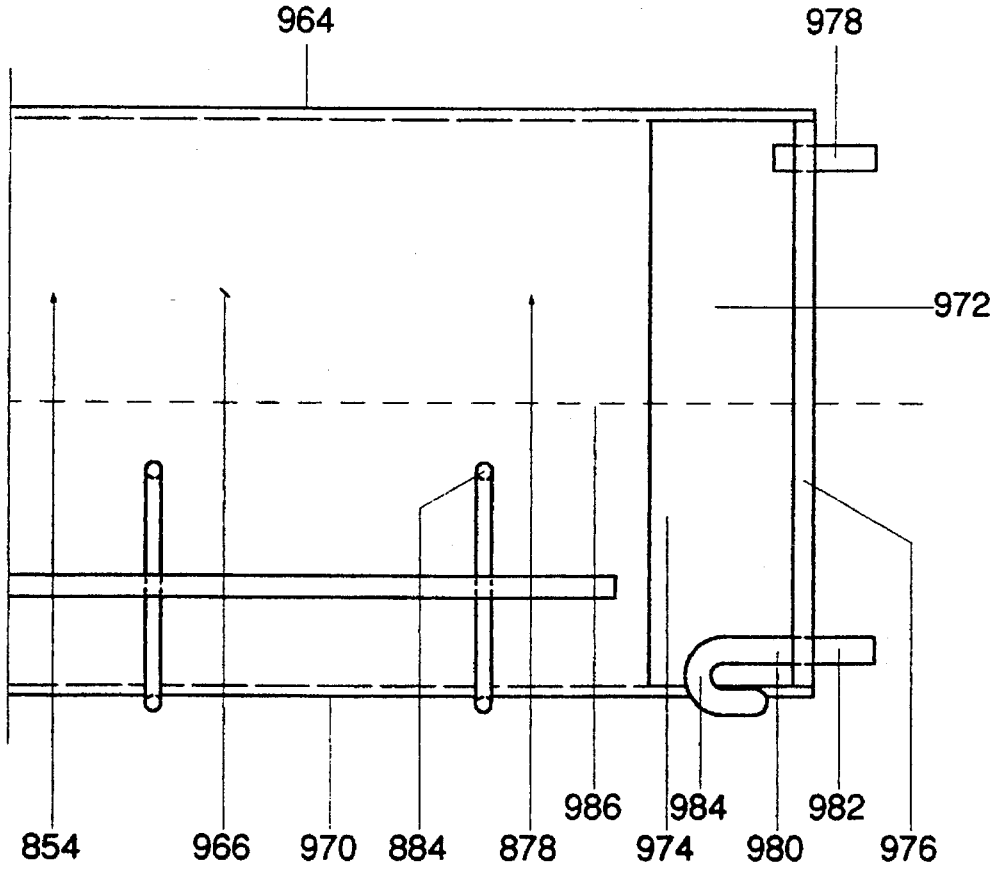
Figure 50:
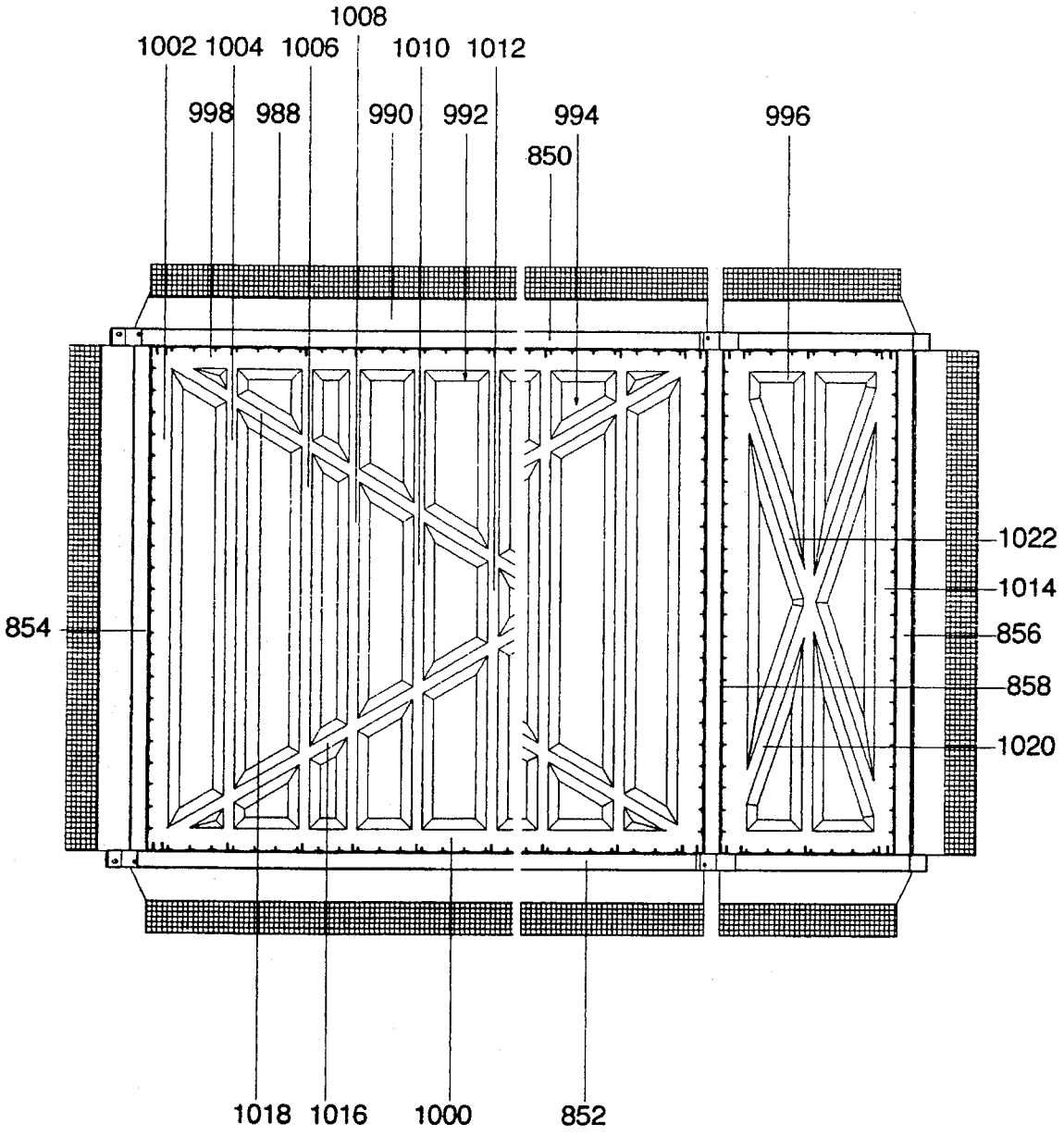
Figure 51:
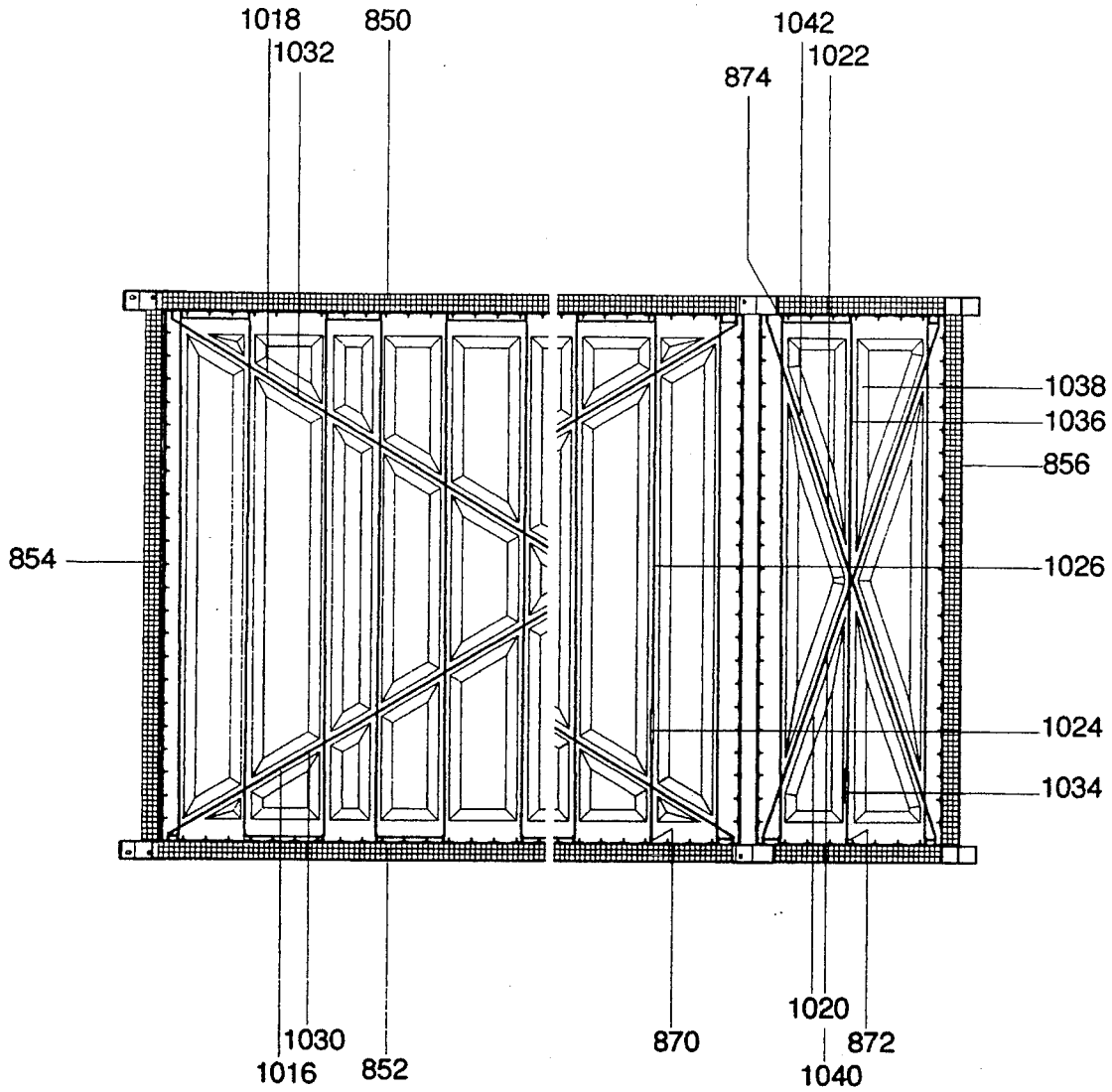
Figure 52:
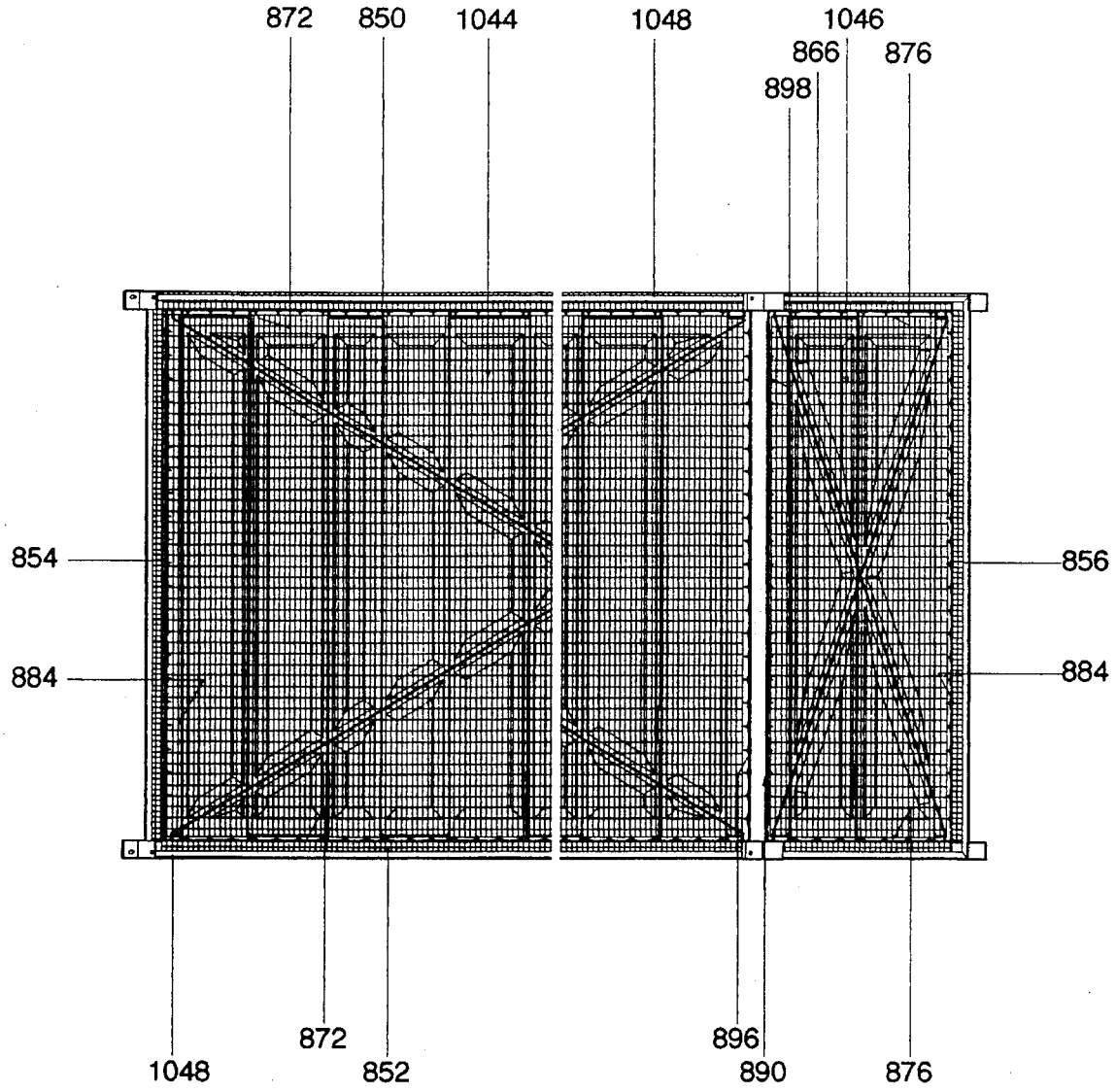
Figure 53:
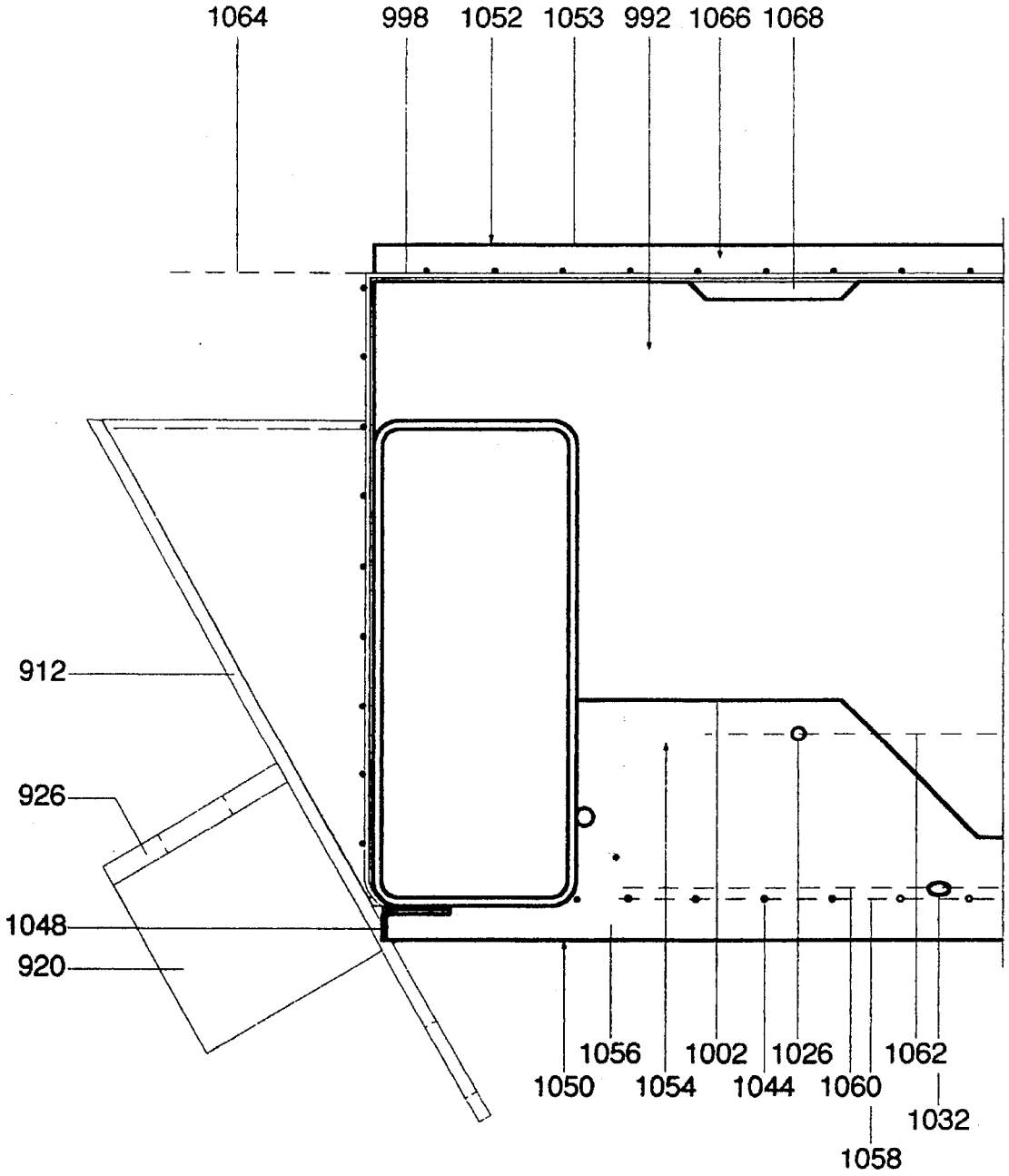
Figure 54:
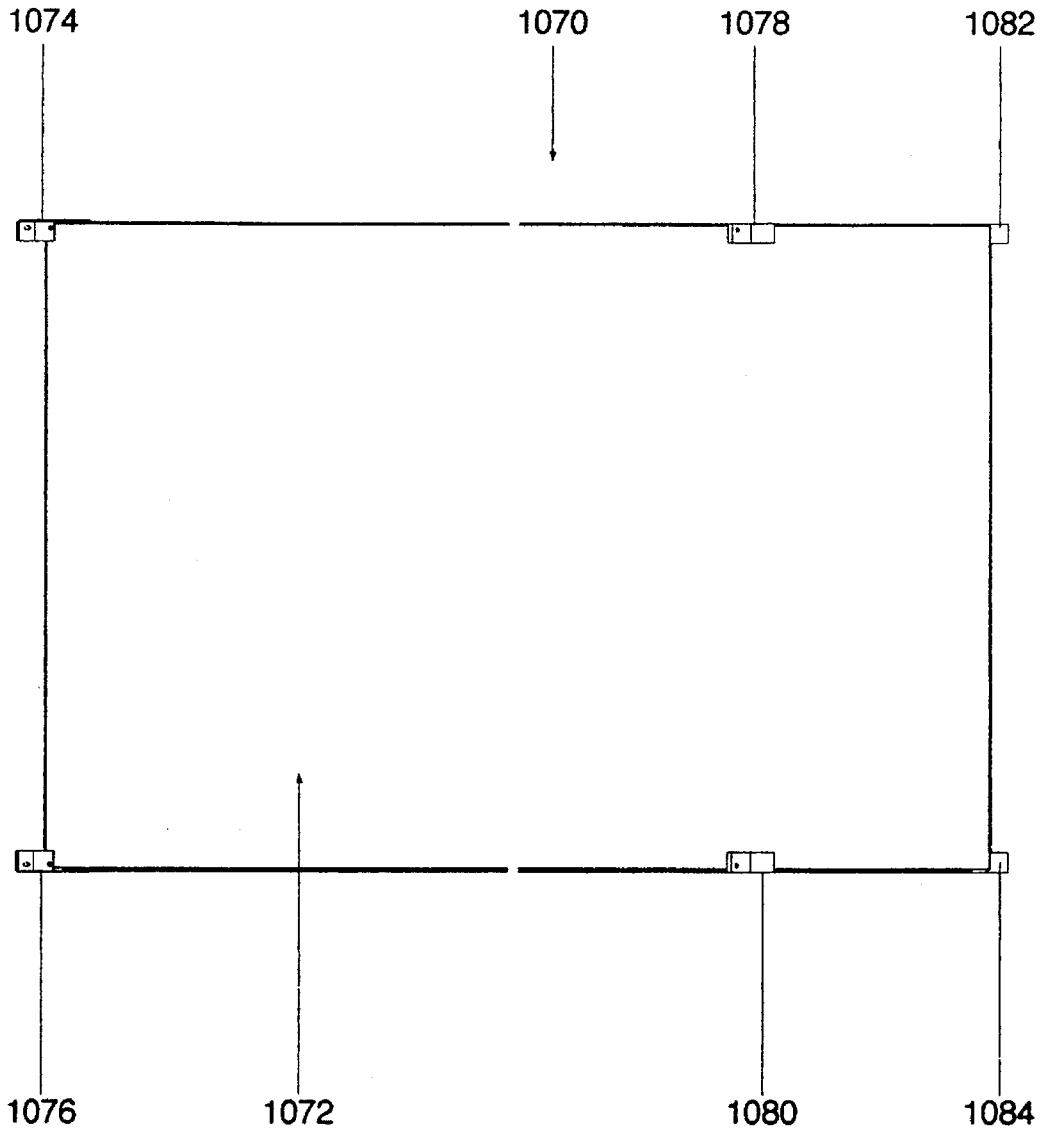

FIG. 43 is a plan view of frame members included in a roof panel according to a fifth embodiment of the invention;

FIG. 44 is a side view of a frame portion of a top frame member shown in FIG. 43;

FIG. 45 is a face view of the frame portion shown in FIG. 44;

FIG. 46 is a side view of a connecting portion of the top frame member shown in FIG. 43;

FIG. 47 is a face view of the connecting portion shown in FIG. 46;

FIG. 48 is a side view of a top end portion of a side frame member of FIG. 43;

FIG. 49 is a face view of the top end portion shown in FIG. 48;

FIG. 50 is a plan view of an assembly step in forming the roof panel, in which the frame members are placed on an insulating material;

FIG. 51 is a plan view of an assembly step in forming the roof panel wherein tension cables are connected between frame members;

FIG. 52 is a plan view of an assembly step in forming the roof panel wherein a first layer of mesh material is connected between frame members;

FIG. 53 is a cross-sectional view of a completed roof panel according to the fifth embodiment of the invention;

FIG. 54 is a plan view of a completed roof panel according to the fifth embodiment of the invention;

Assembly of Panels

Figure 55:
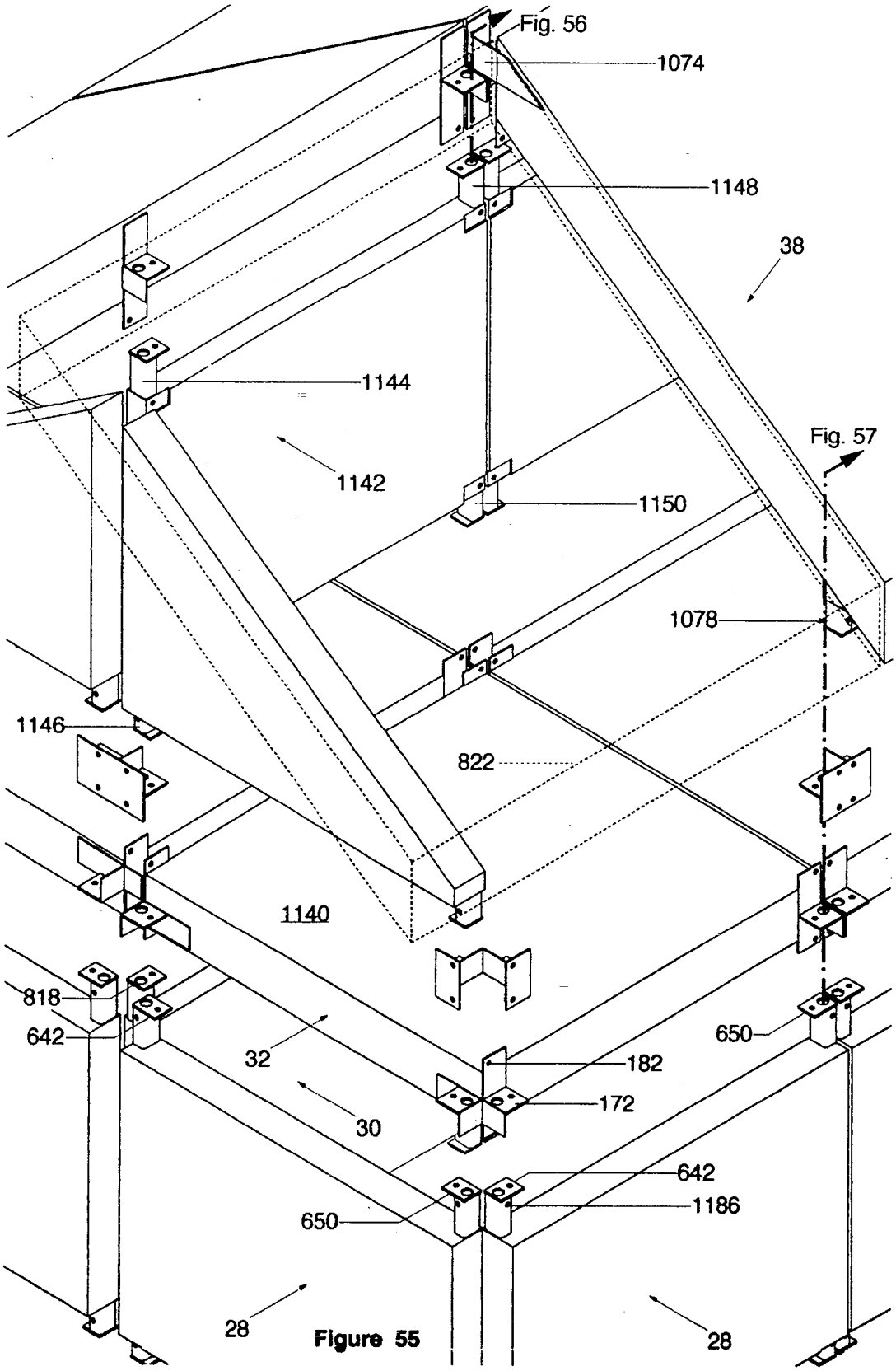
Figure 56:
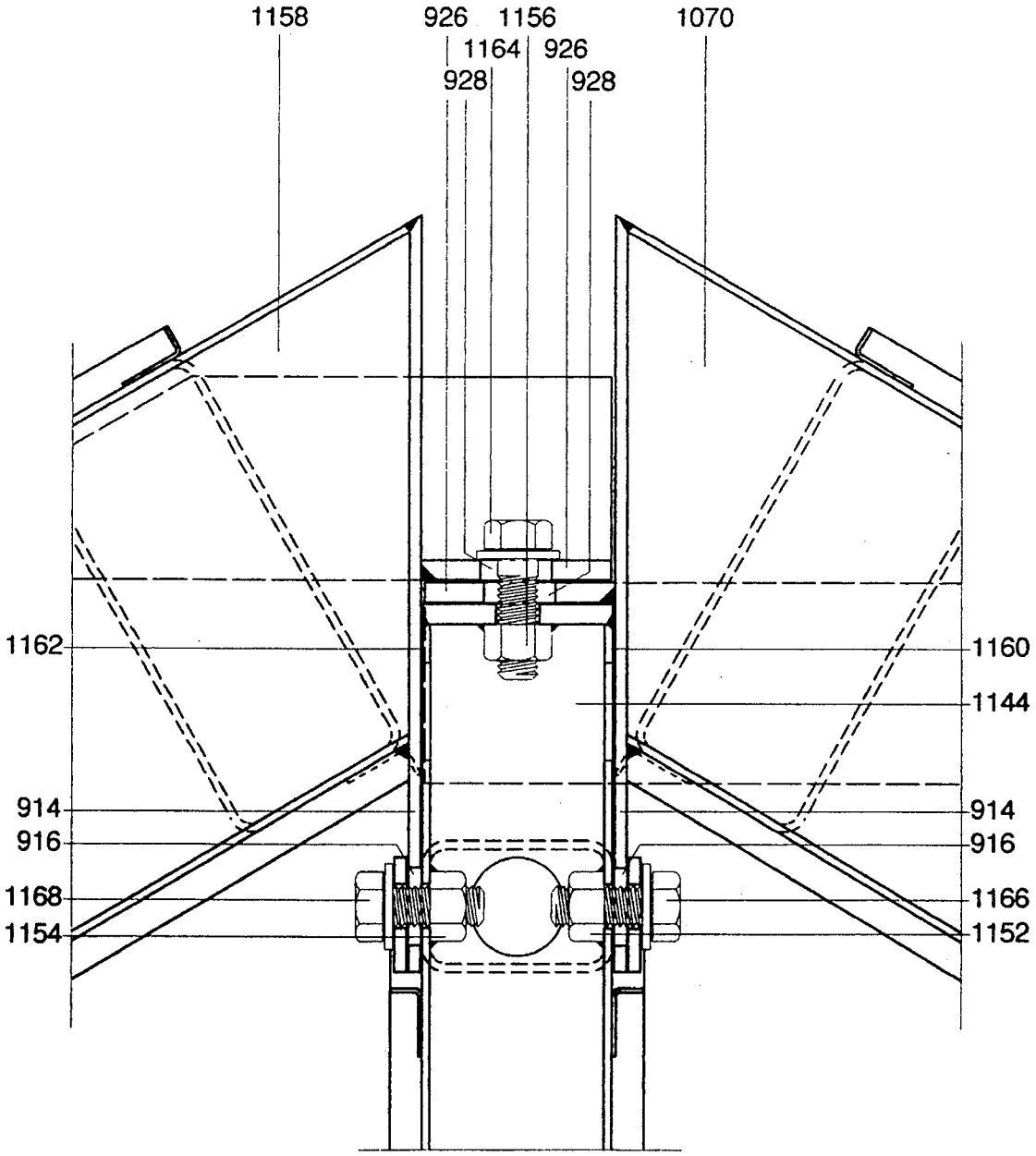
Figure 57:
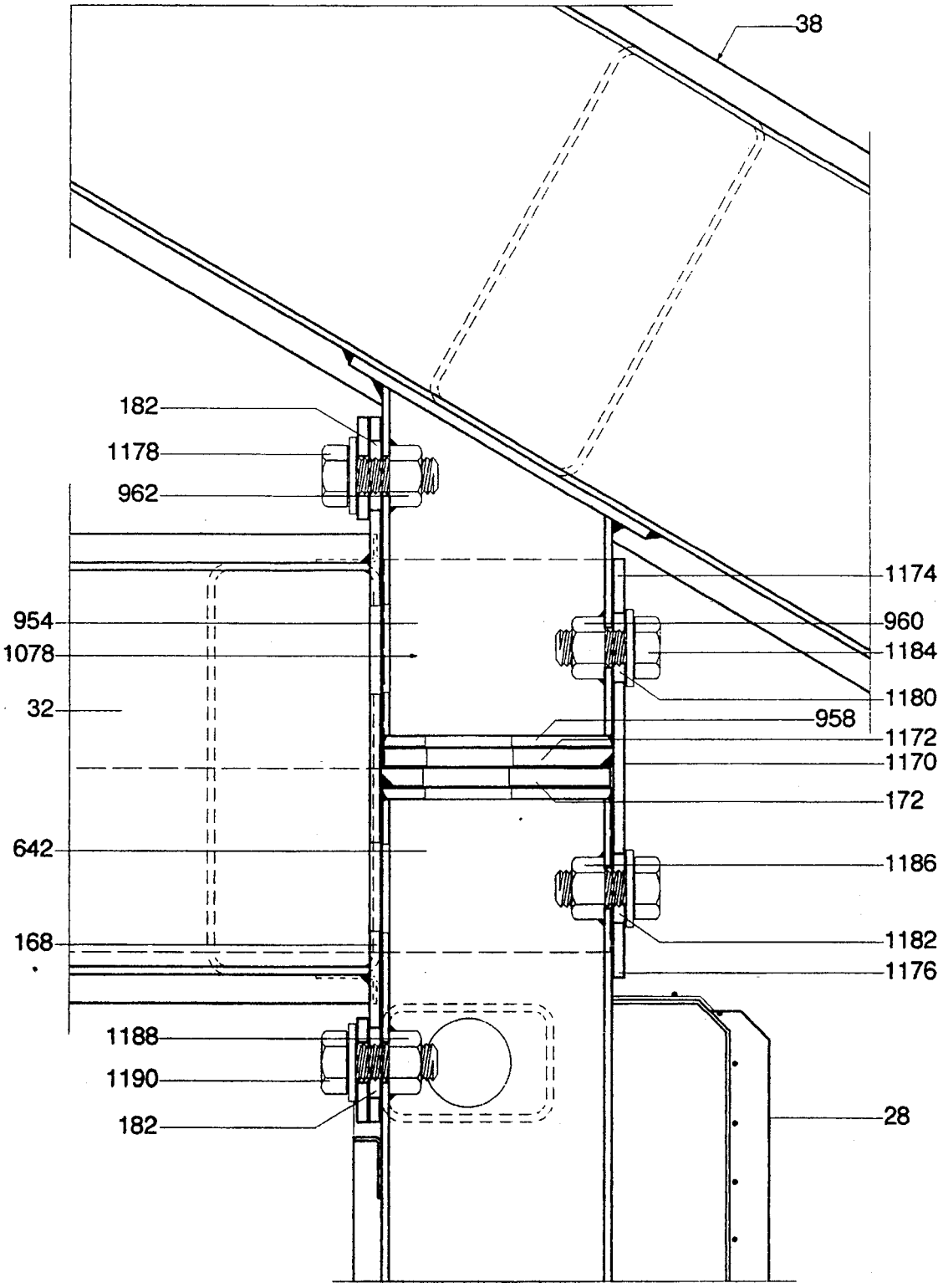

FIG. 55 is an exploded view illustrating the assembly of roof, floor and wall panels according to the invention;

FIG. 56 is a cross-sectional view taken along lines 56—56 of FIG. 55;

FIG. 57 is a cross-sectional view taken along line 57—57 of FIG. 55;

Hi-Rise Structure

Figure 58:
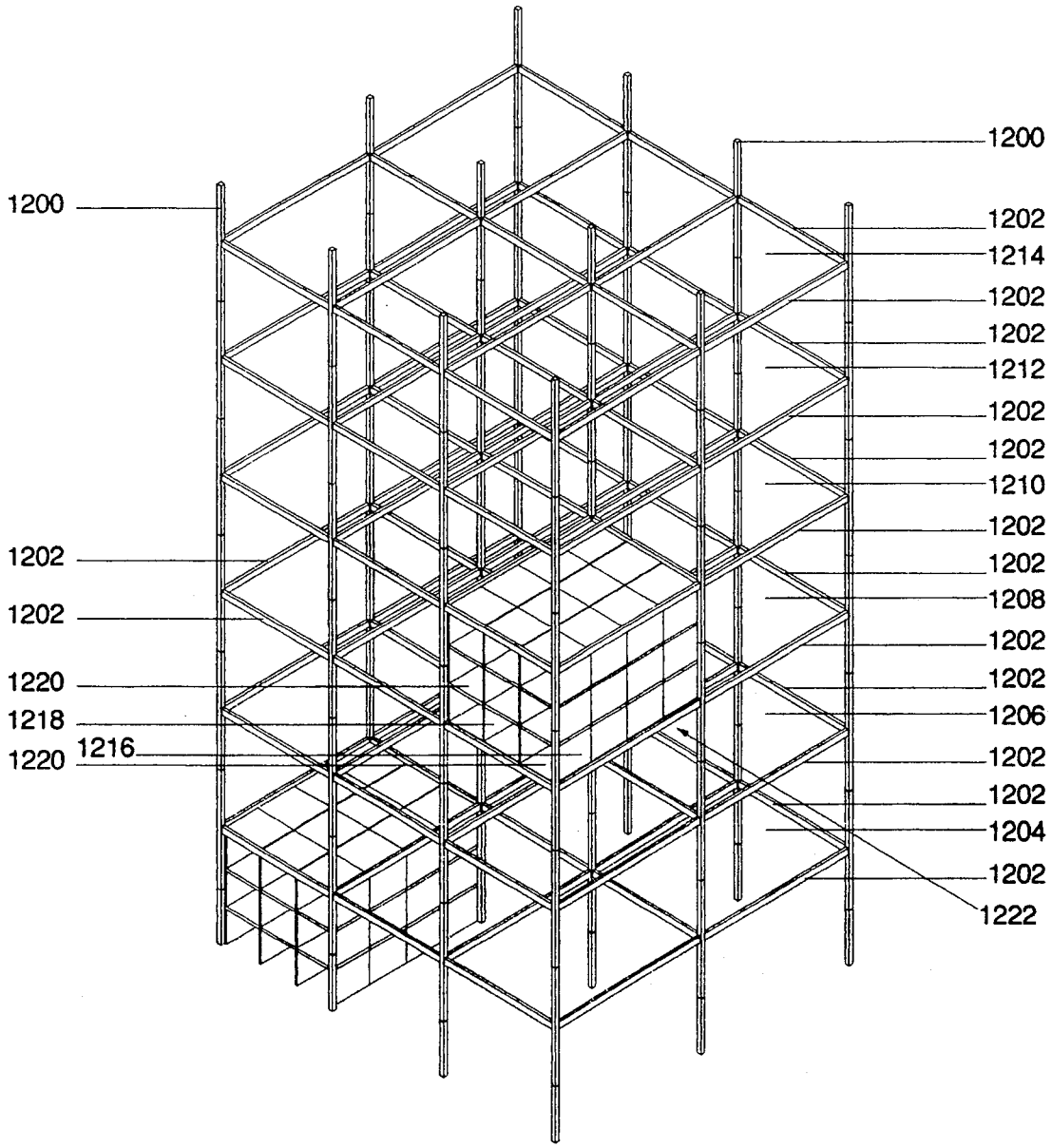

FIG. 58 is a perspective view of a hi-rise structure, illustrating a use of panels according to the invention to form units of the structure;

Shipping Container

Figure 59:
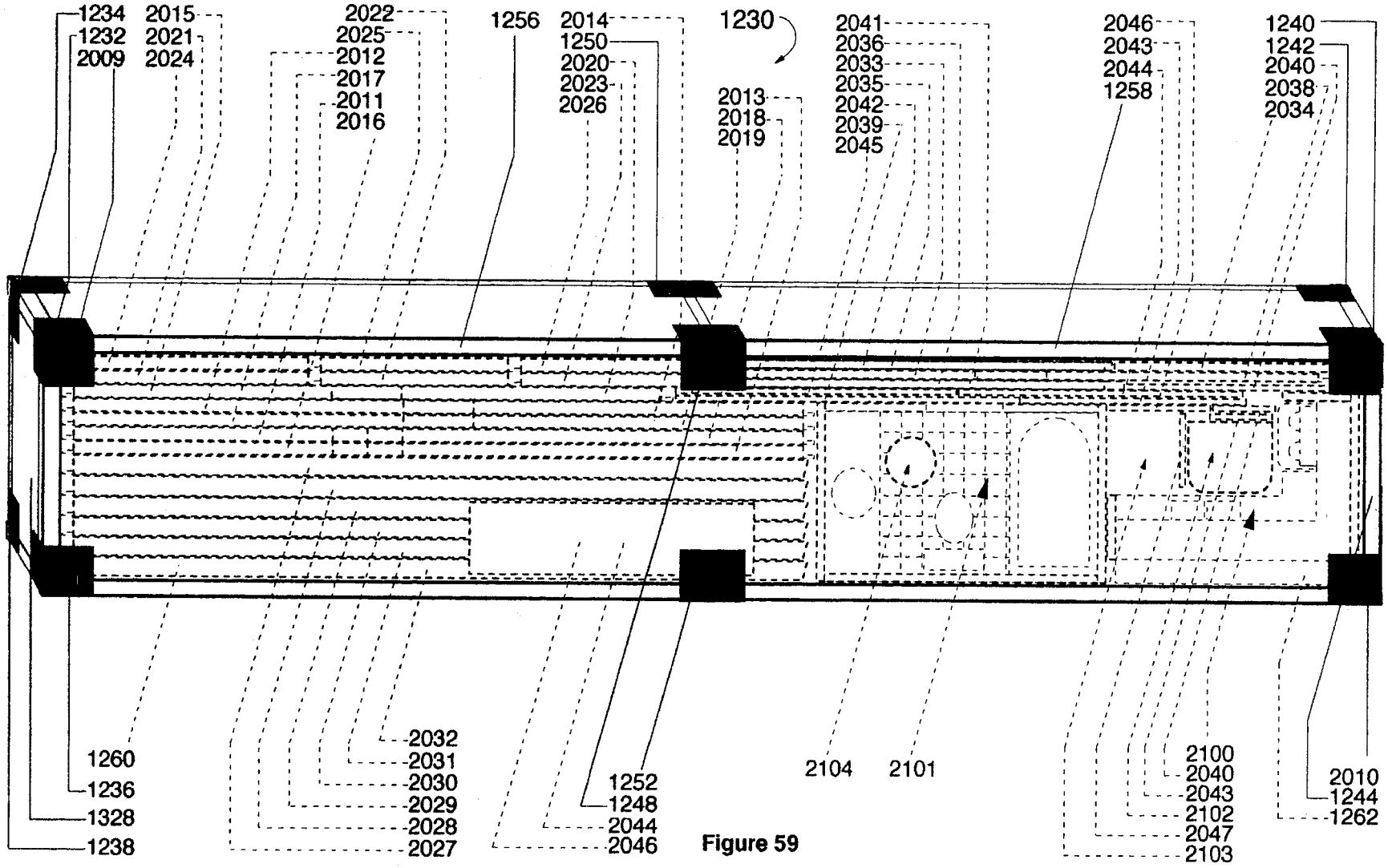
Figure 60A:
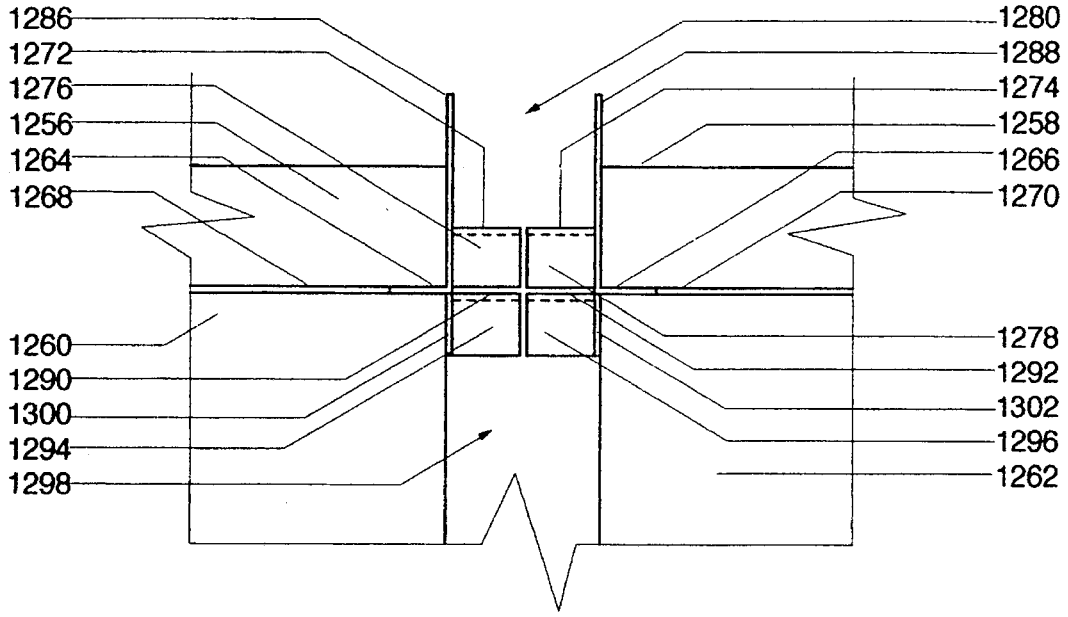
Figure 60B:
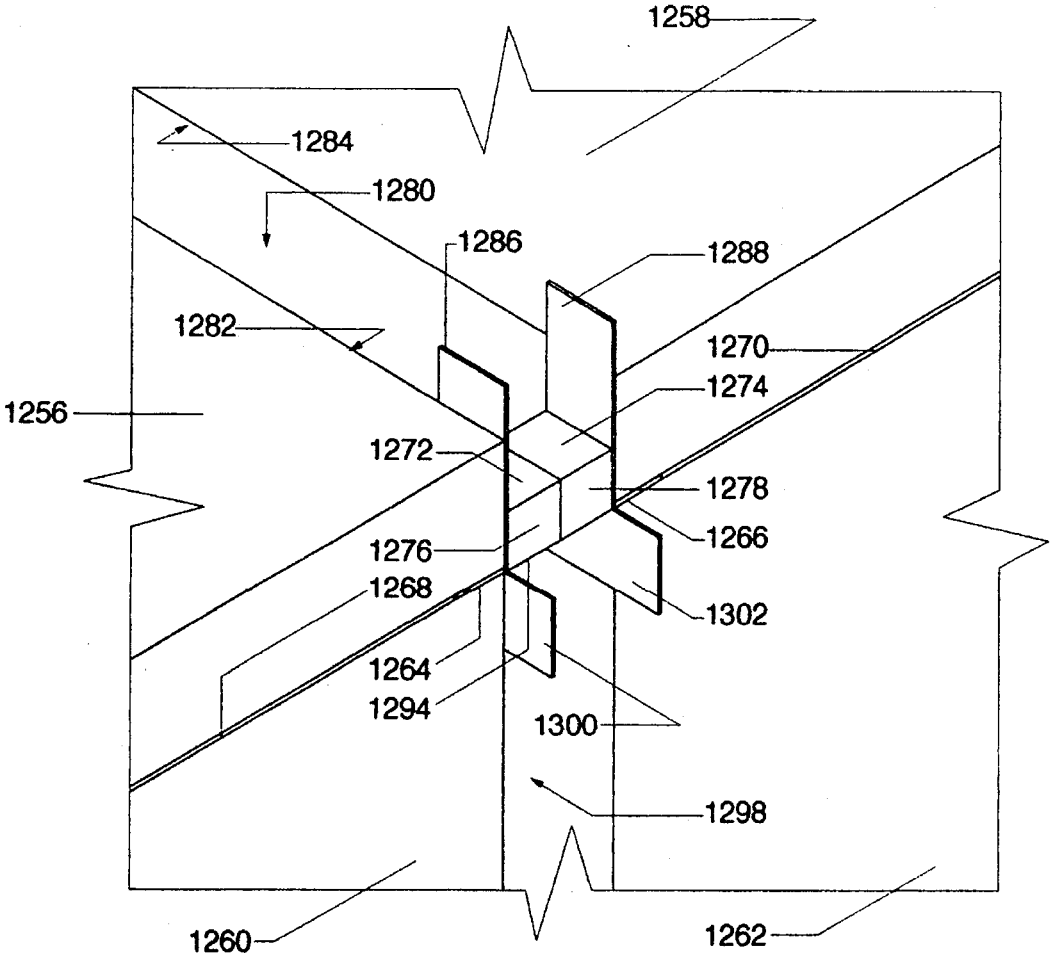
Figure 60C:
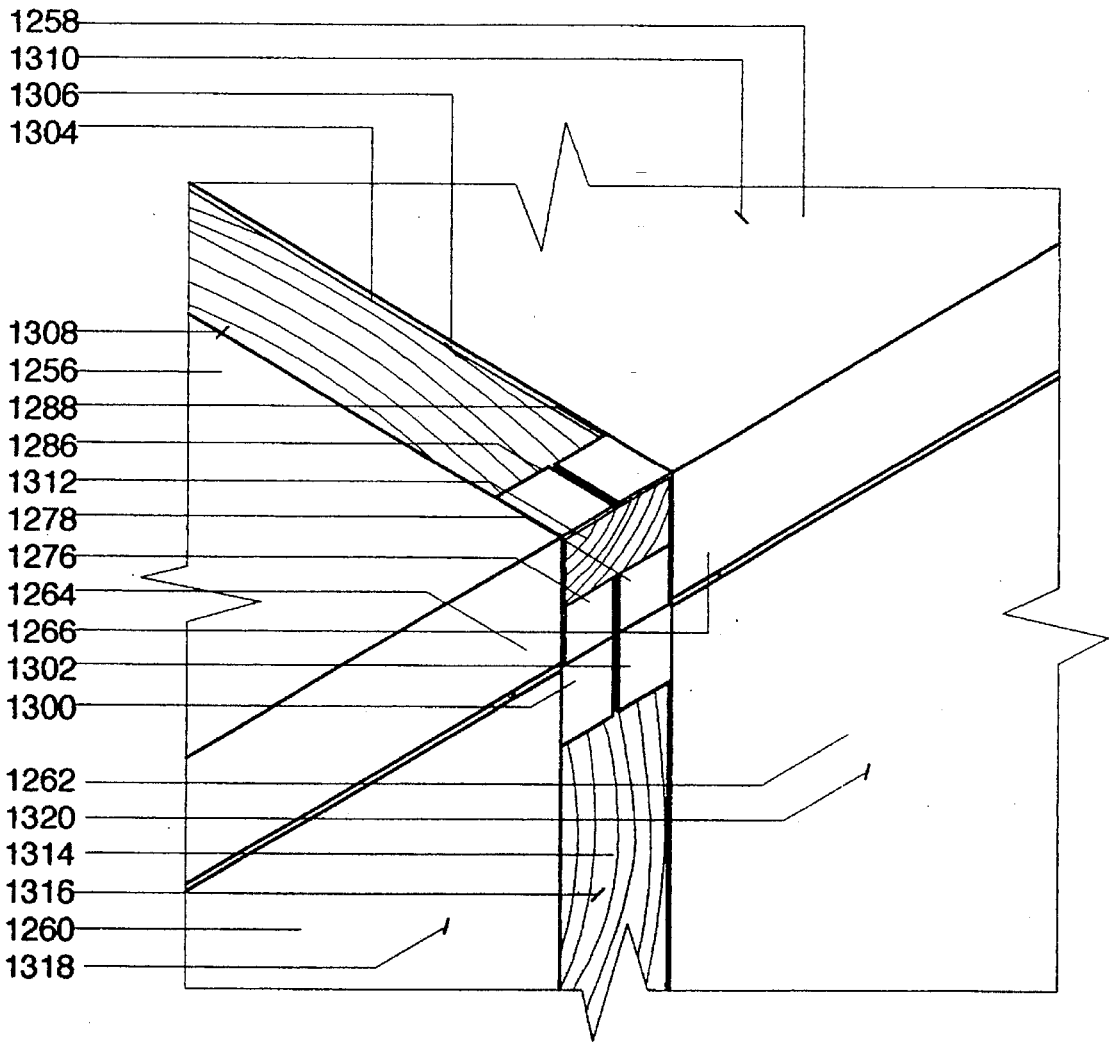
Figure 60D:
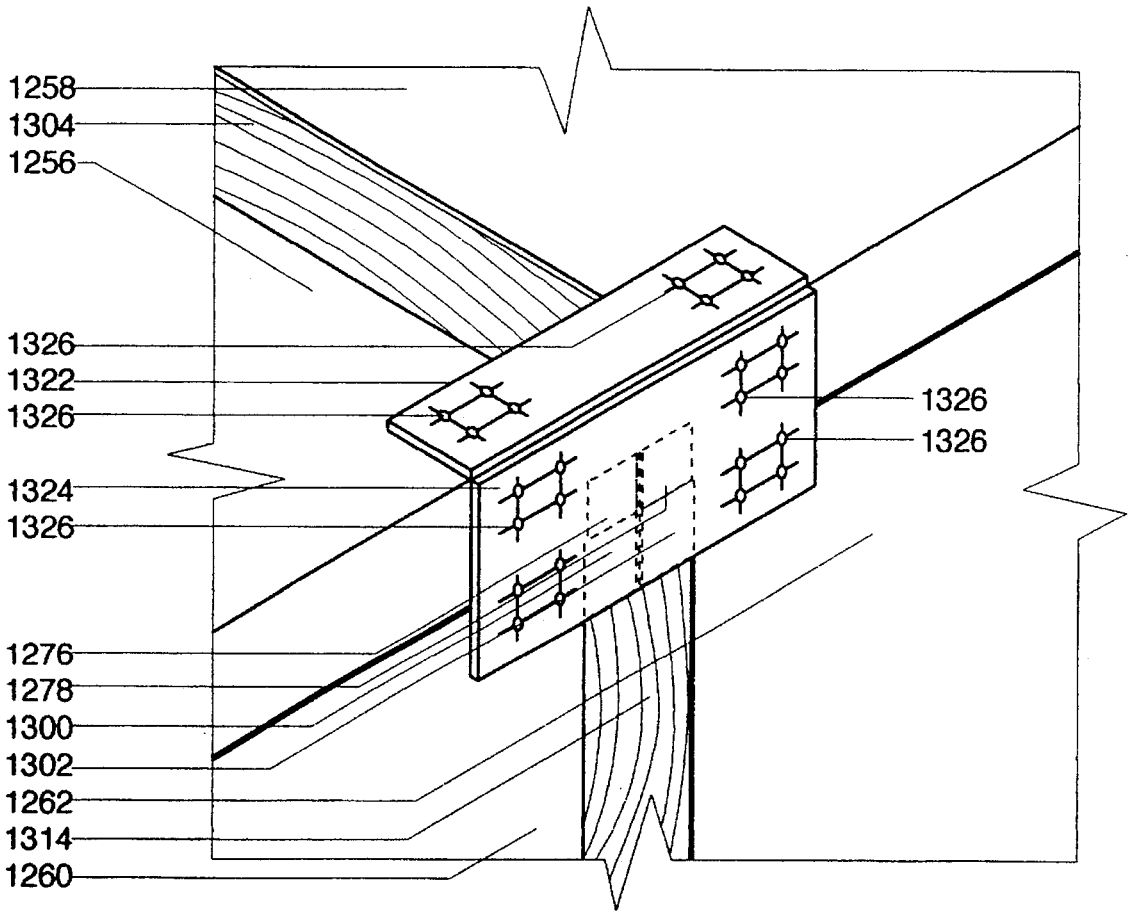
Figure 60E:
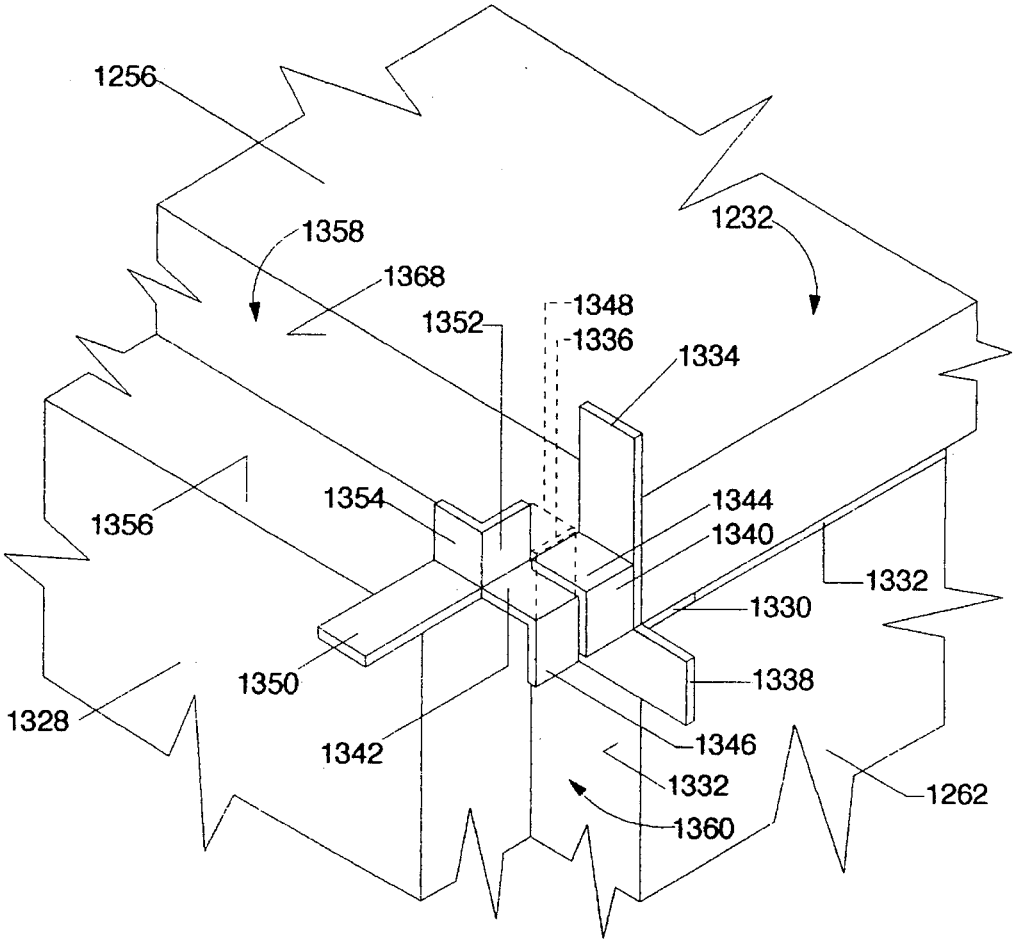
Figure 60F:
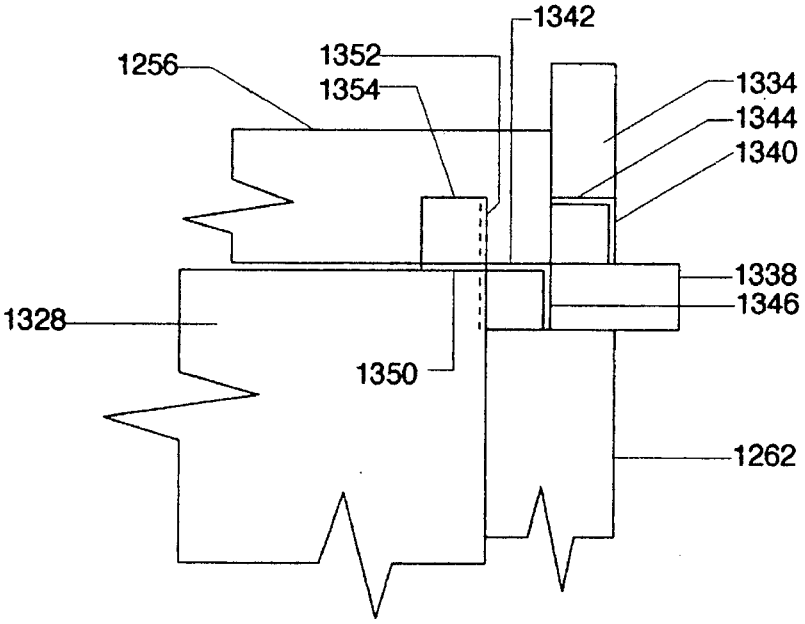
Figure 60G:
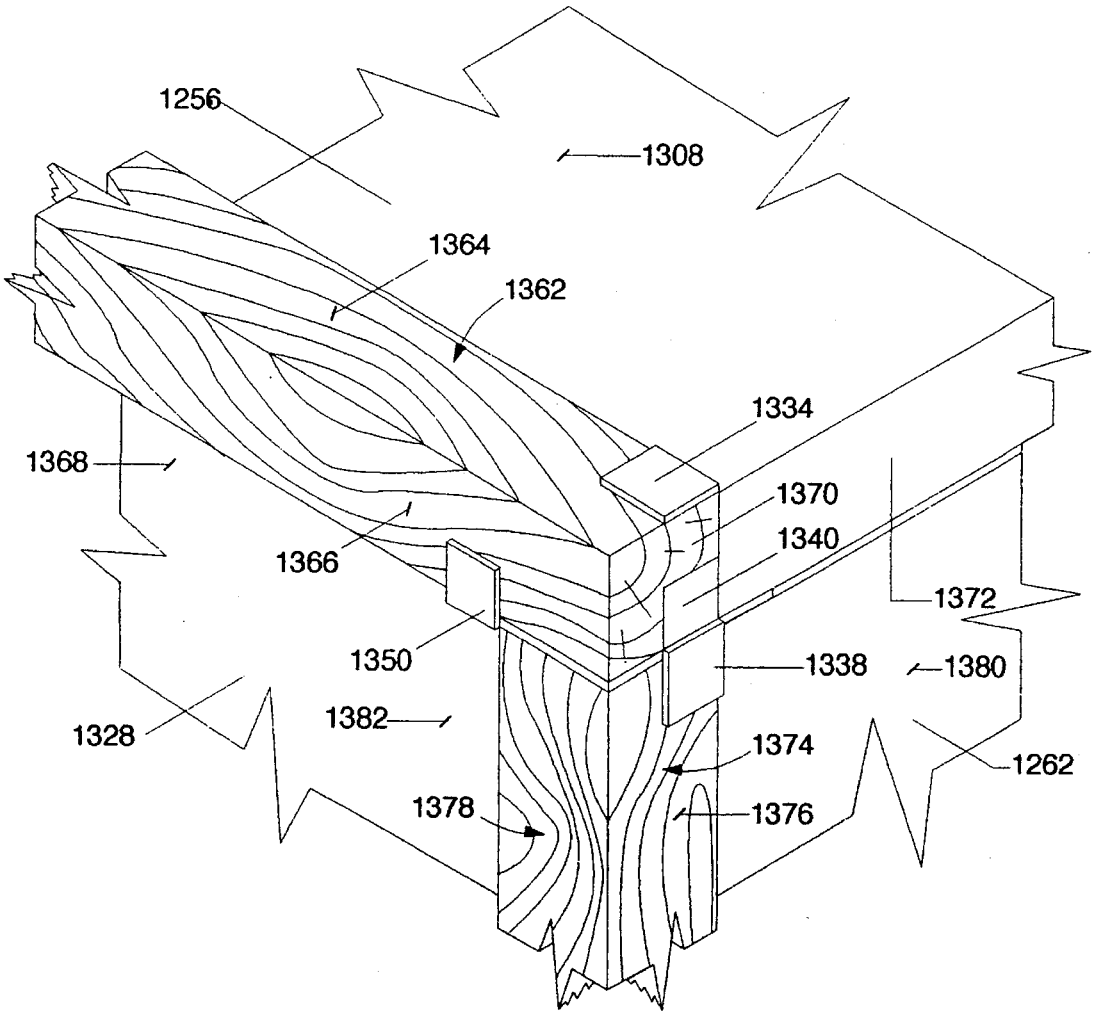
Figure 60H:
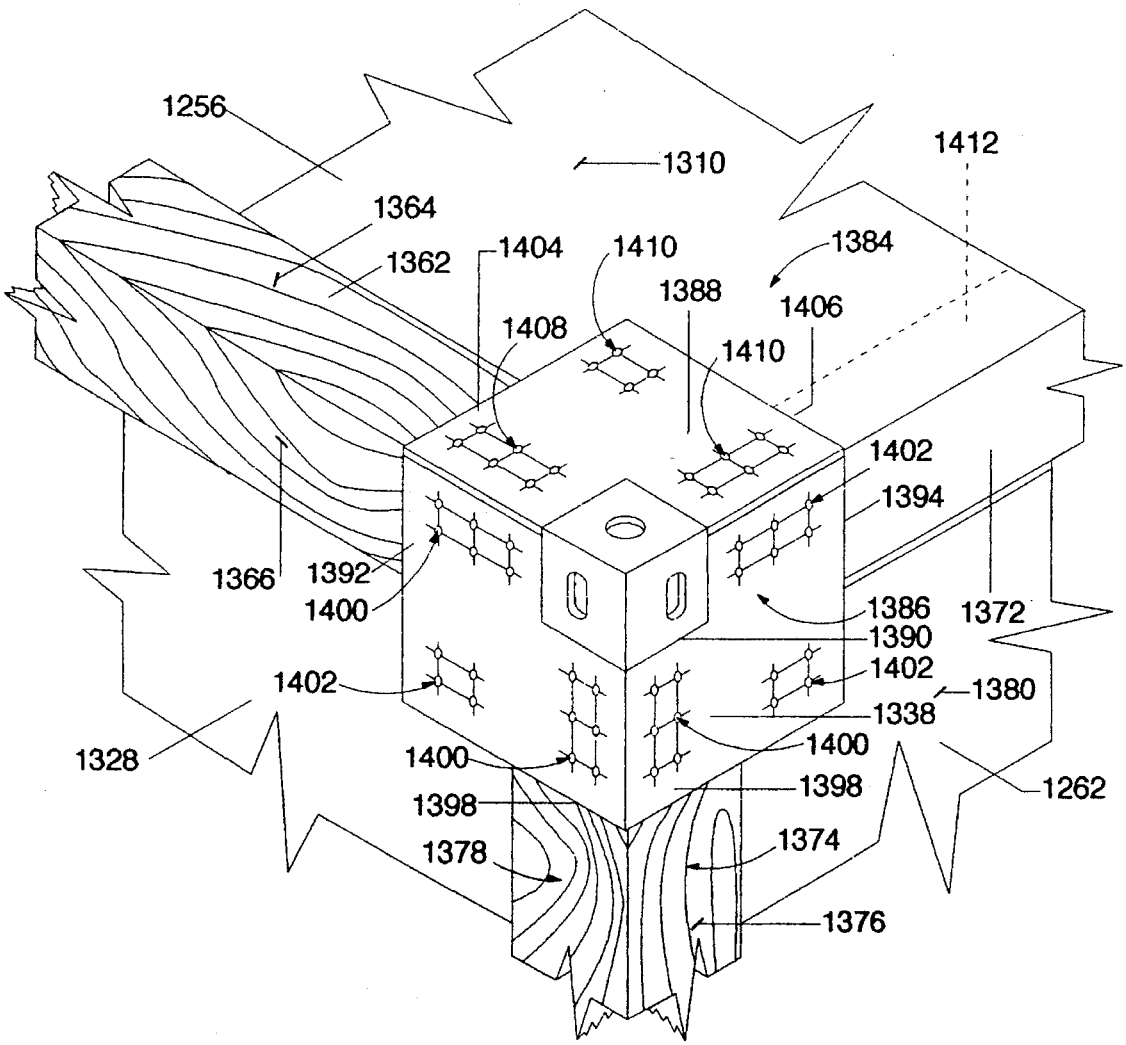
Figure 61:
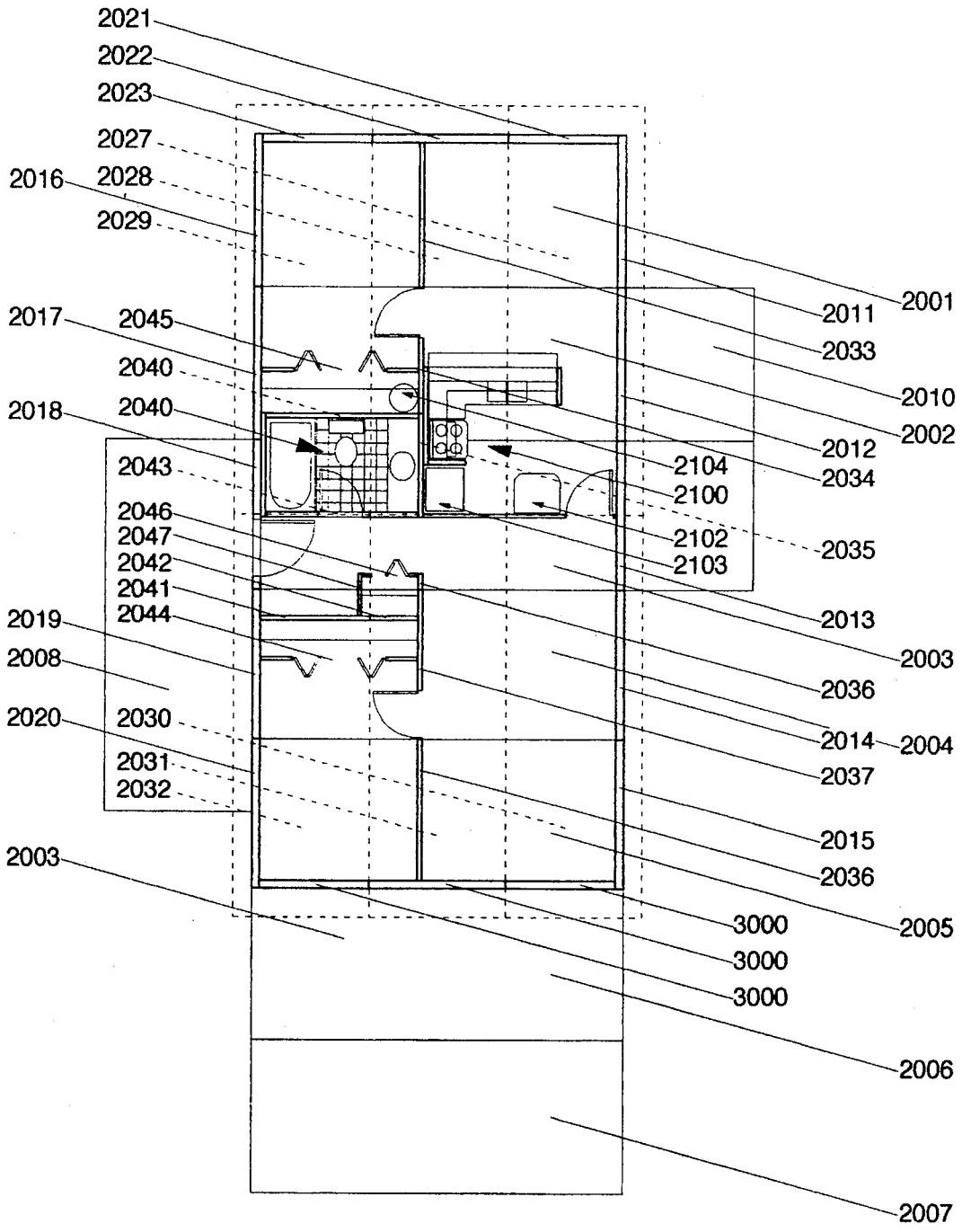
Figure 62:
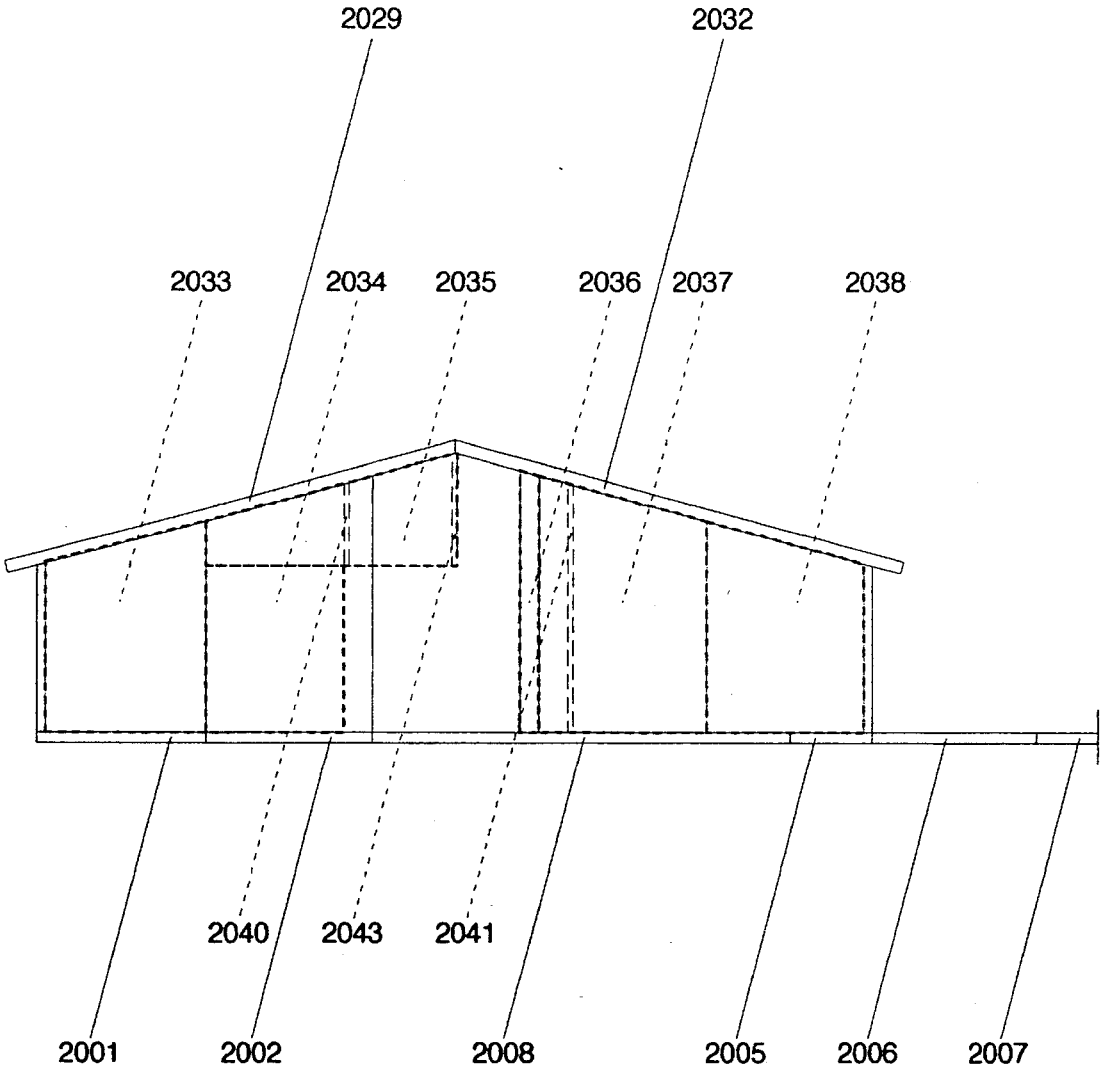

FIG. 59 is a perspective view of a shipping container illustrating a further use of panels according to the invention;

FIG. 60*a* is a fragmented side view of a mid-portion of the container of FIG. 59;

FIG. 60*b* is a fragmented perspective view of the mid-portion shown in FIG. 60*a*;

FIG. 60*c* is a fragmented perspective view of the mid-portion shown in FIGS. 60*a* and 60*b*, in a partially assembled state;

FIG. 60*d* is a fragmented perspective view of the mid-portion shown in FIGS. 60*a*, 60*b*, and 60*c* in a completed state;

FIG. 60*e* is a fragmented perspective view of a corner portion of the container shown in FIG. 59;

FIG. 60*f* is a fragmented side view of the corner portion shown in FIG. 60*e*;

FIG. 60*g* is a fragmented perspective view of the corner portion shown in FIGS. 60*e* and 60*f*, in a partially completed state;

FIG. 60*h* is a fragmented perspective view of the corner portion shown in FIGS. 60*e*, 60*f*, and 60*g* shown in a completed state;

FIG. 61 is a plan view of a house built from components shipped in the container shown in FIGS. 59 and 60;

FIG. 62 is a side view of the house of FIG. 61;

Panel Finishing

Figure 63:
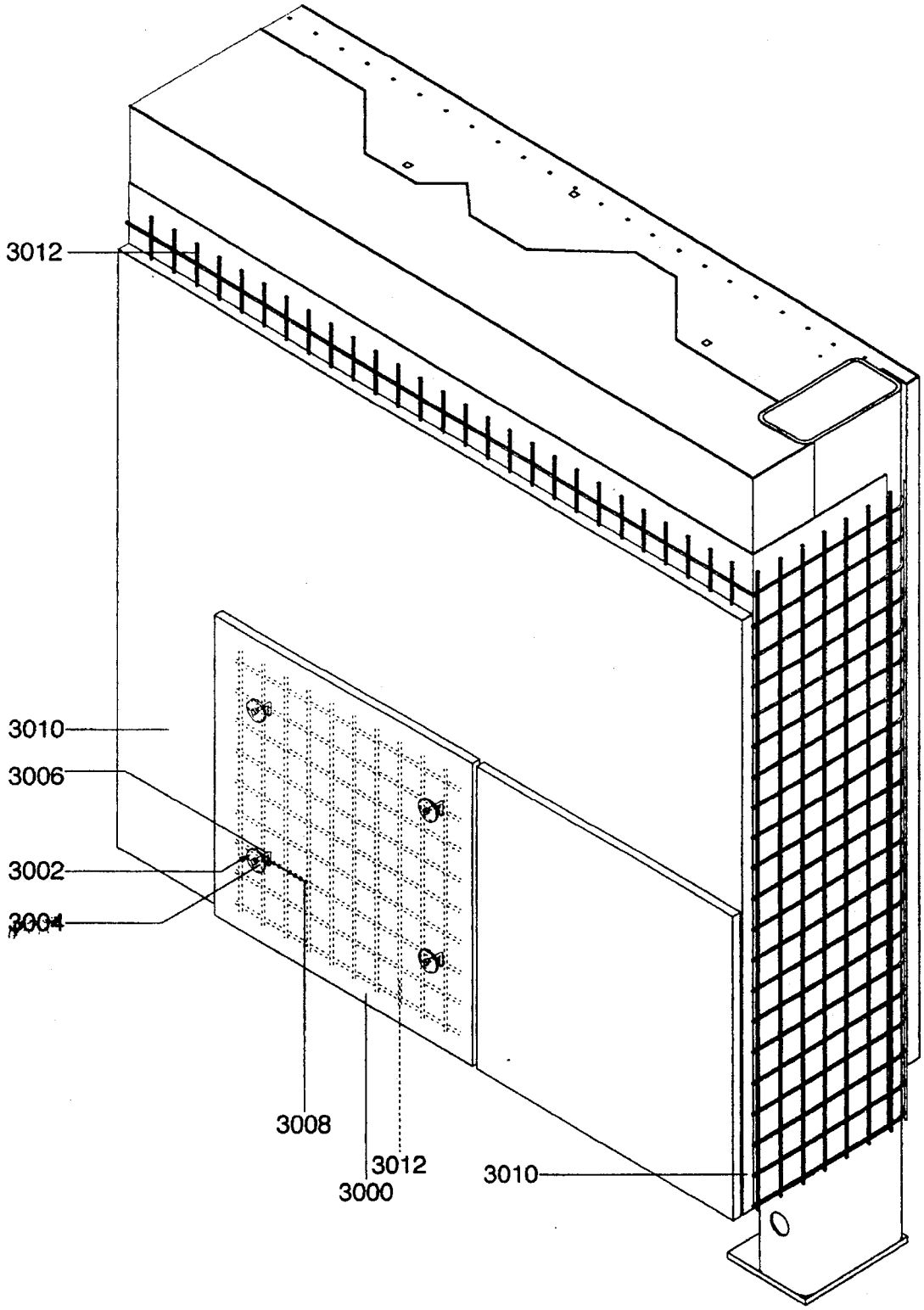

FIG. 63 is a layered view of an exterior panel according to the third embodiment of the invention, illustrating a method of securing an architectural finishing material to the panel;

Panel Variations

Figure 64:
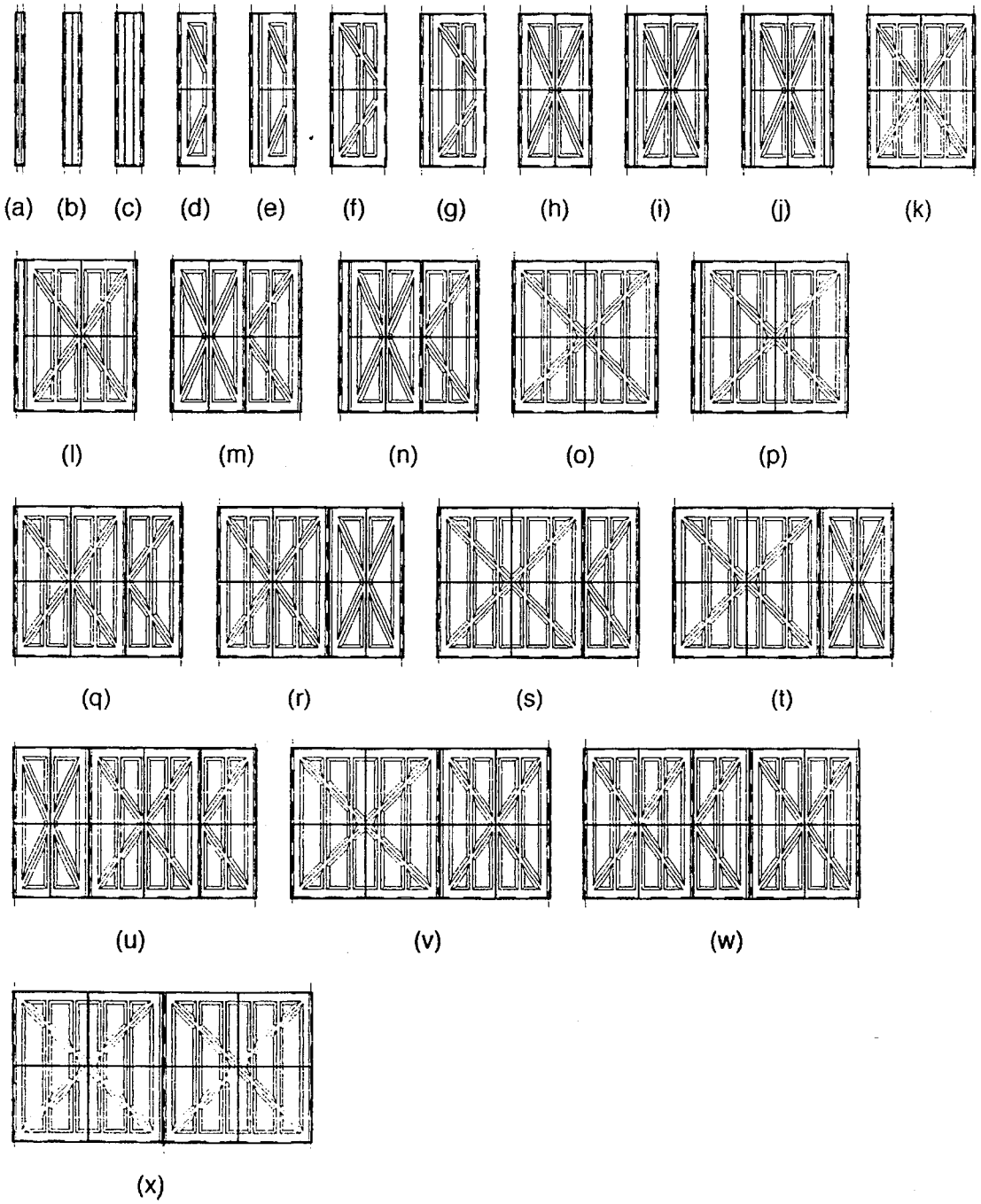

FIG. 64 (*a*)–(*x*) illustrates a plurality of plan views of panel configurations having various dimensions;

Curved Components

Figure 65:
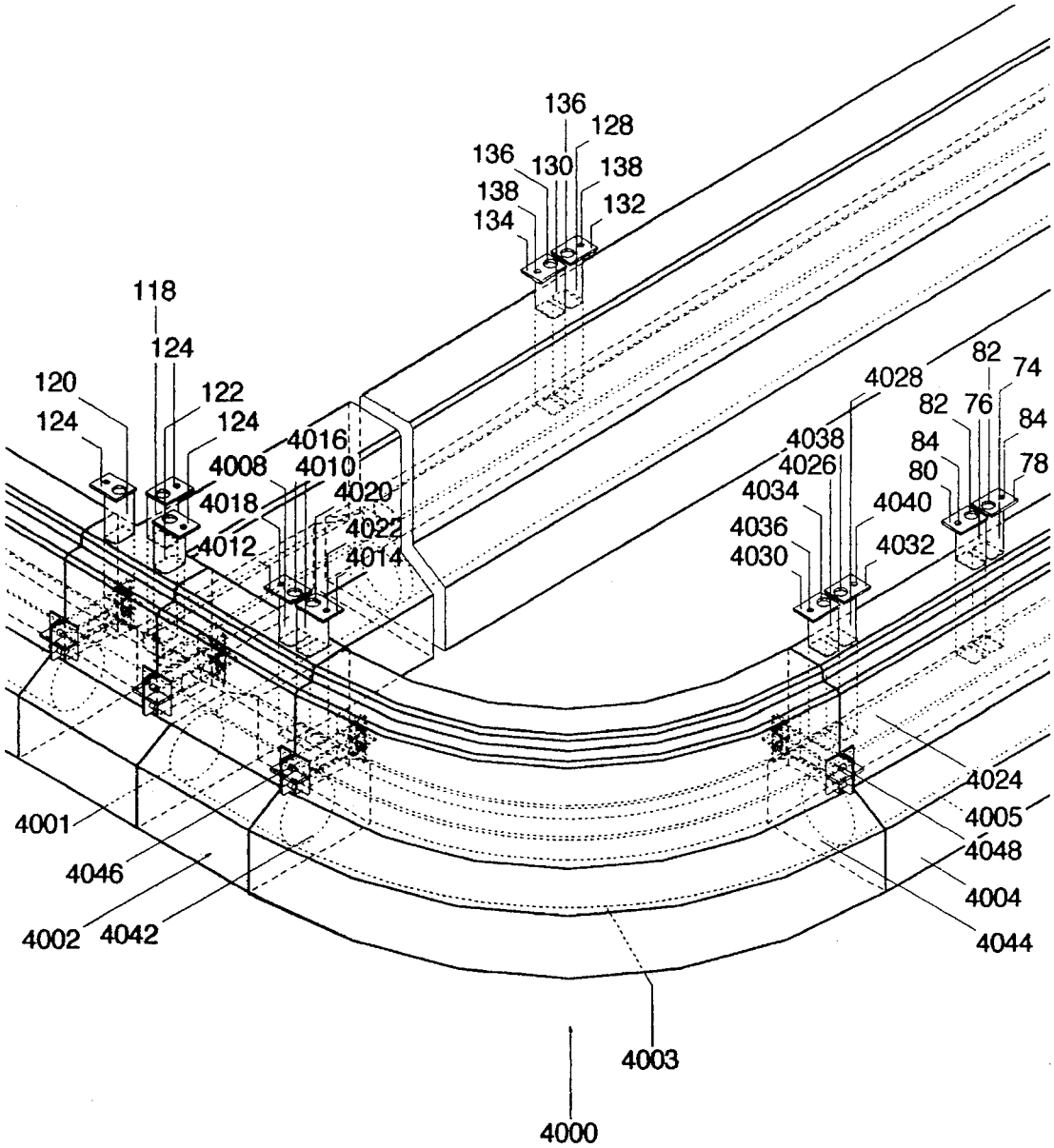

FIG. 65 is a perspective view of a curved corner foundation member according to a sixth embodiment of the invention;

Curved Floor Panel

Figure 66:
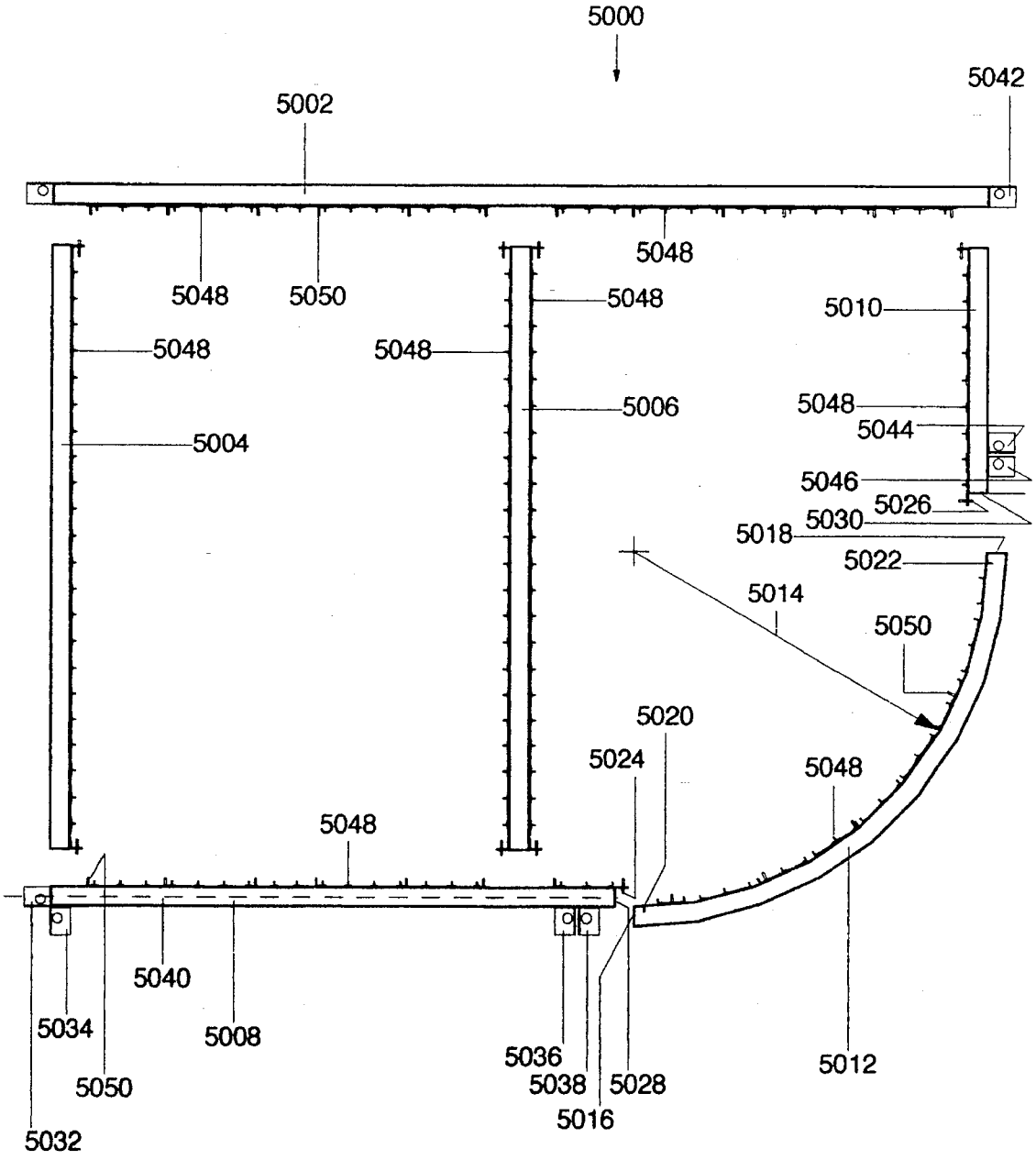
Figure 67:
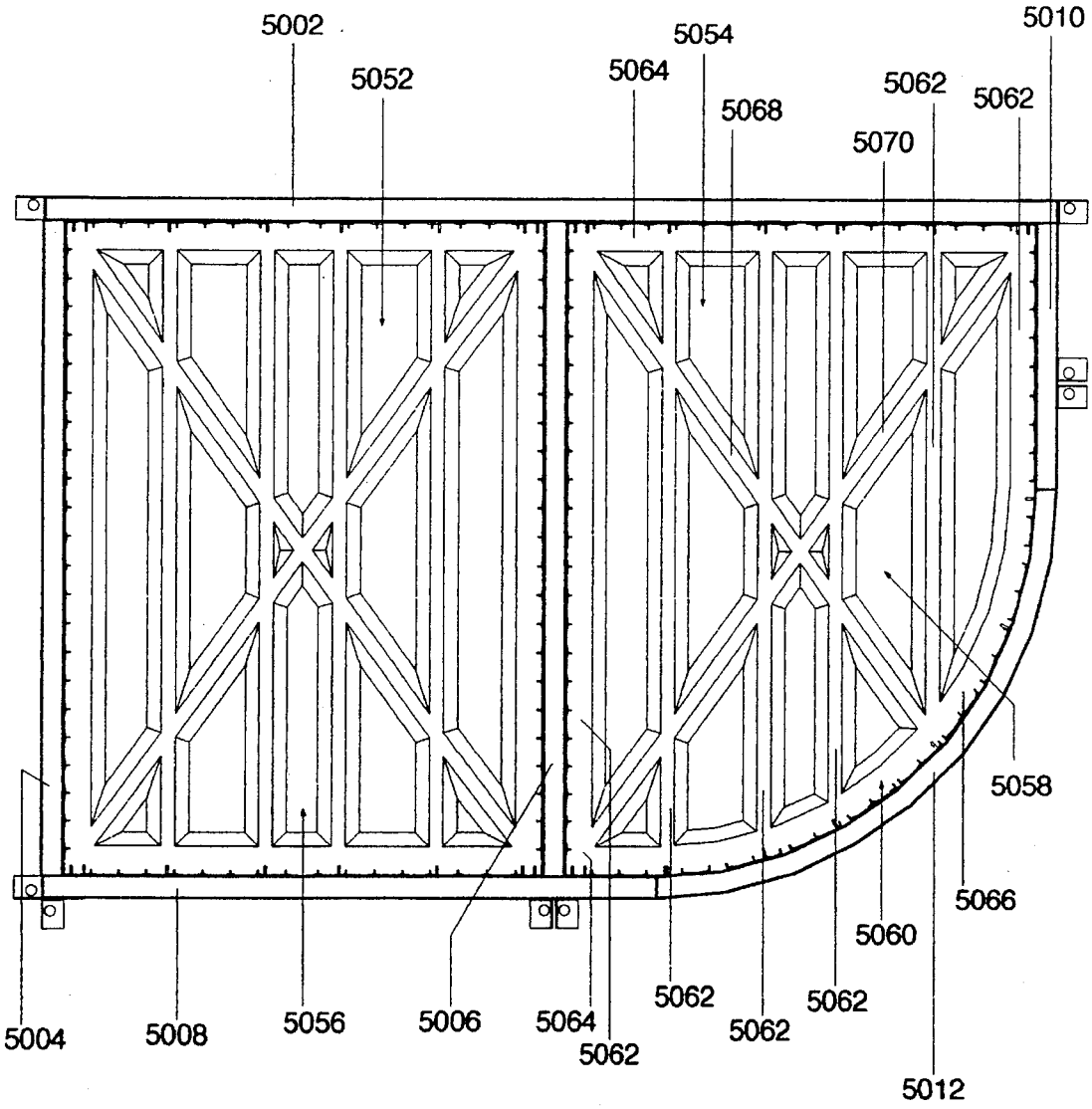
Figure 68:
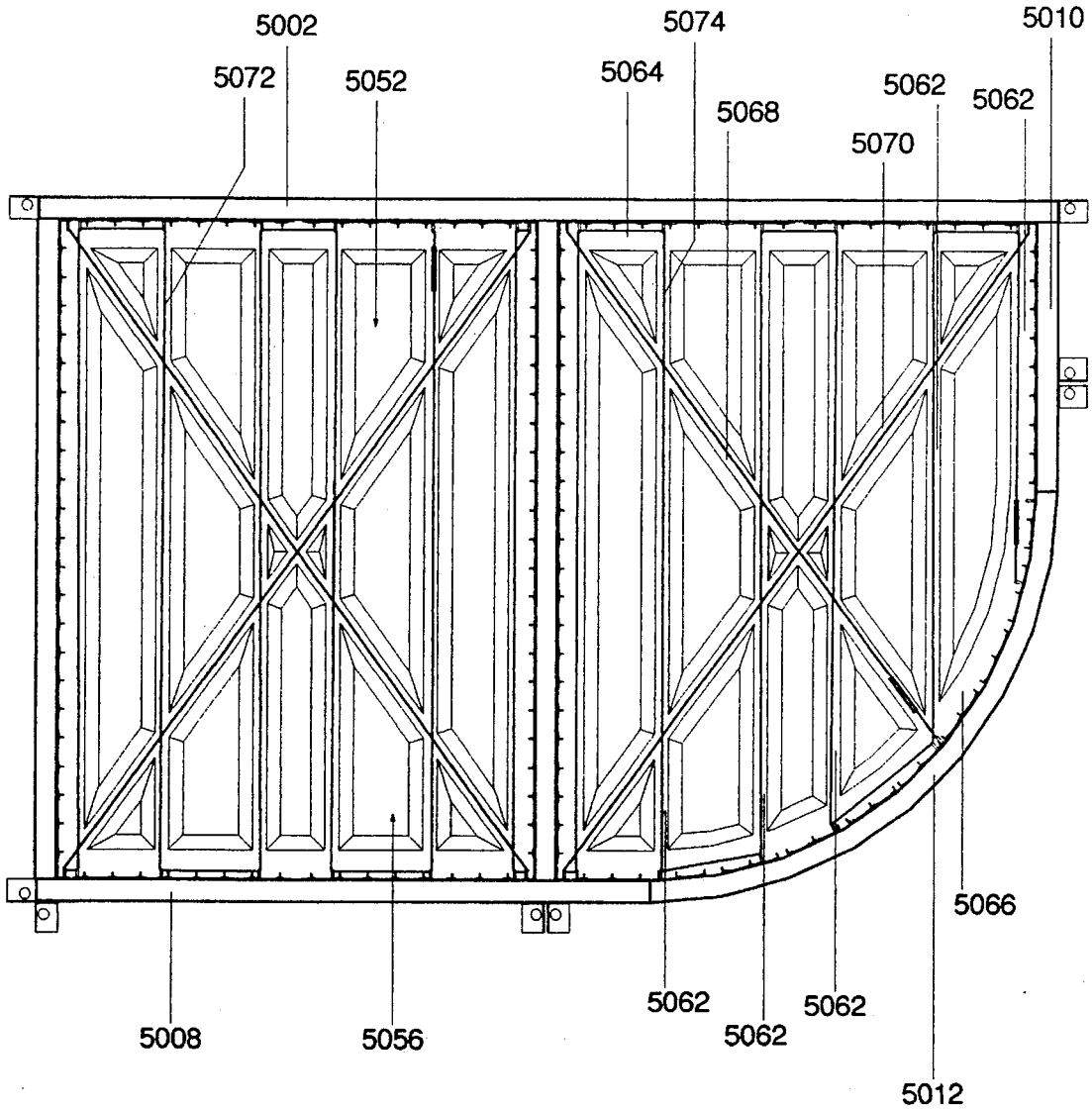
Figure 69:
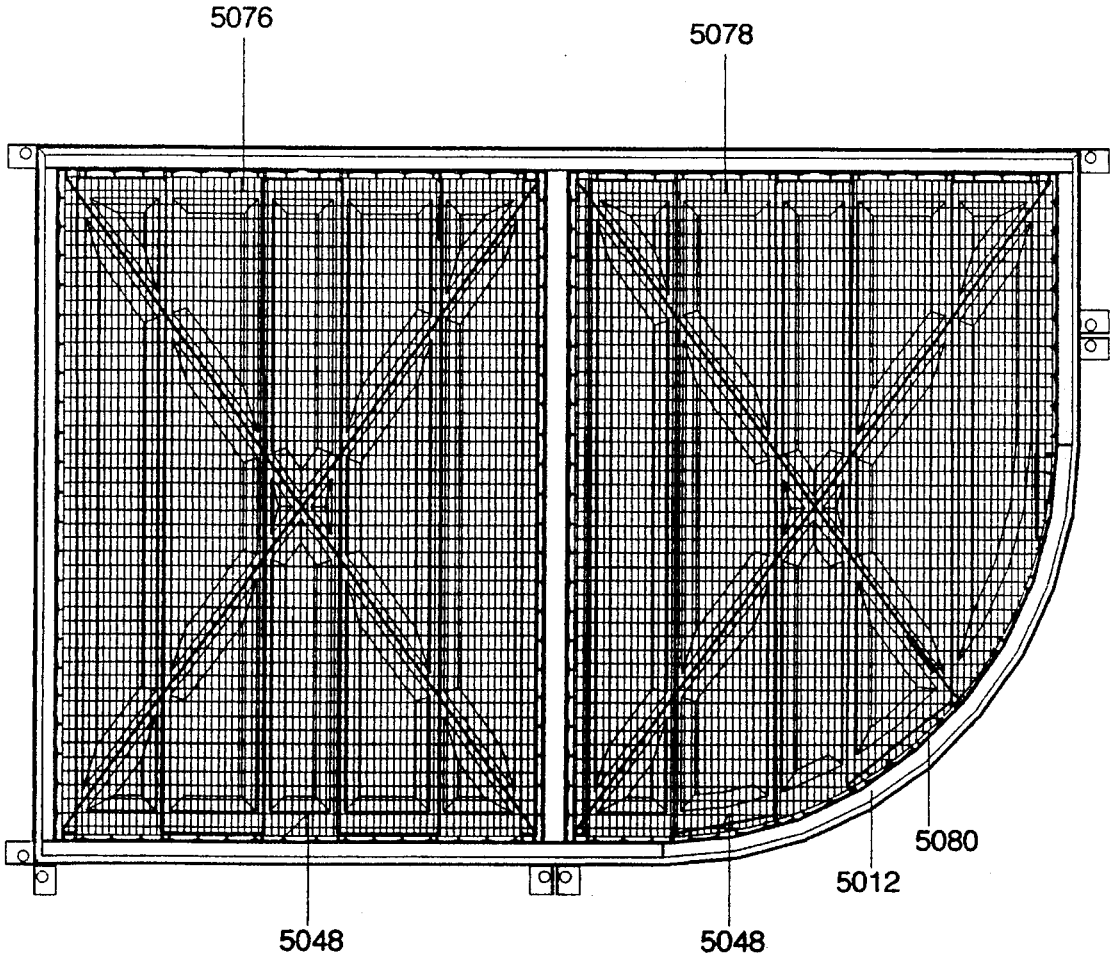
Figure 70:
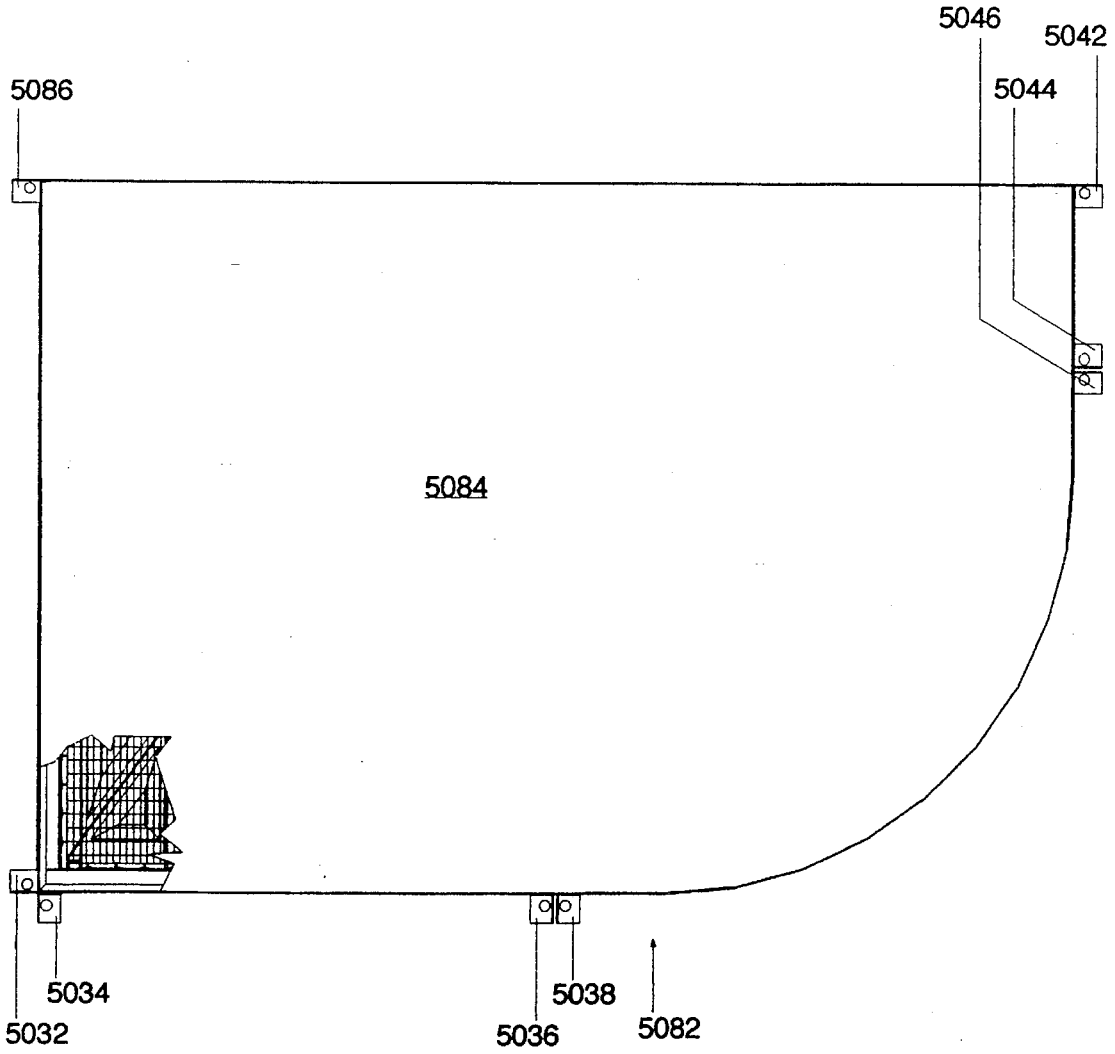

FIG. 66 is a plan view of frame members included in a floor panel having a curved corner portion, according to a seventh embodiment of the invention;

FIG. 67 is a plan view of an assembly step in forming the panel according to the seventh embodiment, in which the frame members are placed on an insulating material;

FIG. 68 is a plan view of an assembly step in forming the panel according to the seventh embodiment wherein tension cables are connected between frame members;

FIG. 69 is a plan view of an assembly step in forming the panel according to the seventh embodiment wherein a first layer of mesh material is connected between frame members;

FIG. 70 is a plan view of a completed floor panel according to the seventh embodiment of the invention;

Curved Exterior Wall Panel

Figure 72:
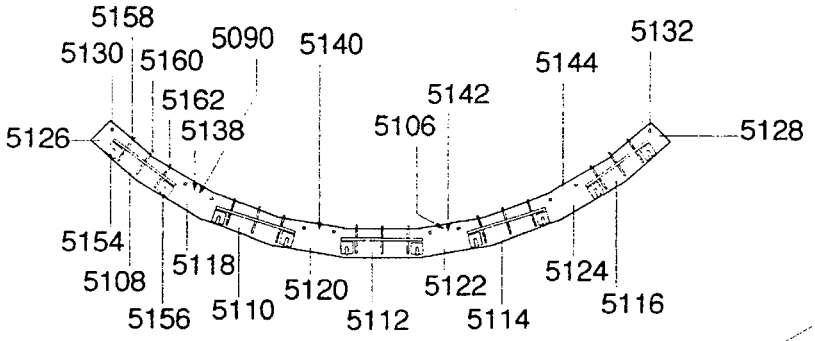
Figure 71:
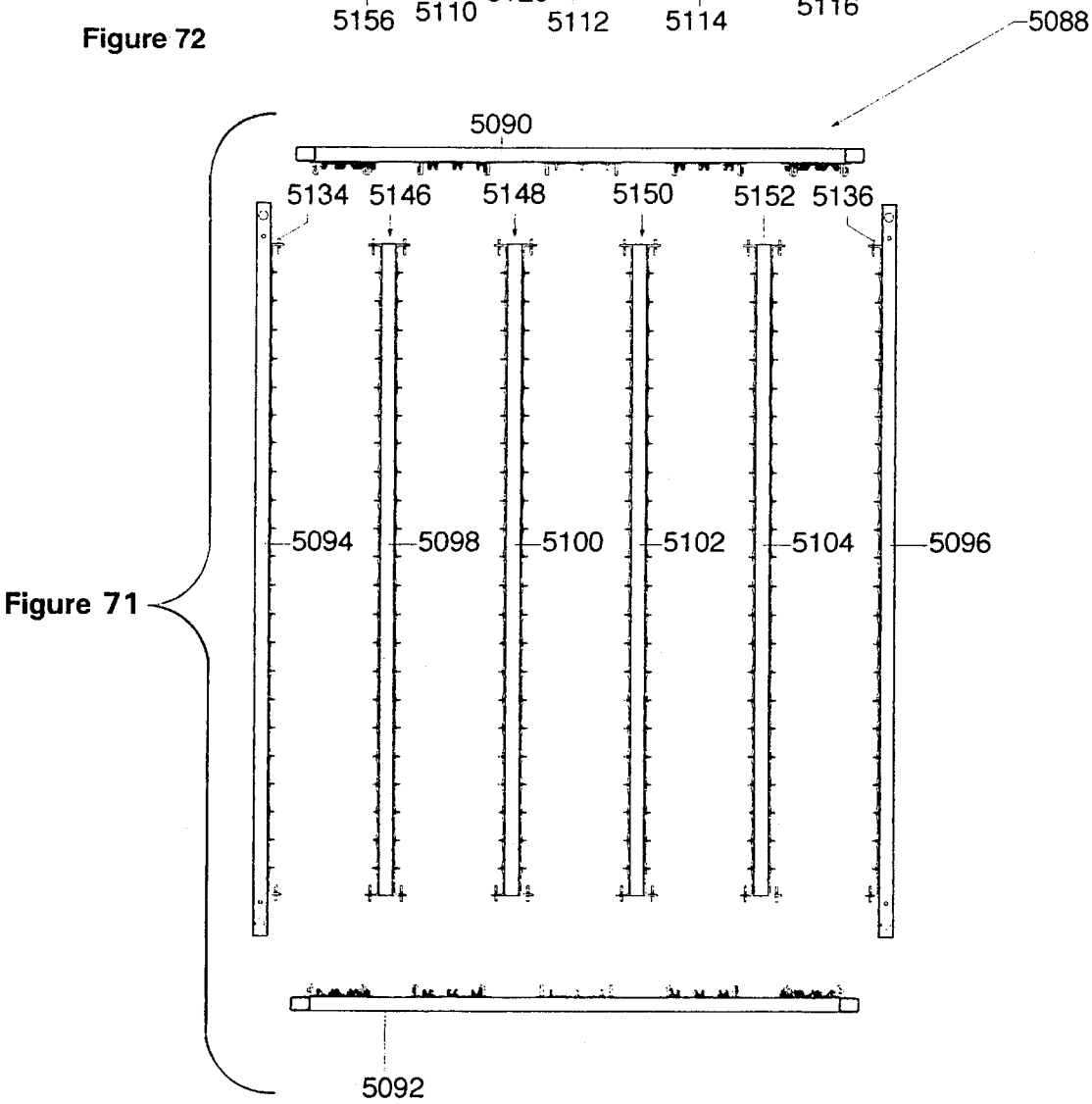
Figure 73:
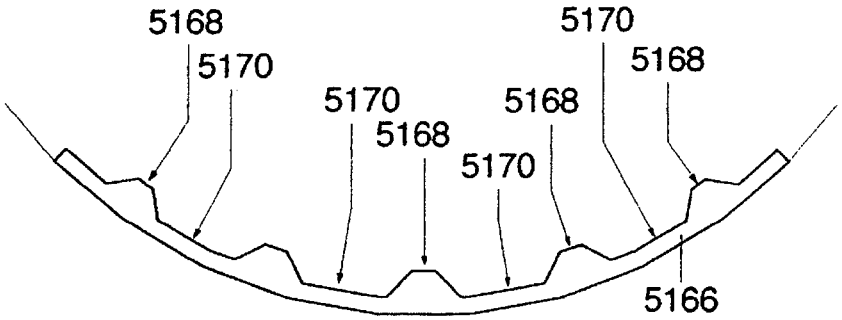
Figure 74:
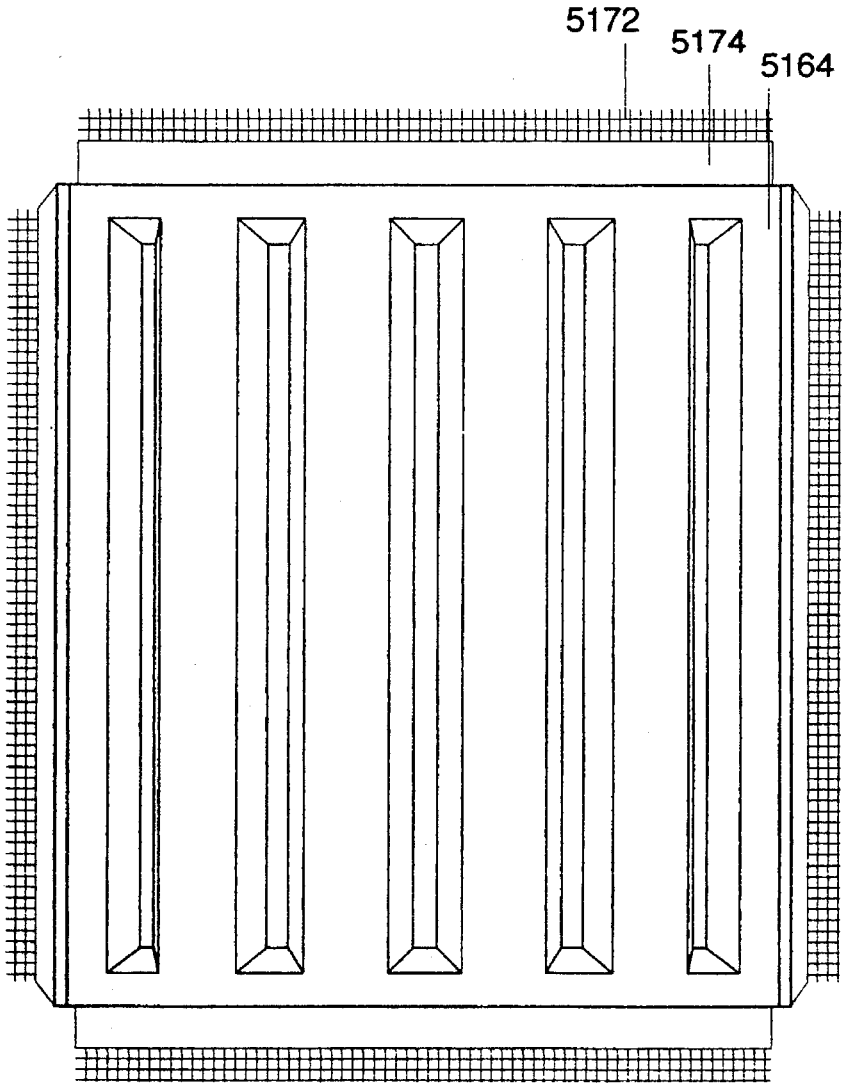
Figure 75:
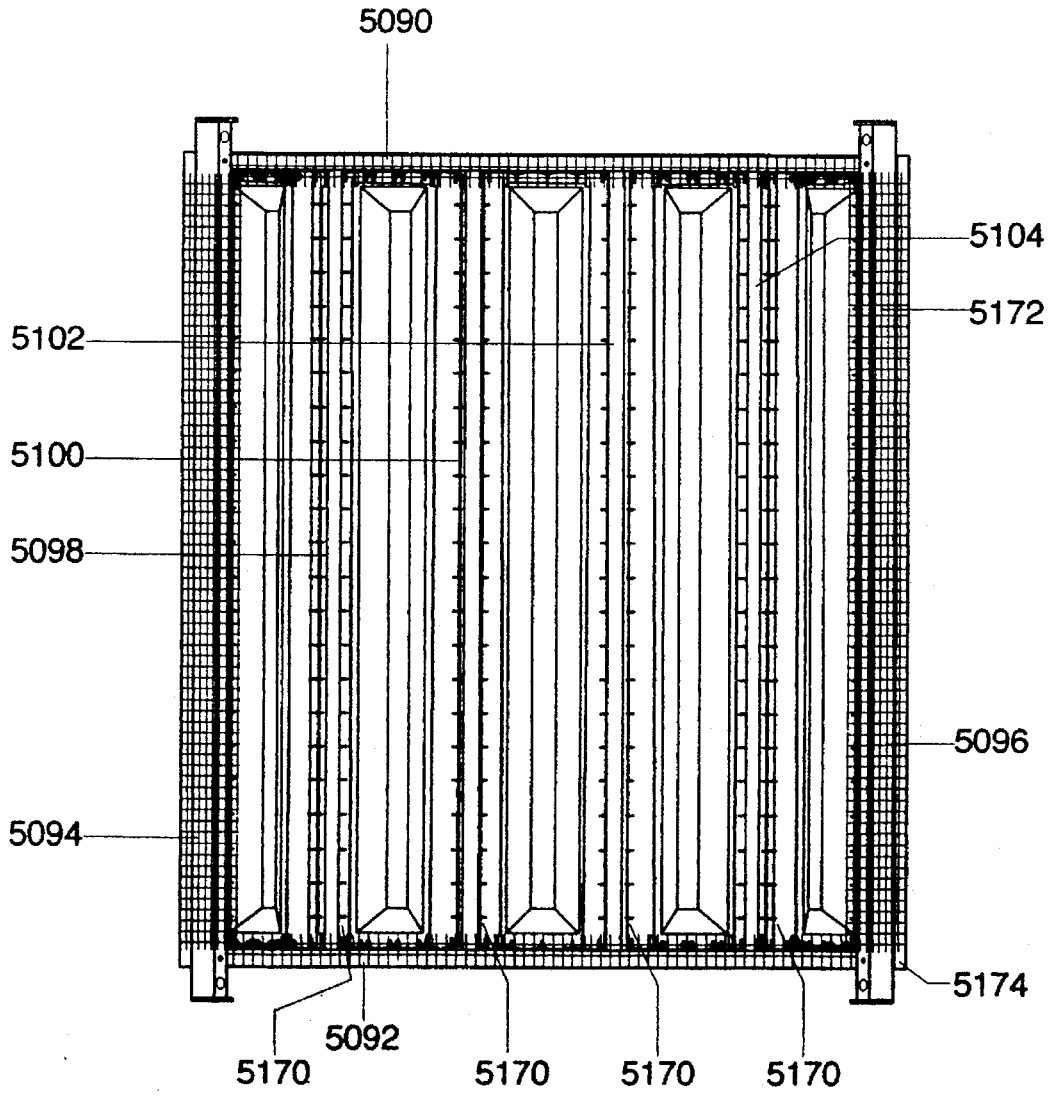
Figure 77:
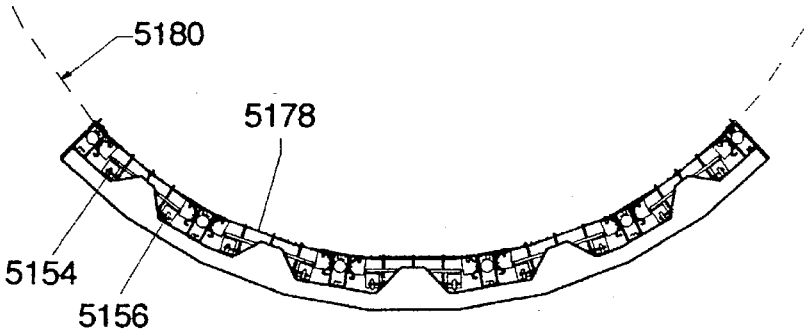
Figure 76:
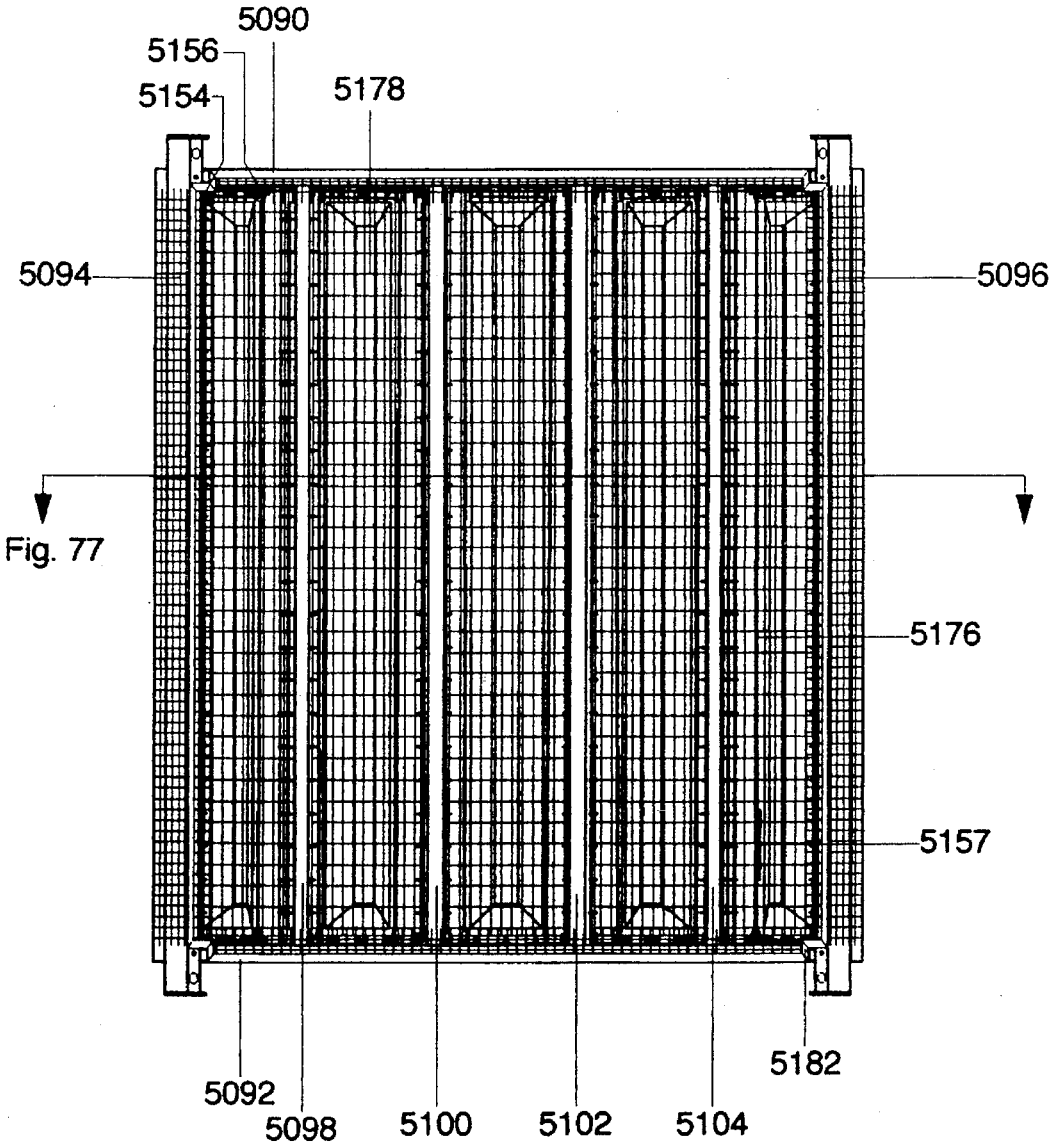
Figure 78:
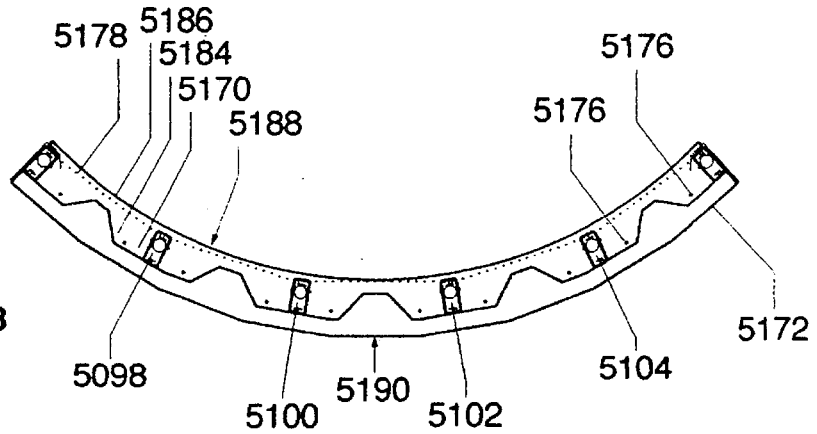
Figure 79:
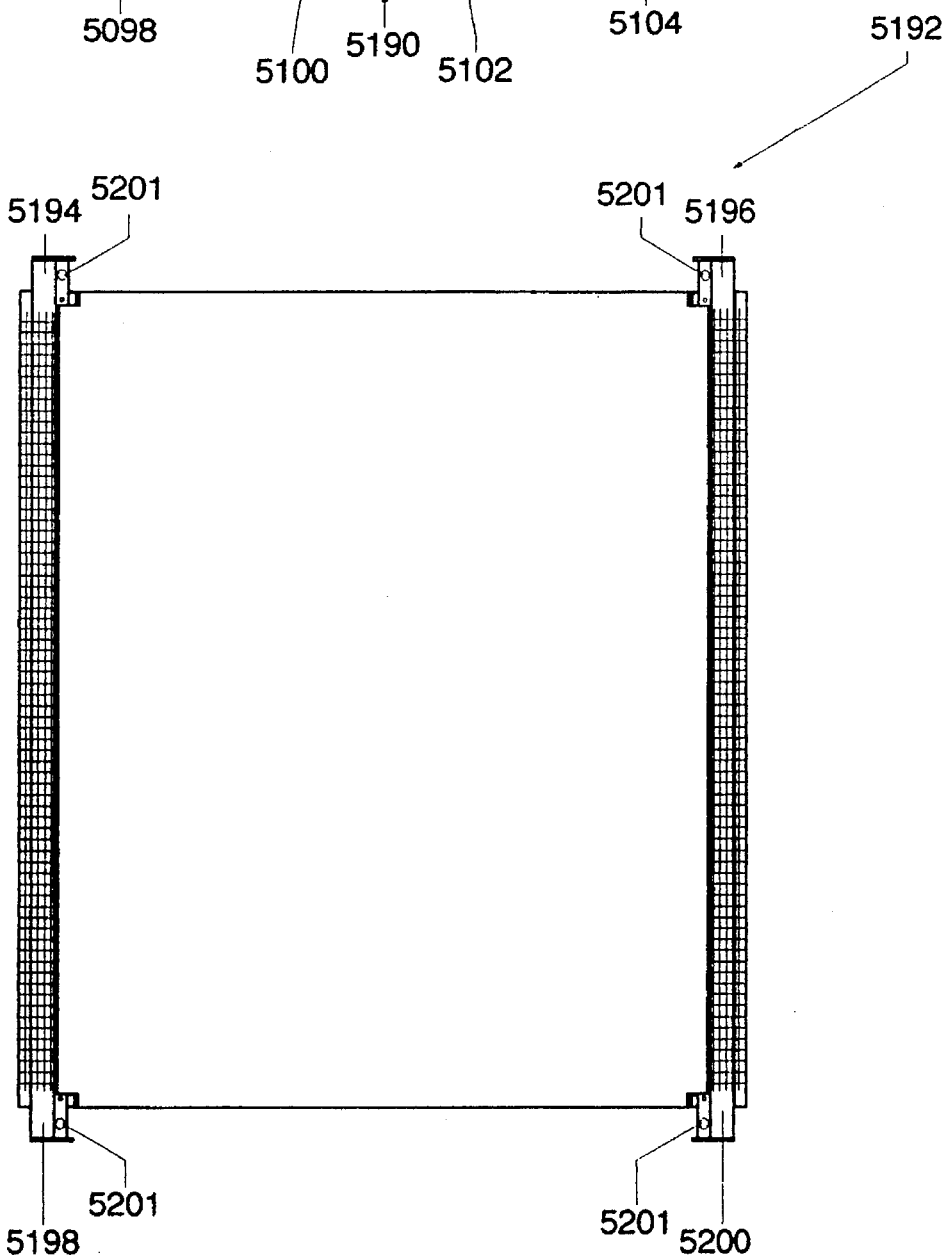

FIG. 71 is a plan view of frame members included in a curved exterior wall panel according to an eighth embodiment of the invention;

FIG. 72 is a bottom view of a first curved frame member shown in FIG. 71;

FIG. 73 is a top view of a curved styrofoam slab according to the eighth embodiment of the invention;

FIG. 74 is a plan view of an assembly step in forming the panel according to the eighth embodiment wherein the curved styrofoam slab of FIG. 73 is placed upon a layer of mesh material and a water impermeable membrane;

FIG. 75 is a plan view of an assembly step in forming the panel according to the eighth embodiment wherein a tension cable is routed between opposite curved frame members and wherein the mesh and water impermeable membrane are wrapped around edges of end frame members of the panel;

FIG. 76 is a plan view of an assembly step in forming the panel according to the eighth embodiment wherein a second layer of mesh material is laid between the frame members to form a concave inner surface and wherein a concrete retaining edge form is secured to the frame members;

FIG. 77 is a cross-sectional view of the panel taken along lines 77—77 of FIG. 76;

FIG. 78 is a cross-sectional view of the curved wall panel;

FIG. 79 is a plan view of the completed curved wall panel; and

Figure 80:
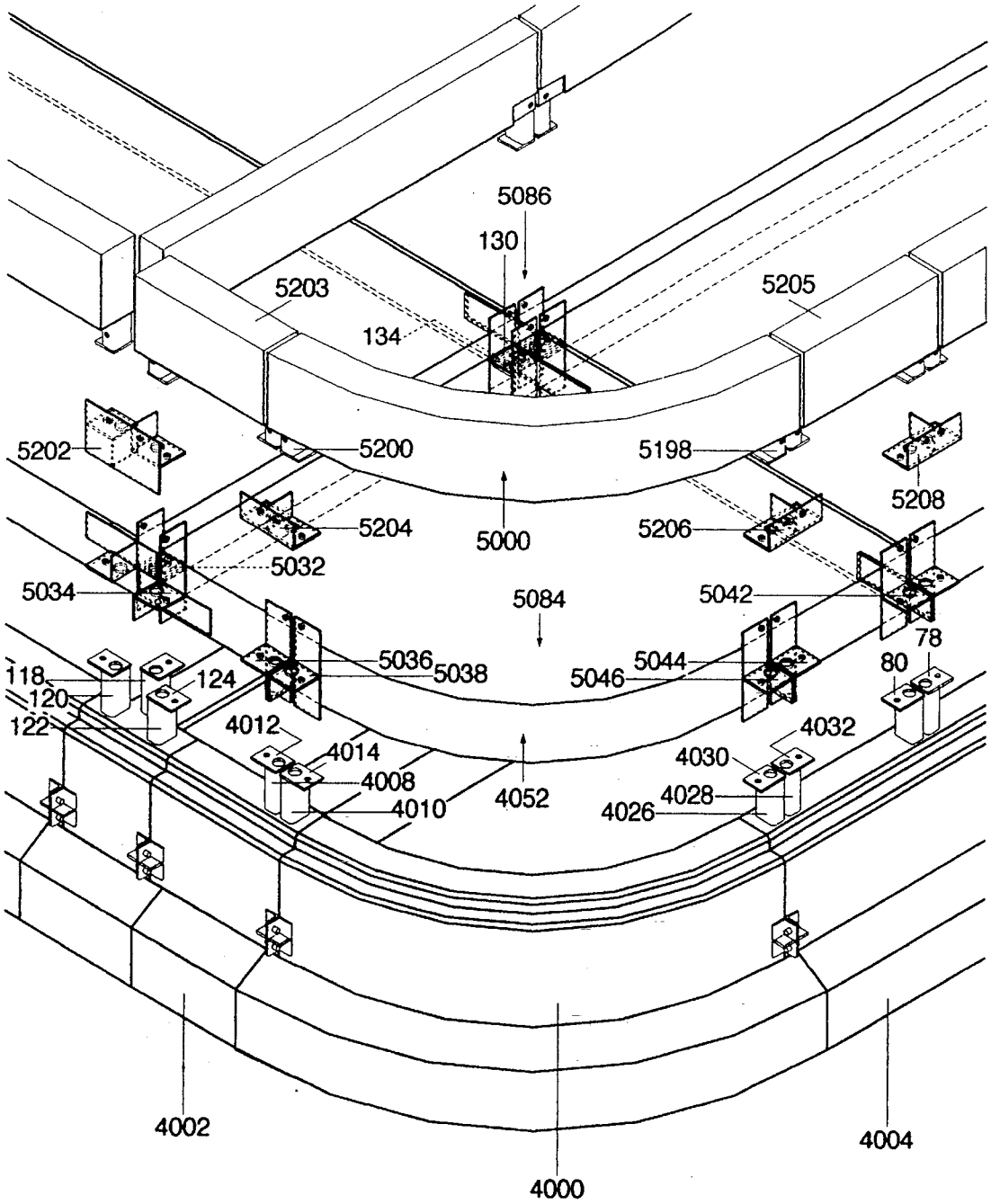

FIG. 80 is a perspective view of a corner of a structure having a curved foundation portion, a floor panel with a curved portion and a curved exterior wall portion according to the sixth, seventh and eighth embodiments of the invention.

This application contains 87 drawing figures.

DETAILED DESCRIPTION

Building structure and pre-fabricated panels

FIG. 1

Figure 1:
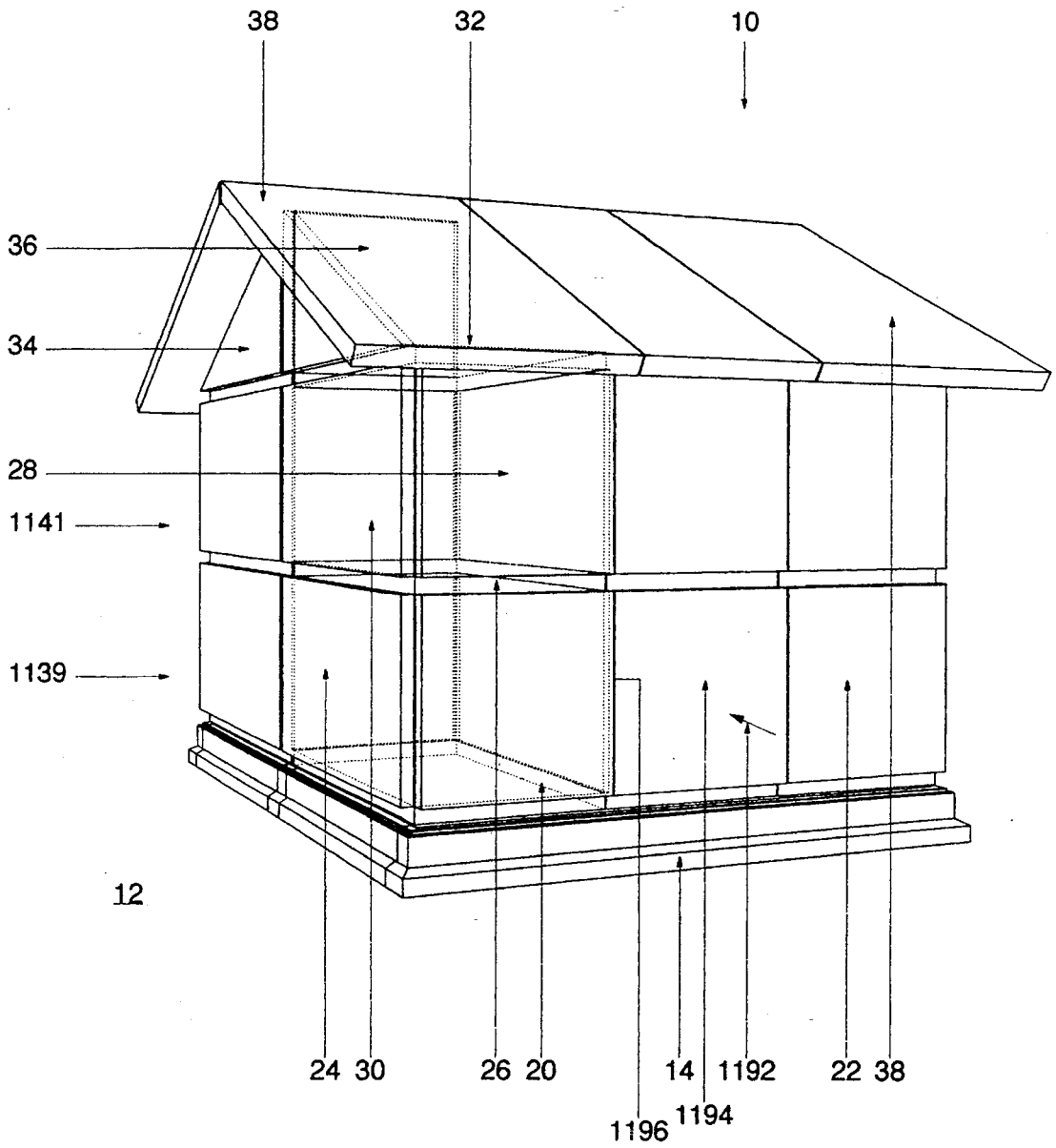
FIG. 1 is a perspective view of a house including a foundation, and floor, exterior wall, interior wall and roof panels according to various embodiments of the invention.

Referring to FIG. 1, a pre-fabricated house formed of foundation members and panels according to the invention is shown generally at 10 on a building site 12.

The house includes a foundation shown generally at 14, a first plurality of pre-fabricated first floor panels 20, a first plurality of pre-fabricated exterior wall panels 22, a first plurality of pre-fabricated interior wall panels 24, a second plurality of pre-fabricated second floor panels 26 a second plurality of pre-fabricated exterior wall panels 28, a second plurality of pre-fabricated interior wall panels 30, a third plurality of pre-fabricated floor panels 32, a third plurality of pre-fabricated exterior panels 34, a third plurality of pre-fabricated interior panels 36 and a plurality of pre-fabricated roof panels 38.

Foundation

FIG. 2

Referring to FIG. 2, the foundation 14 is shown in accordance with a first embodiment of the invention and includes side, end and centre foundation members designated 40, 42 and 44, respectively. Each foundation member is formed by casting concrete, to include a footing portion for resting on the ground and a support portion for supporting a building structure. The support portion is cast about a pre-assembled hollow steel beam. Each foundation member is also formed such that the side, end and centre foundation members have engaging faces 41 which mate with each other and can be connected to each other.

Side foundation members

The side foundation members 40 have first and second opposite end portions 46 and 48 and a middle portion 50 disposed therebetween. The first and second end portions 46 and 48 have first and second short steel tubing portions 52 and 54, respectively while the middle portion has a relatively long steel tubing portion 56 which is welded to and extends between the first and second end portions. The long portion 56 is in communication with the short portions such that a duct 58 is formed between the first tubing portion 52 and the second tubing portion 54. As the tubing portions are welded together, a unitary length of structural tubing is formed. The duct is operable to hold utility service conduits for water, electricity, etc.

FIG. 3

Referring to FIG. 3, the side foundation member 40 is formed with a concrete footing portion 60 and a concrete support portion 62 which encircle the steel tubing portions 52, 54, and 56 to form a structural support for the steel tubing portions. The steel tubing extends lengthwise in the support portion 62. A hollow conduit 64 is formed in the footing portion 60 and is filled with insulating material (not shown) such as styrofoam to provide insulating properties to the member and prevent ingress of moisture in the event that the concrete becomes cracked. The insulating material also renders the foundation member lighter in weight.

The first and second end portions 46 and 48, only portion 48 being shown in FIG. 3, have first and second vertically extending duct portions 66 and 68, respectively which are in immediate communication with the long steel tubing portion 56 and the second steel tubing portion 54, respectively. The first and second vertically extending duct portions have foundation connecting flanges 70 and 72, respectively which act as connecting means for connecting floor panels and wall panels to the foundation members. The middle portion 50 also has first and second vertically extending duct portions 74 and 76 which are disposed approximately midway between the first and second end portions and which are in immediate communication with the long steel tubing portion 56 and which have respective foundation connecting flanges 78 and 80. Each of the foundation connecting flanges 70, 72, 78 and 80 has a respective opening 82 for permitting access to, and for communication with its respective vertical duet and each flange has a respective threaded opening 84 for permitting a fastening member to be received therein for use in connecting the floor panels to the foundation members.

Referring to FIGS. 2 and 3, the first and second end portions 46 and 48 also have first and second connecting flanges 86 and 88 which are flush with respective end engaging faces of the side foundation member. The first and second connecting flanges 86 and 88 are used to connect the side foundation member to an adjacent end foundation member 42. The horizontal duct formed by the hollow tubing has end openings 89 and 91 which are accessible at respective engaging faces 41.

End foundation members

Referring to FIG. 2, the end foundation members 42 are similar to the side foundation members in that they include a hollow steel tubing portion 90, have footing and support portions 92 and 94, respectively and have an insulation filled conduit 96, shown best in FIG. 3. Referring back to FIG. 2, the end foundation members also have first and second end portions 98 and 100 to which are rigidly connected first and second elastically deformable connecting flanges 102 and 104 which extend from the hollow steel tubing portion 90 for mating engagement with and bolting to co-operating connecting flanges of an adjacent side foundation member (such as 86, 88 and 142).

Centre foundation member

Still referring to FIG. 2, the centre foundation member 44 has a central portion 106 and first and second "T"-shaped end portions 108 and 110. The central portion 106 includes a relatively long hollow steel tubing portion 112 which is connected to first and second hollow steel end members 114 and 116 disposed at right angles to the long steel tubing portion 112 and connected so as to permit communication between the first and second hollow steel members 114 and 116.

Each end portion 108 and 110 has first, second and third vertically extending ducts 118, 120 and 122, respectively. The first vertically extending duct 118 is in direct communication with the long steel tubing portion 112 while the second and third vertically extending duets are in direct communication with the first (and second) steel end member 114. Each of the first, second and third ducts has a respective duct connecting flange 124 having an opening 126 in communication with its respective duct and a threaded opening 127 for receiving a threaded fastener for use in connecting an adjacent floor member to the centre foundation member.

The central portion 106 also has first and second vertically extending duct portions 128 and 130 which are disposed approximately midway between the first and second end portions 108 and 110 and which are in immediate communication with the long steel tubing portion 112. These duct portions also have respective foundation connecting flanges 132 and 134. Each of the foundation connecting flanges has a respective opening 136 for communication with its respective vertical duct and each flange has a respective threaded opening 138 for permitting a fastening member to be received therein for use in connecting the floor panels to the foundation members.

The centre foundation member further includes first and second connecting flanges 140 and 142 on opposite sides of the member for use in connecting the centre foundation member to adjacent end members 42.

In the preferred embodiment, all steel components of respective foundation members are welded to adjacent steel members of the same foundation member such that the steel components form a rigid structure within the foundation portion. The concrete footing portions and wall portions are then formed about the rigid structure to form the individual foundation members depicted in the drawings. If desired, the concrete curing process may be accelerated by passing the members through an oven or by the use of steam. Desired finishes and waterproofing can also be added at this time. The individual foundation members are then connected together using the elastically deformable connecting flanges on each member to form a foundation for the entire building structure as shown in FIG. 2. The connecting flanges also connect together the steel tubing members of the foundation members, thus forming a space frame lying in a flat plane, with the tubing members of each of the foundation members acting as the space frame members.

Floor panel

FIG. 4

Referring to FIG. 4, the fabrication of a floor panel according to a second embodiment of the invention is begun by cutting to length first, second, third, fourth and fifth 2"×4" hollow steel tubing frame members as shown at 150, 152, 153, 154 and 155, although it will be appreciated that the steel tubing may be of any suitable size to meet any desired structural loading requirement. The steel tubing members act as frame members for the panel. Frame members 152 and 154 form a pair of adjacent sides of the frame and frame members 150 and 155 form a pair of opposite sides of the frame, the pair of opposite sides extending between the pair of adjacent sides. Frame member 153 extends between frame members 150 and 155 at a central location between members 152 and 154.

Frame members 150 and 155 have respective opposite end portions 156, 158, 160 and 162, respectively. Only end portion 156 will be described, it being understood that end portions 158, 160 and 162 are similar.

FIGS. 5, 6 and 7

Referring to FIGS. 5, 6 and 7, end portion 156 is shown in greater detail. Frame member 150 has a longitudinal axis 164, an outside face 165, an inside face 190 and an end face 166. The outside face 165 extends the length of the frame member and forms an outer edge of the ultimate panel. The inside face 190 faces inwards toward an interior portion of the frame. Secured to the end face 166 is a plate 168 extending to cover the end portion of the steel frame member 150. Plate 168 has first and second service openings 176 and 178 which provide access to a hollow portion 180 within the longitudinal frame member 150 and extending the length thereof. The plate also has openings 182 and 184 for receiving threaded fasteners to permit the plate and hence the longitudinal frame member 150 to be fastened to an adjacent member of an adjacent panel.

Referring to FIG. 5, a parallel member 170 extends in a direction parallel to the longitudinal axis 164. The parallel member 170 is welded to the longitudinal frame member 150 and is welded to the plate 168. A flange 172 extending perpendicular to the plate 168 and perpendicular to the parallel extending member 170 is connected to the parallel member 170 and the plate 166. The flange 172 has an opening 174 of sufficient size to receive electrical conduits and/or water service conduits (not shown).

FIG. 6

Referring to FIG. 6, inside face 190 has pin receptacles 186 and 188. Beginning adjacent the receptacle 186 on the inside face 190, a first plurality of steel plates 192, to which are fastened respective pre-welded steel hooks 196, extends in a first hook plane 308, longitudinally along the frame member 150. Referring to FIG. 4, the hooks 196 are located at spaced apart intervals along the frame member 150.

Referring back to FIG. 6, a second plurality of steel plates 194 to which are fastened respective hooks 198, also extends in a second hook plane 312, longitudinally along the frame member 150. The first and second hook planes 308 and 312 are parallel and spaced apart and extend symmetrically on opposite sides of a transversely extending longitudinal plane 197 intersecting the longitudinal axis 164 of FIG. 5.

Referring to FIG. 7, the longitudinal plane 197 divides the frame member into two portions comprising a side one portion 199 and a side two portion 201. Thus, the hooks 196 lying in the first hook plane 308 are on the side one portion and the hooks 198 lying in the second hook plane 312 are on the side two portion. In the present embodiment, the side one portion 199 will ultimately form the "floor" surface of the panel and the side two portion 201 will ultimately face the ground beneath the house.

FIGS 6 and 7

Referring to FIGS. 6 and 7, there is further secured to the inside face 190 a first plurality of pre-cut bent chair bolster hooks 204, each having first and second opposing portions 206 and 208, respectively, shown best in FIG. 7. The first portions 206 of the hooks are disposed in spaced apart relation in a third hook plane 310 extending longitudinally along the side one portion 199 of the frame member. The third hook plane is parallel to and spaced apart from the first and second hook planes 308 and 312.

A second plurality of pre-cut bent chair bolster hooks 210 also having first and second opposing hook portions 212 and 214, respectively are disposed in spaced apart relation along the side two portion 201 of the frame member. The first hook portions 212 are disposed in a fourth hook plane parallel to and spaced apart from the first, second and third hook planes 308, 310 and 312.

Referring to FIG. 4, it will be appreciated that the members 150 and 155 are mirror images of each other and therefore frame member 155 has a similar arrangement of hooks 196 and chair bolster hooks 204 (and 210 not shown).

Still referring to FIG. 4, the side members 152 and 154 have first and second end portions respectively, the end portions being designated 216 and 218, respectively. The end portions are similar and therefore only end portion 216 will be described.

FIG. 8

Referring to FIG. 8, frame member 152 has an outer face 220, an inner face 222 and a longitudinal axis 225, the longitudinal axis 225 lying in the same longitudinal plane 197 as the longitudinal axis 164 of frame member 150. An end face 226 is formed at end portion 216 and lies in an end face plane 217. To the inner face 222 is secured a transversely extending angle member 224 having a projecting portion 228 and a parallel portion 229. The projecting portion 228 extends in the end face plane 217 and the projecting portion 229 is welded to the inner face 222.

FIG. 9

Referring to FIG. 9 the projecting portion 228 has a first transversely extending hook 230 extending perpendicularly to the end face plane 217. The hook has a first shank portion 232 extending past the end face plane 217 and has a first hook portion 234 extending opposite the first shank portion 232, parallel and adjacent to the parallel portion 229. The first hook portion 234 lies in a fifth hook plane 340 extending parallel to and spaced apart from the longitudinal plane 197, adjacent a side one portion 221 of the frame member. The fifth hook plane is also parallel to and spaced apart from the first, second, third and fourth hook planes 308,312, 310 and 314.

Still referring to FIG. 9, the end portion 216 also has a second hook 236 on a portion of the angle member opposite the first hook 230, the second hook has a second shank portion 238 and has a second hook portion 240. The second shank portion 238 extends parallel to the first shank portion 232 and is spaced apart therefrom. The second hook portion 240 lies in a sixth hook plane 341 extending parallel to and spaced apart from the longitudinal plane 197, adjacent a side two portion 223 of the frame member. The sixth hook plane is also parallel to and spaced apart from the first, second, third, fourth and fifth hook planes 308, 312, 310, 314 and 340.

FIGS. 9 and 10

Referring to FIGS. 9 and 10, secured to the side one portion 221 of the inner face 222 is a first plurality of chair bolster hooks 242. The chair bolster hooks 242 are secured in spaced apart relation longitudinally along the frame member 152 and are similar to the chair bolster hooks 204 described previously and shown in FIGS. 5, 6 and 7. Referring back to FIGS. 9 and 10 each of the hooks 242 has a first portion 244 which lies in the third hook plane 310.

Similarly, secured to the side two portion 223 of the inside face is a second plurality of chair bolster hooks 248. The chair bolster hooks 248 are also secured in spaced apart relation longitudinally along the frame member 152 and are similar to the chair bolster hooks 210 described previously and shown in FIGS. 5, 6 and 7. Referring back to FIGS. 9 and 10, each of the hooks 248 has a first portion 243 which lies in the fourth hook plane 314.

Referring back to FIG. 4, frame member 153 is similar to frame members 152 and 154 with the exception that frame member 153 has two inside faces 245 and 247 each with a respective plurality of chair bolster hooks 260 disposed such that hook portions thereof lie in the third and fourth hook planes 310 and 314, respectively. In addition, frame member 153 has first and second end portions 262 and 264, respectively, each with four hooks and extending shank portions similar to shank portions 232 and 238 in FIGS. 9 and 10, only two of such hooks being shown in FIG. 4 at 266 and 268.

To assemble the frame members together, the shank portions 232 and 238 shown in FIGS. 9 and 10 are received in receptacles 186 and 188 of the frame member 150 shown in FIG. 6. A similar insertion is performed at each of the remaining corners of the frame. In addition, the four hook portions, only two of which are shown at 266 and 268 in FIG. 4, are received within corresponding receptacles (not shown) in longitudinal frame member 150.

No screws or rivets are used to connect the frame members together. The shank portions at each joint are merely loosely held in their receptacles and thus the opposite members 150 and 155 are permitted to move in a direction parallel with the longitudinal axes of adjacent frame members 152, 153 and 154. This is important as it permits the frame to absorb forces exerted on the ultimate panel which renders the panel effective in absorbing dynamic forces such as seismic forces due to earthquakes, hurricanes, heat stresses from fire, and forces due to flooding.

FIG. 11

Referring to FIG. 11, the frame members are connected together in the loosely connected arrangement described above to form a frame lying in a frame plane. In the embodiment shown, the frame members define the perimeter of the panel, the perimeter bounding first and second interior portions of the panel 270 and 272. On side one of the panel, within the first interior portion 270, is disposed a first preformed or pre-cast insulating slab 274 of styrofoam. The styrofoam slab has outer dimensions which permit the slab to fit snugly within the interior portion, between the frame members 150, 152, 153 and 155.

The styrofoam slab is preformed or pre-cast to have a plurality of longitudinally extending recesses 276, 278, 280, 282, 284 and 286. The slab also has first and second laterally extending recesses 288 and 290 which extend laterally of the slab between opposite sides thereof. The slab also has first and second diagonal recesses 292 and 294 which form an "X" shape in the slab. The recesses are formed in what will ultimately form an interior side 296 of the panel. An exterior side (not shown) opposite the interior side is formed in a similar manner.

FIG. 12

Referring to FIG. 12, recess 278 is representative of the remaining recesses and is generally truncated triangular in shape. Each recess has first and second sloping side portions 298 and 300 connected by a bottom portion 302.

Each of the four sides of the insulating slab, adjacent the frame members 150, 152, 153 and 155 is formed with a projecting portion 304 having a thickness defined as the distance between opposing bottom portions of immediately adjacent recesses on opposite sides of the slab. The thickness is designated 306 in FIG. 12 and is proportional to the desired insulative or "R" value of the panel.

FIG. 13

Referring to FIG. 13, the thickness 306 of the projecting portion 304 is formed such that the projecting portion is received between the first and second pluralities of hooks 196 and 198 on the upper and lower portions of the inside face of member 150. The projecting portions on the remaining sides of the slab are received between corresponding hook members on adjacent frame members. The first and second pluralities of hooks 196 and 198 thus serve to locate the slab relative to the frame. Consequently, it is important that the hooks 196 and 198 and similar hooks on the other frame members are located symmetrically about the longitudinal axis of respective frame members to ensure that the insulating slab is located centrally between sides one and two of the panel.

FIG. 14

Referring to FIG. 14, a turnbuckle 316 is connected to a hook 196 adjacent recess 284. A unitary, resiliently extendable cable 318 is connected to the turnbuckle 316 and is routed in recess 284 past the hook 196 on frame member 155 opposite frame member 150. The cable is then routed in recess 290 to an adjacent hook 196 adjacent recess 282 and is then further routed in recess 282 back to a hook 196 on frame member 150. The cable is routed in similar fashion between the frame members 150 and 155 until a first corner 322 of the panel is reached. It will be appreciated that as all of the hooks 196 lie in the first hook plane 308, shown best in FIG. 13, the portion of the tension cable 318 routed thus far also lies in the first hook plane 308.

FIG. 15

Referring to FIG. 15, when the cable is routed to the corner 322, the cable is routed from hook 196 upwards to first shank portion 232. From here, referring back to FIG. 14, the cable is routed through a diagonal path in diagonal recess 292 to a diagonally opposite second corner 324 of the panel. As the first shank portion 232 in the corner 322 and corresponding first shank portion 232 in corner 324 lie in the fifth hook plane 340, shown in FIG. 15, the cable in diagonal recess 292 of FIG. 14 also lies in the fifth hook plane 340.

Referring back to FIG. 14, the cable is then routed downwards in corner 324 to an adjacent hook 196 lying in the first hook plane 308 (not shown in FIG. 14) and extends in recess 286 to hook 196 in an opposite third corner 326. The portion of the cable extending in recess 286 thus lies in the first plane 308. At corner 326, the cable is routed upwards to the first shank portion 232 lying in the fifth hook plane 340 and then extends diagonally in diagonal recess 294 to a diagonally opposite fourth corner 328 whereupon the cable is fastened to first shank portion 232. This diagonal extending portion of the cable thus also lies in the fifth hook plane 340.

The turnbuckle 316, which acts as tightening and tensioning means for tensioning the cable, is then tightened to tighten and tension the cable 318 to approximately 600 lbs., although the tension may be higher or lower to suit the particular structural loading expected to be imposed on the panel.

Tightening and tensioning of the cable biases the opposite frame members 150 and 155 inwards towards the interior portion 270 of the panel. The cable and turnbuckle thus act as biasing means for biasing at least some of the frame members inwardly, generally in the frame plane, towards the interior portion of the panel.

It will be appreciated that the cable 318 has longitudinally and transversely extending portions which extend within the longitudinally and transversely extending recesses and has diagonally extending portions which extend within the diagonally extending recesses. Referring to FIG. 15, it will be appreciated that the longitudinally and transversely extending portions lie in a first plane (308) whereas the diagonally extending portions lie in a second plane (340), the second plane being spaced apart from the first plane. Generally, the spacing between the first and second planes should be increased with increased structural loading and decreased with decreased structural loading.

A similar procedure of installing styrofoam and a tension cable is followed for the second interior portion 272 of the panel.

FIG. 16

Referring to FIG. 16, a first layer of wire mesh 330 is cut to fit within the interior portion 270 and has first, second, third and fourth edges 332,334,336 and 338. The wire mesh 330 is tensioned, through the use of a conventional tensioning tool, to tighten it between at least two frame members. The edges 332, 334, 336 and 338 are connected to the chair bolster hook portions lying in the third plane 310 on each of the frame members 150, 152, 153 and 155.

FIG. 17

Referring to FIG. 17, the first layer of wire mesh 330 thus lies in the third hook plane 310 and is spaced apart from the remaining planes. It will be appreciated that the diagonal cable portions lying in the fifth hook plane 340 which is immediately adjacent, act as supports for the mesh. Tie wires (not shown) may be used to connect the mesh to the diagonal cables to prevent the mesh from movement during subsequent steps.

Referring back to FIG. 16, the second interior portion 272 also includes its own first layer of wire mesh material similar to that of the first interior portion.

Still referring to FIG. 16, a concrete form edge retaining member 343 is connected to the frame members to further define an outer perimeter of the panel. The retaining member is connected by means of rivets, screws or point welding to the frame members 150, 152, 154 and 155. Concrete is then poured onto the mesh 330, to fill the recesses in the styrofoam slab, and is bounded by the form edge retaining member 343.

The concrete used in construction of the panel may be of virtually any mix. The ratio of gypsum to gravel in the mix can be selected to suit the particular conditions under which the panel is to be used. Preferably, the mix includes a waterproofing agent such as epoxy resin which imparts to the resulting concrete an ability to prevent moisture ingress and a resilient flexibility useful in absorbing energy imparted to the panel by seismic activity or even shell-fire. In one embodiment in which the panel was used in the Pacific Northwest, the ratio of cement to sand to gravel to water to epoxy was approximately 1:2:4:1:0.05.

It will be appreciated that chips of marble, granite, crystallized sand mixed with water and any colour of cement may be used in the mixture to produce a good architectural base suitable for finishing.

FIG. 18

Referring to FIG. 18 the concrete passes through the mesh and flows into the recesses such as 276 of the insulating slab such that the concrete extends about the tension cable 318 and about the first layer of mesh 330. The concrete thus has a planar portion shown generally at 342 and has a plurality of rib portions 344. The rib portions extend perpendicularly from the planar portion 342 to form transverse, longitudinal and diagonal ribs defined by the recess portions of the insulating slab. As the recesses extend substantially between the opposite frame members, so do the concrete ribs. The width of the recesses may be widened to increase the overall strength of the panel and if the bottom portion is widened the slope of the first and second sloping side portions is preferably reduced. Effectively, the shapes of the recesses are optimized in cross-sectional area and section shape to optimize strength of the panel and to optimize the position of the neutral axis of the section for a given loading. The concrete ribs have embedded therein, portions of the tension cable which act as positive reinforcement when loads are applied to the panel and the planar portion has embedded therein the first layer of mesh which also acts as positive reinforcement. The diagonal ribs with embedded portions of the cables and the mesh in the planar portion also act to distribute dynamic and static stresses to the frame members when positive loading is applied centrally of the panel. The embedded portion of the cables and mesh also can act as negative reinforcement and distribute dynamic and static stresses when negative loading is applied centrally of the panel.

The concrete acts as a first solidified castable substance cast in the interior portion of the frame, between the frame members and about the biasing means such that loads imposed on the solidified castable substance (concrete) are transferred by the biasing means to the frame members.

FIG. 19

Referring to FIG. 19, side two 201 of the panel is finished in a manner similar to side one 199 and includes recesses similar to those on side one, includes a second turnbuckle, a second resiliently extendable tension cable having a second perpendicular portion 348 and a second diagonal portion 350, the second perpendicular portion lying in the second plane 312 and the second diagonal portion lying in the sixth hook plane 341. The second cable is routed in a manner similar to the first cable, about hooks 198 and 234 of FIG. 13.

Side two 201 further includes a second layer of wire mesh material 346 extending in the fourth hook plane 314. Side two also has a second concrete retaining edge 358 and concrete 360 is poured over the second layer of mesh material 346 about the perpendicular and diagonal portions of the second resiliently extendable cable 348 and 350, into the recesses 288 formed in the second side of the insulating material. The concrete on the second side thus has a second planar portion 362 and a plurality of ribs 364 extending perpendicularly to the planar portion, in a manner similar to the concrete on side one 199.

The concrete on sides one and two may be finished to have any desired surface to suit the placement of the panel. If side one 199 is used to form the ground floor of the house, it preferably will be finished with a smooth surface to which finishing such as tile, carpet terrazzo, chips of marble, etc., may be fastened. Side two 201, which will ultimately face the ground when installed, need not be finished smooth but is preferably coated and sealed with a conventional water proofing compound.

FIG. 20

Referring to FIG. 20, a completed floor panel manufactured according to the steps above to is shown generally at 370. The panel has first and second opposite longitudinal edges 372 and 374, respectively and has first and second opposite transverse edges 376 and 378, respectively which form a perimeter of the panel. These edges also define first, second, third and fourth corners of the panels designated 171,173,175 and 177, respectively. The parallel members 170 and flanges 172 on each of the end portions of the frame members 150 and 155 extend beyond the perimeter of the panel and are used for lifting and handling the panel and for connecting the panel to the foundation members and wall panels.

The parallel members 170 and flanges 172 act as co-operating connecting means for connecting the panel to a co-operating connecting means of an adjacent building panel. As the parallel members and flanges are formed from plate steel they are operable to deform elastically when subjected to dynamic forces imposed on the panel. Due to this elastic deformability, the parallel members and flanges are operable to absorb seismic forces and due to the rigid connection of the parallel members and flanges to the adjacent frame member residual seismic forces are transmitted throughout the frame and to adjacent frame members of an adjacent panel.

Connection of Floor Panel to Foundation

FIG. 21

Referring to FIG. 21, the floor panel 370 is in position for connection with the foundation members. The panel is positioned such that the first transverse edge 376 is adjacent the side foundation member 40 and the second longitudinal edge 374 is adjacent the end foundation member 42.

Prior to connecting the floor panel to the foundation members, a first corner connecting flange 380 is secured to the parallel member 170 adjacent the first transverse edge 376 and the second longitudinal edge 374 and a second corner connecting flange 382 is secured to the parallel member 170 adjacent the second transverse edge 378 and the second longitudinal edge 374. These corner connecting flanges are fastened by welding. Only the second longitudinal edge 374 of the panel, which faces outwardly of the house has corner flanges connected thereto. The first longitudinal edge which faces inwardly, has no such corner flanges.

The first and second corner connecting flanges have respective parallel flange portions 384 and 386 which extend parallel to the second transverse edge and right angled flange portions 388 and 390 which extend perpendicular to the second transverse edge.

The parallel flange portions 384 and 386 have respective utility conduit openings 392 and 394 and respective adjacent fastener openings 396 and 398. The utility conduit openings 392 and 394 permit utility service conduits (not shown) to pass therethrough. The fastener openings 396 and 398 are for use in receiving a threaded fastener for fastening the panel to the foundation members.

Installation of the floor panel 370 onto the foundation members is effected by positioning the floor panel, using a crane (not shown), such that flange 172 and parallel flange portion 384 are received directly on top of the foundation connecting flanges 70 and 72, respectively. In addition, the panel is positioned such that the remaining flanges extending from the panel are disposed directly on top of corresponding foundation connecting flanges on corresponding foundation members below.

In this position, the utility service conduit openings in flanges 172 and 384 are in axial alignment with the openings 82 in foundation connecting flanges 70 and 72 and are thus in communication with the interior of the steel tubing in the foundation members. Similarly, the fastener openings 176 and 396 are in axial alignment with corresponding threaded openings 84 in the foundation connecting flanges 70 and 72. Other fastener openings in other flanges on the panel are also in axial alignment with respective threaded openings in corresponding foundation connecting flanges. Threaded fasteners are then used in the threaded openings to securely fasten the panel to the foundation members, particularly if the floor is to be a deck portion of the house, with no wall panels connected thereto. If wall panels are to be connected however, the threaded fasteners would not be installed at this time.

Other floor panels constructed as explained above are similarly connected to the remaining duct flanges extending from the remaining foundation members. A first floor 400 of the house is thus formed by a plurality of floor panel members so connected to the foundation members.

In the embodiment depicted in the figures thus far, the dimensions of a single floor panel are 8'×8'. It will be appreciated, however, that the floor panel may be virtually any size. Interior and exterior wall panels, portions of which are shown at 402,404 (interior) and 406, 408, 410 and 412 (exterior), respectively are connected to respective plates 168 extending from respective corners of the floor panels 370.

As floor panel 370 measures 8'×8', the installation of the interior and exterior wall panels 402, 404, 406, 408 and 412 define a first room which has dimensions of at least 8'×16' as no interior panel is installed adjacent the first longitudinal edge 372 of the first floor panel. Alternatively, an interior panel may be installed at this location in which case a room having the dimensions of 8'×8' would be defined. Also alternatively, the room may be made larger in the longitudinal direction of the floor panels by cutting off the plates at the third corner 175 of the floor panel 370 and omitting the installation of the interior panel 402.

Omitting the installation of interior panel 402 would leave a gap 414 between adjacent transverse sides of adjacent panels, however, such gap may be filled with concrete or water impermeable sealant such as silicone to provide a smooth floor surface. Various finishes such as linoleum or carpeting etc., may then be placed upon this smooth surface.

Before describing the specific connection of the interior and exterior panels to the floor panels, each of these panels will be described.

Exterior Panel

FIG. 22

Referring to FIG. 22, the fabrication of an exterior panel according to the invention is begun by cutting to length first, second, third, fourth, fifth, sixth and seventh 2"×4" hollow steel tubing members as shown at 420, 422, 424, 426, 428,430 and 432, respectively. The steel tubing members act as frame members for the panel and are arranged to provide a window opening 434 and first, second and third panel portions 436, 438 and 440.

Frame members 420 and 432 have respective opposite end portions 442, 444, and 446, 448, respectively. Each of the end portions is similar and therefore only end portion 444 will be described but will be considered representative of each end portion.

FIG 23

Referring to FIG. 23, end portion 444 of frame member 420 is shown in greater detail. The frame member 420 has a longitudinal axis 450 extending centrally of the member. Inside and outside faces of the member are shown generally at 452 and 454, respectively, the inside face being directed towards an interior of the first panel portion 436 and the outside face being directed outwards from the panel and forming a portion of an outer perimeter of the panel. The frame member 420 also has a side one face 456 and a side two face 458, best seen in FIG. 24. The side one face ultimately faces the interior of the house and the side two face ultimately faces the exterior of the house.

FIGS. 23, 24 and 25

Referring to FIGS. 23, 24 and 25, the end portion 444 of Frame member 420 has secured thereto, a transversely extending plate 460. The plate has a cover portion 462 for covering the end portion of the frame member and has a lip portion 464 which extends inwards, towards the interior portion of the panel. The cover portion 462 has an opening 466 which permits access to a hollow interior portion 468 of the frame member. As with the floor panel, described previously, the hollow interior portion of the frame member permits utility service conduits to be routed therein.

Referring to FIGS. 23 and 24, the end portion 444 further includes a first transversely extending opening 470 in the side one face 456, a second transversely extending opening 472 in the side two face and a third opening 475 in the inside face 452 and first and second threaded openings 474 and 476 provided by first and second nuts 478 and 480 which are welded behind the side one 456 and side two 458 faces, respectively.

The inside face 452 has secured thereto a right angled member 482 having a mounting portion 484 and an extending portion 486. The mounting portion is welded to the inside face while the extending portion 486 projects perpendicularly to the inside face, toward the interior of the first panel portion 436. The extending portion has secured thereto a hook 488 having a hook portion 490 which is disposed in a first hook plane 492 adjacent the side one face 456, and a projecting pin portion 491 which projects parallel to the longitudinal axis 450, toward the plate 460.

The inside face also has secured thereto a plurality of chair bolster hooks 494 similar to the chair bolster hooks depicted as Items 204 and 210 in FIG. 7. Referring to FIG. 22, the chair bolster hooks 494 are disposed in spaced apart relation, longitudinally along the frame member 420 and extend between the opposite end portions 442 and 444. Referring back to FIGS. 24 and 25, the chair bolster hooks have respective hook portions 496 disposed in a second hook plane 498 between the side one face 456 and the first hook plane 492.

The plate 460 acts as a foot for supporting the frame member, the openings 466, 470, 472, and 475 provide access to utility service conduits inside the frame member. The threaded openings 474 and 476 are for securing the resulting panel to an adjacent panel and the extending portion 486 is for cooperating with an adjacent frame member of the same panel. The hook 488 is for cooperating with a tension cable for holding the panel together and the chair bolster hooks 494 are for holding a wire mesh in the second hook plane.

Referring back to FIG. 22, the frame member 432 is similar to the frame member 420 and therefore requires no further description. Frame members 422 and 426 are however, slightly different from frame members 420 and 432 and therefore will now be described.

Frame members 422 and 426 form upper and lower portions of the outer perimeter of the panel. Frame member 422 is divided into a first portion 500, a second portion 502 and a third portion 504. Frame member 426 is similarly divided into a first portion 506, a second portion 508 and a third portion 510.

The first portions 500 and 506 form part of the first panel portion 436 while the second portions 502 and 508 form portions of the second panel portion 438. The third portion 504 of member 422 forms a portion of a window frame about window opening 434 and the third portion 510 of member 426 acts as a frame portion of the third panel portion 440. With the exception of the third portion 504 of member 422 adjacent the window opening 434, each of the above described portions has a respective plurality of chair bolster hooks, each indicated at 512 and has a plurality of tension cable hooks, each indicated at 514.

FIG. 26

Referring to FIG. 26, the chair bolster hooks 512 each have respective hook portions 513 which lie in the second plane 498. In addition, the tension cable hooks 514 have respective hook portions 515 which lie in a third hook plane 517. The third plane 517 is parallel to and spaced apart from the first and second planes 492 and 498, respectively.

Referring back to FIG. 22, the exterior panel further includes the frame members 424, 428 and 430 which are disposed intermediate the frame members 422, 424, 426 and 432. Frame members 424 and 430 are similar, mirror images of each other and therefore only member 424 will be described.

Frame member 424 extends between frame members 422 and 426. Member 424 has a longitudinal axis 519, a first end portion and a second end portion 520 and 522. The first end portion 520 has a hook 524 which is similar to the hook 488 shown in FIG. 24. The hook 524 has a hook portion 526 which lies in the same, first hook plane 492 as the hook 488 shown in FIG. 24. Referring back to FIG. 22, the hook 524 also has a projecting pin portion 528 which extends parallel to the longitudinal axis 519 and which projects past the end portion 520 of the member.

The second end portion 522 of frame member 424 has first and second hooks 530 and 532 similar to hook 524, disposed on opposite sides of the end portion. Each of these hooks also has respective hook portions 534 and 536 lying in the first hook plane 492 (not shown in FIG. 22) and has respective projecting portions 538 and 540 projecting past the end portion 522.

A right angled member 542 is secured to a side of the frame member 424. The right angled member has a projecting portion 546 which projects inwards towards the third panel portion 440. A further hook 548 having a projecting portion 550 and a hook portion 552 is secured to the projecting portion. The projecting portion 550 extends parallel to the longitudinal axis 519, toward the window opening 434. The hook portion 552 extends toward the third panel portion 440 and lies in the first hook plane 492 (not shown in FIG. 22).

The frame member 424 has a first intermediate portion 554 which is disposed between the first and second end portions 520 and 522 and has a second intermediate portion 556 which is disposed between the right angled member 542 and the second end portion 522. The first intermediate portion has a plurality of chair bolster hooks 558 secured thereto in spaced apart relation along the length thereof. Similarly, the second intermediate portion 556 has a second plurality of chair bolster hooks 560. Both the first and second pluralities of chair bolster hooks have hook portions disposed in the second hook plane 498 (not shown in FIG. 22).

Frame member 428 extends between frame members 424 and 430 and has a plurality of hooks 562 having hook portions (not shown) lying in the third hook plane 517 seen best in FIG. 26. In addition, referring to FIGS. 22 and 26, frame member 428 has a plurality of chair bolster hooks 564 which have hook portions lying in the second hook plane 498. Frame member 428 also has openings indicated at 566 and 568 for receiving the projecting pin portions 550 of adjacent frame members 424 and 430. In addition, frame members 422 and 426 have respective openings 570 for receiving the projecting pin portions 491, 528, 538, 540, 532 and 530 of frame members 420, 424, 430 and 532, respectively.

FIG. 27

Referring to FIG. 27, before the frame members are connected together, a sheet of wire mesh 572 is cut into a "U" shape corresponding to the ultimate shape of the exterior panel. A vapour barrier 574 is similarly cut to shape and is placed on top of the mesh material 572. A styrofoam slab 576 having first 578, second 580 and third 582 panel portions is laid on top of the vapour barrier 574. The first, second and third panel portions 578, 580 and 582 are similar and therefore only panel portion 578 will be described.

Panel portion 578 includes a plurality of longitudinally extending recesses 583 and cross-diagonal recesses 584 and 586, respectively. The panel portion also has longitudinal edge portions 588 and 590 which are recessed for receiving the frame members 420 and 424, respectively as will be described further below.

Panel portions 580 and 582 have a similar construction and include a plurality of longitudinally extending recesses 592 and cross diagonal recesses 594 and 596, respectively.

FIG. 28

Referring to FIG. 28, frame members 420,422, 424, 426, 428, 430 and 432 are placed in corresponding recesses of the styrofoam slab 576. Respective projecting portions 491, 538 and 540 on each of the frame members are received in corresponding openings 570 in frame member 426. Frame member 428 is then installed between frame members 424 and 430, the projecting portions 550 being received in openings 566 and 568 on opposite end portions of member 428, respectively. Finally, member 422 is placed adjacent the frame members 420, 424, 430 and 432 such that the projecting portions 528 and projecting portions 491 of respective frame members are received in corresponding openings 570 in frame member 422. At this point therefore, the frame is loosely connected together and lies in a flat frame plane parallel to the plane of the drawing sheet.

At this time in the fabrication process, a recess 598 is cut longitudinally into a centre portion of the second panel portion 580 for receiving an electrical conduit 600 therein. The electrical conduit is connected to the frame member 426 by an electrical box 610 and is terminated in a second electrical box 612 operable to receive a standard wall socket cover. The conduit 600 is in communication with the hollow interior portion of frame member 426 and therefore electrical service conductors disposed in frame member 426 can be routed via conduit 600 to electrical box 612 to provide electrical service to a conventional wall receptacle (not shown) thereon.

FIG. 29

Referring to FIG. 29, first, second and third tension cables 614, 616 and 618 are routed in longitudinal and cross diagonal recesses of respective panel portions. Separate turnbuckles 620, 622 and 624 are used to tension respective tension cables 614, 616 and 618. The tension cable 614 is routed between the hooks 530, 526, 488, 514 in the first panel portion 436 such that portions of the cable lie in the diagonal recesses and portions of the cable lie in the longitudinal and transversely extending recesses. The second and third cables 616 and 618 are routed in a similar manner.

Referring back to FIG. 26, the portions of the tension cables in the longitudinal extending recesses 583 and 592, respectively extend in the third hook plane 517 whereas the tension cables extending in the cross-diagonal recesses 586 and 596 lie in the first hook plane 492. Referring back to FIG. 29, the first, second and third tension cables 614, 616 and 618 act as biasing means for biasing the frame members inwardly, generally in the frame plane, towards the interior portion of the panel.

The edge portions of the mesh material, indicated at 572 and 574 (in FIG. 27) are then bent over the adjacent frame members such as shown generally at 626 in FIG. 29. The edge portions are hooked onto the chair bolster hooks 494, 512 and 562 on adjacent frame members.

FIG. 30

Referring to FIG. 30, first, second and third individual rectangular pieces of flexible mesh material 628, 630 and 632 are then cut to fit respective first, second and third portions 578, 580 and 582 and are placed over such portions. Edge portions of respective portions of the pieces of flexible mesh material are hooked onto adjacent hook portions of chair bolster hooks on respective adjacent frame members. Referring back to FIG. 26, these hook portions such as indicated at 513 lie in the second hook plane 498 and thus the mesh material also lies in the second hook plane 498.

Referring back to FIG. 30, a concrete retaining edge 634 is then welded to respective frame members bounding the first, second and third panel portions, respectively. A concrete mix as described above is then poured over the mesh material 628, 630 and 632 such that the concrete flows through the mesh and into the longitudinal and cross-diagonal recesses of each panel portion. The concrete is poured and finished flush with the concrete retaining edge 634. The concrete thus has a finished planar surface (not shown) which is parallel to the plane of the drawing page of FIG. 30. This smooth surface will ultimately face the interior of the house.

FIG. 31

Referring to FIG. 31, the panel is then turned upside down relative to its orientation depicted in FIG. 30, whereupon a layer of stucco 636 is applied to the wire mesh 572 covering the first, second and third panel portions 436, 438 and 440, respectively. The manufacture of the panel is thus completed.

A window 638 may then be installed in the window opening 434. Alternatively, the window 638 may be installed after the panels are assembled to form the house.

The finished exterior panel includes a generally rectangular portion 640 with first, second, third and fourth panel connecting portions 642, 646, 648 and 650, respectively. Referring to FIG. 23, the connecting portions are portions of corresponding end portions of the longitudinal frame members 420 and 432.

FIG. 32

Referring to FIG. 32, it may be seen that the portions of the tension cable 616 which extend in the longitudinally extending recesses 583 lie in the third plane 517, portions of the tension cable which lie in the diagonal recesses lie in the first plane 492 while the mesh 630 lies in the second plane 498. Each of the planes 492, 498 and 517 are parallel and spaced apart from each other.

In addition, the concrete has a planar portion 660 in which the mesh 630 and the diagonal portions of the tension cable 616 are disposed. Rib portions such as shown at 662 extend perpendicularly to the planar portion 660, in the longitudinally extending recesses and in the diagonally extending recesses of the styrofoam slab 576. This is similar to that described with respect to the floor panel and thus the exterior wall panel has the same advantages of the floor panel which includes the ability to withstand positive and negative loads.

Interior Panel

Referring to FIG. 33, the fabrication of an interior panel according to the invention is begun by cutting to length first, second, third and fourth panel frame members 670, 672, 674 and 676 and first, second, third and fourth door frame members 678, 680, 682 and 684.

Panel frame members 670 and 672 are similar and form longitudinal edge portions of the panel. Panel frame members 674 and 676 are similar and form transverse edge portions of the panel.

Frame members 670 and 672 have respective first and second similar end portions 686 and 688, respectively. End portion 686 is representative of each of the end portions and therefore will be described, it being understood that remaining end portions are similar.

FIG. 34

Referring to FIG. 34, end portion 686 has a longitudinal axis 690 extending centrally of the member. The end portion has inside and outside faces designated generally at 692 and 694, respectively. The inside face 692 is directed towards an interior of the panel portion and the outside face 694 is directed outwards from the panel and forms a portion of an outer perimeter of the panel.

FIG. 35

Referring to FIG. 35, the end portion also has a side one face 696 and a side two face 698. The side one face ultimately faces the interior of a first room of the house and the side two face ultimately faces the interior of a second, adjacent room of the house.

The end portion 686 is similar to the end portion 444 illustrated in FIGS. 23, 24 and 25. In this regard, referring to FIG. 35, the end portion has openings 700, 702, and 703 which are similar to openings 470, 472 and 475, respectively. The end portion also has first and second threaded openings 704 and 706 which correspond to threaded openings 474 and 476 of FIG. 24.

The end portion 686, is also similar to the end portion described in FIGS. 23, 24 and 25 in that it has an end plate 708 which covers the end portion 686 and which has a projecting portion 709. Face 692 has a right-angled member 710 secured thereto. The right-angled member has a connecting portion 712 and a projecting portion 714. Referring to FIG. 35, the connecting portion 712 and the projecting portion 714 extend the full width of the member between faces 696 and 698. First and second hook members 716 and 718 are connected to the projecting portion 714 in parallel spaced apart relationship. First hook member 716 has a first hook portion 720 which lies in a first hook plane 722. Similarly, the second hook 718 has a hook portion 723 which lies in a second hook plane 724. In addition, hook 716 has a projecting pin portion 726, the projecting pin portion projecting in a direction parallel to the first hook plane 722. Similarly, the second hook 718 has a projecting portion 728 which is parallel to the projecting portion pin 726 and parallel to the second hook plane 724.

The frame member further includes a plurality of chair bolster hooks 730 which are disposed transversely across the frame member. The chair bolster hooks each have first and second hook portions 732 and 734, respectively. The first hook portion lies in a third hook plane 736 while the second hook portion 734 lies in a fourth hook plane 738. The first, second, third and fourth hook planes 722, 724, 736 and 738 are parallel and spaced apart relative to each other.

Referring back to FIG. 33, frame members 676 and 674 have respective opposite end portions 740 and 742. The end portions 740 and 742 are similar and therefore only end portion 740 will be described, it being understood that end portion 742 is similar.

FIG. 36

Referring to FIG. 36, end portion 740 has first and second openings 744 and 746 for receiving the pin portions 726 and 728 of the hooks 716 and 718 shown in FIG. 35. Referring back to FIG. 36, the end portion 740 further includes a plate 748 extending transversely of the frame member, the plate having first and second upstanding hooks portions 750 and 752 depending therefrom.

FIG. 37

Referring to FIG. 37, the first and second hooks 750 and 752 have respective hook portions 754 and 756 which lie in third and fourth parallel spaced apart planes 758 and 760, respectively.

Referring back to FIG. 36, the frame member further includes a plurality of chair bolster hooks 762 having first and second hook portions 764 and 766. The hook portion 764 lies in a fifth hook plane 768 while the second hook portion lies in a sixth hook plane 770.

FIG. 38

Referring to FIG. 38, end portions 686 and 740 are connected together as shown generally at 772. Pin portions 726 and 728 (not shown) are received in openings 744 and 746 (not shown), respectively, such that the end portion 740 rests on the projecting portion 714 of the right angled member 710. Hooks 720 and 752 are therefore disposed parallel to and adjacent to each other.

FIG. 39

Referring to FIG. 39, a styrofoam slab 774 is inserted within an area bounded by the frame members 670, 672, 674 and 676. The styrofoam slab has a plurality of longitudinally extending recesses 776, 778, 780, 782, 784, 786 and 788, first and second cross-diagonal recesses 790 and 792 and transversely extending recesses 794 and 796. A turnbuckle 798 is connected to hook 752 on frame member 676. A resiliently extendable flexible tension cable 800 is secured to the turnbuckle and routed in recesses 786, 794, 784, 796, 782, 794, 780, 796, 778, 794 and 776. The cable is then routed to hook portion 720 on frame member 670 and is then routed in cross-diagonal recess 790 to the corresponding hook portion 720 on frame member 672, in a diagonally opposite corner of the panel. The cable is then routed to hook 752 on frame member 674 and is routed longitudinally of the panel in recess 788 to a corresponding hook 752 on frame member 676. The cable is then routed to hook portion 720 on member 672 immediately adjacent hook 752, and is routed in cross diagonal recess 792 to hook portion 720 on member 670, in the diagonally opposite corner of the panel. Turnbuckle 798 is tightened to place the cable under tension such that the frame members 670, 672, 674 and 676 are drawn inwardly towards the interior portion of the panel. Frame members 678, 680, 682 and 684 are welded together to form a door opening 802, with member 678 being welded longitudinally to frame member 672. A second insulating slab 804 is inserted between members 678, 680, 682 and 684.

FIG. 40

Referring to FIG. 40, a first layer of wire mesh 806 is placed between the frame members 670, 672, 674 and 676. Edge portions of the mesh material 806 are fastened to the first hook portions 732 of the chair bolster hooks 730 on frame members 670 and 672 and are connected to the second hook portions 766 of the chair bolster hooks 762 of members 674 and 676. The wire mesh is thus secured to the frame members. A second layer of wire mesh 808 is connected to frame members 678,680, 682 and 684, respectively. A concrete retaining edge 810 is then connected to the frame members 670, 672, 674 and 676 to form an outer perimeter of the panel. Similarly, a second concrete retaining edge 810 is connected to frame members 678, 680, 682 and 684 to form a second retaining edge above the door opening 802.

FIG. 41

Referring to FIG. 41, a concrete mix as described above is then poured over the first and second layers of mesh material 806 and 808 and finished to form smooth surfaces indicated generally at 814 and 816, respectively. After pouring the concrete, the panel has first, second, third and fourth connecting members 818, 820, 822 and 824 corresponding to respective end portions of frame members 670 and 672 (not shown), for connecting the panel to adjacent panels and to floor and ceiling panels as will be described below. In addition, these members 818–824 may be used for handling and lifting the panel on the job site.

The panel is then turned upside-down relative to its orientation shown in FIG. 41 whereupon the side two portion of the panel is completed in a manner similar to the side one portion. Effectively therefore, the steps discussed above in forming the side one portion are repeated in forming the side two portion.

FIG. 42

Referring to FIG. 42, a cross-section of a completed interior panel according to the invention is shown generally at 826. The finished panel thus includes wire mesh 806 on a side one portion 828 of the panel and includes a further wire mesh 830 adjacent a side two portion 832 of the panel. The mesh 806 lies in the sixth plane 770 while the mesh portion 830 lies in the fifth plane 768. As stated earlier, the fifth and sixth planes 768 and 770 are parallel and spaced apart from each other and therefore the wire mesh portions 806 and 830 are also parallel and spaced apart.

The concrete poured on each side of the panel includes respective planar portions 834 and 835 and respective rib portions 836 and 837, the rib portions being formed by concrete flowing into the recessed portions such as shown at 778, of the styrofoam slab 774. The planar portions 834 and 835 extend about the mesh material 806 and 830, respectively. In addition, the planar portions extend about diagonally extending portions 838 and 840 of the flexible cable associated with the side one portion 828 and the planar portion of the concrete on the side two portion 832 extends about the diagonal portion 840 of the flexible cable on the side two portion 832. Similarly, the rib portions 836 extend about longitudinally extending portions of the flexible cable indicated at 842 for the side one portion 828 and 846 for the side two portion 832. It should be apparent that the diagonal portions of the cable 838 lie in the second plane 724 while the longitudinally extending portions and transversely extending portions of the cable 842 lie in the fourth plane 760. The second plane and the fourth plane 724 and 760 are parallel to and spaced apart from each other.

By routing the flexible cable in the manner described i.e. using diagonal portions and longitudinally and transverse portions in spaced apart planes, the panel is rendered with the ability to withstand positive and negative dynamic loading.

Roof Panel

FIG. 43

Referring to FIG. 43, the fabrication of a roof panel according to the invention is begun by cutting to length first, second, third, fourth and fifth panel frame members 850, 852, 853, 854 and 856. Frame members 850 and 852 are similar and frame members 854 and 856 are similar. All frame members are formed from steel tubing but may be formed from generally any alloy operable to withstand any desired loading.

Frame member 850 has a first end portion 860 and a second end portion 862. The frame member also has a main roof portion illustrated generally at 864 and an overhang portion illustrated generally at 866. The main roof portion 864 and overhang portion 866 are separated by a connecting portion 868. The main roof portion has a plurality of hooks 870 for securing a tensioned resiliently flexible cable to the frame member and has a plurality of chair bolster hooks 872 for securing wire mesh as will be described below. The overhang portion also has a plurality of tension cable hooks 874 and chair bolster hooks 876 for similar purposes. As frame member 852 is similar to frame member 850, frame member 852 also includes similar chair bolster hooks and main roof portions, connecting portions and overhang portions and therefore these components are labelled with the same numbers as corresponding components on member 850.

Frame member 854 also has first and second opposite end portions 878 and 880 and has an intermediate portion shown generally at 882 having a plurality of chair bolster hooks 884. Frame member 856 is similar to frame member 854 and has similar components. Similar components are labelled with the same numerical reference numbers as those indicated on frame member 854. Frame member 858 also has first and second opposite end portions 886 and 888 and has an intermediate portion 890 with a roof side 892 and an overhang side 894. The roof side 892 has a plurality of chair bolster hooks 896 mounted thereon and the overhang side has a plurality of chair bolster hooks 898 mounted thereon.

FIGS. 44 and 45

Referring to FIGS. 44 and 45, end portion 860 of frame member 850 is shown. Referring to FIG. 44, frame member 850 has an outside face 900 and an inside face 902. Referring to FIG. 45, the frame member has a roof side 904 and a ceiling side 906. The end portion 860 is cut at an angle 908 which determines the slope of the roof relative to the vertical. The end portion 860 includes an end plate 912 which is fastened by welding to a cut face 910 of the longitudinal member 850. The end plate 912 extends flush with the roof side 904 and has a connecting portion 914 which extends past the ceiling side 906. The connecting portion 914 has an opening 916 for receiving a connector such as a bolt therethrough.

The end portion further includes a flat horizontal plate 918 having an extending portion 920 and a flat connecting portion 922. The flat connecting portion 922 is secured to the outside face 900 of the end portion 860. The flat plate has an axis 924 which extends at right angles to the plate 912. A connecting plate 926 is further connected to the extending portion 920 and the plate 912 such that it is disposed at right angles to both the extending portion 920 and the plate 912. The connecting plate has an opening 928 extending therethrough for receiving a connector such as a bolt therethrough.

The end portion further includes a hook plate 930 secured to the inside face 902. A hook 932 having a hook portion 934 disposed in a first hook plane 936 is secured to the plate 930. The plate 930 is disposed immediately adjacent a chair bolster hook 872. The hook 932 corresponds to hook 870 illustrated in FIG. 43.

The end portion further includes a pair of laterally spaced apart openings in the face 902, the openings being designated 938 and 940, respectively. Opening 938 is disposed adjacent ceiling side 906 while opening 940 is disposed adjacent roof side 904.

FIGS. 46 and 47

Referring to FIGS. 46 and 47, the connecting portion 868 is shown in greater detail. The connecting portion 868 includes an open space 942 disposed between the pluralities of chair bolster hooks on the roof portion 864 and the overhang portion 868. The open space includes transversely and longitudinally spaced apart openings 944, 946, 948 and 950 for receiving pins on the end portion 886 of frame member 858 shown in FIG. 43. Referring back to FIG. 47, immediately adjacent the openings 944 and 950, adjacent the ceiling side 906, a plate 952 is secured to the ceiling side 906. An angularly extending portion 954 is connected to the plate 952. The angularly extending portion 954 includes a portion of 4"×4" steel tubing. The extending portion 954 extends at an angle 956 which is the same as angle 908 of FIG. 45. The extending portion 954 has an end plate 958 secured thereto for covering the end portion of the extending portion 954. The extending portion 954 further includes first and second threaded openings 960 and 962 for receiving fasteners therethrough.

FIG. 48 and 49

Referring to FIGS. 48 and 49, end portion 878 of Frame member 854 is shown in greater detail. The end portion includes a roof surface designated 964, an inner surface 966, an outer surface 968 and a ceiling surface 970. Referring to FIG. 49, the end portion 878 has a transversely extending angle member 972 having a connecting portion 974 and a projecting portion 976, the projecting portion 976 projecting at right angles to the inner surface 966. A pin 978 is secured to the projecting portion 976 adjacent the roof surface 964. A hook 980 having a pin portion 982 and a hook portion 984 is also connected to the projecting portion 976 in parallel spaced apart relation to the pin 978. Both the pin 978 and the pin portion 982 extend parallel to a longitudinal axis 986 of the member 854. In connecting the panel together, pin 978 and pin portion 982 are received in openings 940 and 938, respectively, shown in FIG. 45.

FIG. 50

Referring to FIG. 50, a sheet of wire mesh material 988 is laid flat and cut to the approximate size of a finished roof panel. A membrane such as tar paper 990 is also cut to size and laid upon the wire mesh 988. A first styrofoam slab 992 having a roof portion 994 and an overhang portion 996 is laid upon the tar paper 990. The styrofoam slab has longitudinal recesses 998 and 1000 extending along edges thereof and has a plurality of transversely extending recesses 1002, 1004, 1006, 1008, 1010, 1012 and 1014. In addition, the styrofoam slab has first and second cross diagonally extending recesses 1016 and 1018 and has third and fourth cross diagonal recesses 1020 and 1022. The cross diagonal recesses 1018 and 1016 extend between diagonally opposite corners of the roof portion 994. The cross diagonal recesses 1020 and 1022 extend between diagonally opposite corners of the overhang portion 996.

The styrofoam slab 992 further has frame holding recesses (not shown) in which frame members 850, 852, 854, 856 and 858 are received. When the frame members are placed into the recesses, the pin 978 and pin portion 982 depicted in FIG. 49 are received in openings 940 and 938 depicted in FIG. 45. Similarly, projecting pins on frame member 858 in FIG. 50 are received in openings 944, 946, 948 and 950, respectively in FIG. 47 and projecting pins on frame member 856 are received in corresponding openings (not shown) in end portion 862.

FIG. 51

Referring to FIG. 51, a turnbuckle 1024 is connected to one of the hooks 870. A resiliently extendible flexible tension cable 1026 is secured to the turnbuckle 1024 and is routed between hooks 870 on frame member 850 and 852 such that the cable has a plurality of portions lying in the first and second longitudinally extending recesses and in each of the transversely extending recesses. In addition, the cable has portions 1030 and 1032 extending in the cross diagonal recesses 1016 and 1018.

Similarly, the overhang portion has a turnbuckle 1034 connected to a hook 872 and a resiliently extendible flexible cable 1036 is fastened to the turnbuckle 1034. The cable 1036 is routed between hooks 872 and 874 on frame members 852 and 850, respectively such that the cable has portions 1038 which lie in the transversely extending and longitudinally extending recesses and has portions 1040 and 1042 which lie in the cross diagonally extending recesses 1020 and 1022, respectively. Upon fastening the cables, edge portions of the tar paper 990 and wire mesh material 988 are bent over respective adjacent frame members 854, 856, 850 and 852.

FIG. 52

Referring to FIG. 52, the panel further includes first and second portions of mesh material portions 1044 and 1046, respectively. The first portion 1044 is cut to fit between respective chair bolster hooks 872 on frame members 850 and 852 and between chair bolster hooks 884 and 896 on frame members 854 and 858. The second layer of mesh material 1046 is cut to extend between chair bolster hooks 876 on the overhang portion 866 of frame member 850 and 852. In addition, the second wire mesh extends between chair bolster hooks 898 and 884 on frame members 858 and 856, respectively. A concrete retaining edge 1048 extending the entire perimeter of the panel comprising both the roof portion and the overhang portion is then secured to respective perimeter frame members 854, 856, 850 and 852.

A concrete mix as described above is then poured over the mesh material portions 1044 and 1046 such that the concrete flows through the mesh material portion 1044 into the transversely, longitudinally, and cross diagonally extending recesses in the roof and overhang portions of the styrofoam slab. The ceiling side of the roof panel is thus completed.

The panel is then turned upside-down relative to its orientation depicted in FIG. 52 and concrete is poured over the wire mesh (999 not shown) to form a roof surface (not shown).

FIG. 53

Referring to FIG. 53, a portion of the roof panel is shown in cross-section and includes a ceiling side 1050 and a roof side 1052. The ceiling side includes the concrete which has a planar portion 1056 which extends the entire width and length of the panel and has a rib portion 1054 which extends perpendicularly to the planar portion in recess 1002. The remaining recesses in the styrofoam slab also have similar rib portions. The mesh material portion 1044 is disposed within a first plane 1058 while the cross diagonally extending portions of the flexible cable are disposed in a second plane 1060. The longitudinally and transversely extending portions of the cable 1026 lie in a third plane 1062. The first, second and third planes are parallel and spaced apart from each other. The cable 1026 lying in the third plane 1062 is thus spaced apart from the cable portion 1032 lying in the second plane 1060. This provides positive and negative reinforcement of the panel. The exterior mesh 999 lies in a fourth plane 1064. Concrete, such as shown at 1066, forms a roof surface of the panel and is embedded within minor exterior recesses 1068 formed in the styrofoam slab 992.

FIG. 54

Referring to FIG. 54, a finished panel according to the invention is shown generally at 1070. The finished panel includes a ceiling surface 1072, first and second peak connecting portions 1074 and 1076, first and second wall connecting portions 1078 and 1080 and first and second gutter connecting portions 1082 and 1084. The first and second peak connecting portions 1074 and 1076 connect the panel to an adjacent panel to form a peak of the roof of the house. The second peak connecting portions 1074 and 1076 correspond to the end portion 860 of frame members 850 and 852. Similarly, the wall connecting portions 1078 and 1080 correspond to the connecting portions depicted in FIGS. 46 and 47 and shown at 868 in FIG. 43.

Connecting Panels Together

Referring back to FIG. 21, two exterior panels such as shown in FIG. 31 are shown generally at 406 and 408. The third and fourth projecting portions 646 and 648 of panel 406 project downwardly for engagement with flanges 382 and 380, respectively. The third and fourth projecting portions of panel 408 project downwardly for engagement with flanges 172.

To facilitate connection of the exterior panels to the flanges, W-shaped and T-shaped connectors shown at 1090 and 1092, respectively are used. The W-shaped connectors 1090 are used in corners formed by abutting exterior panels while the T-shaped connectors 1092 are used to connect aligned, adjacent exterior panels.

The W-shaped connectors include first and second flat portions 1094 and 1096 and a W-shaped wall portion shown generally at 1098. The flat portions 1094 and 1096 have respective conduit openings 1100 and 1102 and have respective threaded openings 1104 and 1106. The wall portions have openings 1108 and 1110, respectively.

Similarly, the T-shaped connector has first and second flat portions 1112 and 1114 and an upstanding wall portion 1116 with the characteristic T-shape. Each of the flat portions has respective conduit openings 1118 and 1120 and has respective connecting openings 1122 and 1124. In addition, the wall portion 1116 has first and second openings 1126 and 1128 adjacent the first and second flat portions 1112 and 1114, respectively.

The exterior panels are connected to the floor panel 370 by first connecting the W-shaped connector and T-shaped connectors to corners and side portions, respectively. The panels 406 and 408 are placed in position whereupon the connecting portions 646 and 648 of panel 406 are placed upon the flat portions 1114 and 1094, respectively. Similarly, the connecting portions 646 and 648 of panel 408 are placed upon the flat portions 1096 and 1112, respectively.

Referring specifically to panel 408, the openings 474 in the connecting portions 646 align with openings 1110 and 1126, respectively. As the openings 474 are threaded, a bolt may simply be inserted through opening 1110 and a second bolt can be inserted through opening 1126 and threadedly engaged with openings 474 on opposite end portions of the panel respectively. The panel is thus secured to the W-shaped and T-shaped connectors.

In the case of the corner, the upstanding plate 168 of the floor panel 370 has an opening 182 which engages with a corresponding opening (476 not shown in FIG. 21) on an opposite side of the connecting portion 646 of the panel 408. A bolt is received through the opening 182 and is threadedly engaged with the opening (476) on the opposite side of the connecting portion 646. The opposite end portion of panel 408 is secured to corner 171 in a similar manner. Panel 406 is secured to the corners 177 and 173 in a similar manner. The exterior panels are thus connected to the floor panels and foundation.

Connection of Interior Panels

The interior panels are connected to the floor panels in a manner similar to the way in which the exterior panels are connected. The interior panels, shown best in FIG. 41, have respective downwardly projecting connecting portions 820 and 824. Each of the downwardly projecting connecting portions 820 and 824 has a respective threaded opening 704. A corresponding opening 706 (not shown) is available on an opposite side of the projecting portions as shown in FIG. 35.

Referring back to FIG. 21, to install the interior panels, the projecting portions 820 and 824 are placed in receptacles 1130 and 1132 formed between respective plates 168 of adjacent floor panels. Each of the plates has a respective opening 182 which is aligned with the opening 704 (and 706) when the interior panel is properly in place. A threaded fastener such as a bolt may be inserted through the openings 182 and threadedly engaged with openings 704 and 706, respectively to secure the interior panel to the floor panels. A similar procedure is performed to secure other interior panels to the floor panels.

It will be appreciated that the downward projecting connecting portions 820 and 824 have openings shown best in FIG. 34 at 700, 702 and 703 for routing conduits from the foundation members to the individual interior panels.

Referring back to FIG. 1, with the interior and exterior panels fastened to the floor and foundation members, a first storey 1139 of the house is completed. Additional exterior and interior panels may be secured to the panels forming the first storey in order to form a second storey 1141 of the house.

Referring to FIGS. 31 and 41, both the exterior panel shown in FIG. 31 and the interior panel shown in FIG. 41 have upwardly projecting panel connecting portions. With regard to the exterior panel in FIG. 31, the connecting portions are shown at 642 and 650, respectively. With regard to the interior panel shown in FIG. 41, the connecting portions are shown at 818 and 822, respectively.

The connecting portions 642, 650, 818 and 822 of FIGS. 31 and 41, respectively, are similar to the vertically extending duct portions 66 and 76 shown in FIG. 3. Thus, a floor panel member will act as a ceiling to a room on the first floor of the house and will act as a floor of a second floor of the house. Such a floor panel member is installed on the connecting members similar to the manner in which the floor panel 370 was installed on the foundation members as depicted in FIG. 21. Referring to FIG. 1, a second plurality of pre-fabricated exterior wall panels 28 are thus installed upon the panels of the first storey 1139.

FIG. 55

Referring to FIG. 55, the second plurality of pre-fabricated exterior and interior panels 28 and 30 forms an arrangement of connecting portions 642, 650, 818, the arrangement being similar to the upstanding flanges 70, 72, 124 shown in FIG. 3. Additional panels similar to the first and second pluralities of interior and exterior panels may be secured to these upstanding connecting portions 642, 650, 818 and 822 to create a house or structure having any number of storeys. In a preferred embodiment however, the house includes first and second storeys only and therefore the plurality of roof panels is installed above the second storey panels 28.

With the second plurality of second storey exterior panels 28 in place, the third floor panel 32 is secured to the upstanding connecting portions 642,650, 818 and 822, respectively. The third floor panel 32 acts as a ceiling for a room enclosed by the exterior panels 28 and the interior panels 30. The third floor 32 however, has an upper surface 1140 which acts as a floor surface of an attic portion of the house.

An attic panel 1142, similar in construction to the interior panel described in FIGS. 33 through 41 has connecting portions 1144, 1146, 1148 and 1150. These connecting portions are similar to connecting portions 818,820, 822 and 824 shown in FIG. 41. The attic panel 1142 has the same longitudinal dimension as the interior panel of FIG. 41, however, the attic panel 1142 has approximately one-half the vertical dimension of the interior panel shown in FIG. 41. The roof panel 1070 shown in FIG. 54 is then installed with second peak connecting portions 1074 and 1076 (not shown) connected to connecting portions 1144 and 1148 and with connecting portions 1078 and 1080 (not shown) being connected to the connecting portions 650 and 642 of the second storey exterior panel 28.

FIG. 56

Referring to FIG. 56, the connecting portion 1144 has first, second and third threaded openings 1152, 1154 and 1156, respectively. To install roof panels 1070 and 1158, the plate connecting portions 914 are abutted against opposite sides 1160 and 1162. In this position, the connecting plates 926 of respective roof panels 1070 and 1158 are received on top of the connecting portion 1144, such that openings 928 in the respective flange portions are aligned. This enables a bolt 1164 to be inserted through the openings 928 and secured in the threaded opening 1156. In addition, openings 916 in plate connecting portions 914 are aligned with the first and second threaded openings 1152 and 1154, respectively which enables first and second bolts 1166 and 1168 to be threadedly engaged with the threaded openings 1152 and 1154 to secure the roof panels in place.

FIG. 57

Referring to FIG. 57, to install the connecting portion 1078 of roof panel 38, a T-shaped connector 1170 having a horizontal portion 1172 and first and second vertical portions 1174 and 1176 is placed on top of the flange 172 of the third floor panel 32. The horizontal portion 1172 rests on the flange portion 172 and plate 958 of the extending portion 954 rests upon the horizontal portion 1172. With the T-shaped connector 1170 and the extending portion 954 and the floor panel 32 disposed as shown in FIG. 7, opening 962 is aligned with opening 182 in the plate 168 of the floor panel 32 and therefore a bolt 1178 may be inserted through the opening 182 to threadedly engage with the threaded opening 962. Similarly, first and second openings 1180 and 1182 are disposed in the first and second vertical portions 1174 and 1176 of the T-shaped member 1170. Opening 1180 is in alignment with threaded opening 960 in the extending portion 954 and therefore is operable to receive a bolt 1184 therethrough to threadedly engage the bolt with the threaded opening 960 to secure the extending portion 954 to the T-shaped connector 1170. Similarly, opening 1182 is in axial alignment with threaded opening 1186 in the connecting portion 642 of panel 28.

In addition, opening 182 in the plate 168 is axially aligned with a threaded opening 1188 on an inside portion of the connecting portion 642 and thus a bolt 1190 may be inserted through the opening 182 to threadedly engage with the threaded opening 1188 to secure the third floor panel to the connecting portion 642. The roof panel 32 is thus secured to the third floor panel 32 and the connecting portion 642. Other roof panels are secured in a similar manner.

Referring back to FIG. 1, the house 10 is formed by assembly of a plurality of panels. It will be appreciated that small gaps 1196 exist between adjacent panels and thus continuous wall portions extending an entire side or end of the house are eliminated. Rather, the sides and ends of the house are formed from a plurality of discrete panel portions connected together. This permits the panels to move slightly relative to each other which, in effect, permits portions of the wall formed by the discrete panels to move relative to each other. As there is no one continuous wall, such movement is less likely to permit the formation of cracks in the surfaces of the wall and thus the structural integrity of the wall and appearance of the wall is maintained. There are, however, small gaps 1196 which, at the time of assembly, are filled with a fire-proof elastic sealant such as silicone with ceramic thread or with expandable elastic foam which permits the panels to move relative to each other while maintaining an air tight seal in the gaps.

Co-operation of the assembled panels

A structure according to the invention disclosed herein is particularly well adapted to withstand moments created by seismic forces or shell-blast forces. Referring back to FIG. 2, it will be appreciated that the foundation of the house is formed from a plurality of foundation members connected together. This renders the foundation ductile which serves to absorb moments, imposed at one location on the foundation, in a plurality of locations on the foundation. The joints between adjacent foundation members serve to absorb such moments. This is an advantage over conventional one-piece rigid, continuous foundation designs wherein a moment applied to, say, one corner of such a foundation may cause the foundation to crack due to its inability to absorb such moments.

Referring back to FIG. 1, it will be appreciated that as each panel member has a solid frame member forming an outer perimeter of each panel, when the panels are connected together as explained above, the connected frame members form a three-dimensional, ductile, space frame. As the space frame is comprised of essentially the frame members bolted together, the members of the space frame are not rigidly connected together, but rather, provide some ductility and thus provide for some absorption of moments and forces transmitted to the space frame, such as from seismic forces or shell-blast forces travelling in the ground, through the foundation to the space frame or from shell-fire adjacent the building.

Thus, the panels are able to move slightly, relative to each other to absorb such forces. Thus the panels act elastically relative to each other. It will be appreciated that the horizontal portions of each of the wall panels are essentially connected to the vertical portions of the wall panels by pins which permit vertical movement of the horizontal frame members relative to the vertical members. In addition, as the tension cables in each panel are used to bias the frame members inwards towards an interior portion of each panel, the tension cables are operable to extend or contract slightly in the event of positive or negative loading on the panels and thus forces exerted on the panels and the frame members can be further absorbed in the resiliency of the tension cable. This is particularly provided by the use of diagonally extending tension cables in a plane parallel to and spaced apart from the transversely and longitudinally extending portions of the tension cables.

Seismic forces exerted on the foundation are absorbed by the joints in the foundation. Residual moments and forces are transmitted to the panels connected to the foundation and hence to the space frame structure formed by the connected panels. Further residual forces are transmitted to the structure in each panel, specifically, the mesh, the cables and concrete thereof. The mesh and cables are resilient and act to absorb most of the residual forces and moments. Thus, the magnitude of forces and moments finally reaching the concrete forming the panel is minimized, which reduces the risk of creating cracks in the concrete panel portions. The floor, wall and ceiling surfaces of the house thus remain virtually crack free, even after seismic activity or nearby shell-fire.

In addition, the invention presents a structure which is dynamically stable in various wind conditions. As the structure is comprised of a plurality of panels, the surface area over which the wind effects can act is reduced, relative to a unitary wall of a conventional house structure. Each panel itself can withstand both tension and compression and hence can absorb inwardly directed forces (positive loading) and outwardly directed forces (negative loading).

For example, an inward force in direction of arrow 1192 exerts positive loading on an exterior wall panel. A central portion of the panel, indicated generally at 1194, is permitted to move slightly inwards thereby stretching the tension cables on both the side one and side two portions of the panel, the tension cables resiliently resisting such stretching and absorbing the force accordingly. A force applied in a direction opposite to arrow 1192 represents negative loading and is absorbed in a similar manner, with the central portion of the panel moving slightly outwards to absorb the force, and then returning to its original position.

The above panels, foundation members and connectors permit a three-dimensional building structure such as the house shown in Figure I to be quickly and efficiently erected. As the panels are pre-fabricated, the entire manufacturing process of the panels can be completed in the factory. In particular, the aggregates used in forming the concrete can be selected and controlled to ensure uniformity, the concrete can be cured under controlled conditions, and can be ground, painted, baked or any other architectural finish can be applied.

In addition structural steel components can be precisely cut and formed using computer control techniques. Furthermore, the job-site on which the structure is being erected need only be provided with the necessary bolts and wrenches to fasten the panels together, a crane for lifting the panels into place, and a cutting torch for selectively cutting any undesired protruding connecting portions of panels. Furthermore, the panels are sufficiently robust that they may be shipped easily in a specially designed shipping container having conventional shipping container dimensions. Thus, the prefabricated panels are easily transported from the factory to the job-site.

Other uses for the panels

Hi-rise Structure

FIG. 58

Referring to FIG. 58, a further use of the panels according to the invention is realized in co-operation with the conventional hi-rise office or apartment building structure. A conventional hi-rise structure typically includes a plurality of vertical columns 1200 arranged in a rectangular array when viewed from above and a plurality of horizontal cross members 1202 arranged in a plurality of horizontally spaced apart planes 1204, 1206, 1208, 1210, 1212, 1214 along the vertical columns.

The vertical columns 1200 and horizontal cross members 1202 form the main structural components of the hi-rise and are conventional in design. By dimensioning the cross members for structural integrity and by suitable spacing of the planes, exterior 1216, interior 1218, and floor 1220 panels according to the invention can be connected together to form a module 1222, say, three storeys high, three units wide and four units long where each unit is an individual apartment or office.

The hi-rise can thus be built in a modular form, eliminating the pouring of each concrete floor of the hi-rise as is conventionally done.

Individual outer, or boundary panels, which lie adjacent the vertical columns or cross members are connected, using the connecting means associated with each panel, to respective adjacent vertical and horizontal members 1200 and 1202 such that a space frame is formed by the frame members of each panel and by the vertical and horizontal members of the hi-rise. A relatively large, unitary space frame is thus formed, the space frame defining an array of tenantable units between the spaced apart vertical planes. The projecting portions extending from the panels in a direction parallel to the edge portion of the panel act as the connecting means and are operable to deform elastically under seismic forces, the space frame having all of the benefits described earlier, including the ability to absorb moments and forces created by seismic activity or shell-fire. In addition, all of the benefits of the panels including the ability to absorb residual moments without cracking the concrete surface and the ability to withstand and distribute wind loading forces are obtained in the hi-rise.

Shipping Container

FIG. 59

Referring to FIG. 59, transportation of the panels forming a house can be easily accomplished by connecting floor panels of the house together to form a 16'×8'×9' shipping container as shown at 1230, with panels and other components of the house shown in broken outline, inside the container. The floor panels are connected together to form eight container corners, only seven of which are shown at 1232, 1234, 1236, 1238, 1240, 1242 and 1244, and four mid-portion connectors, only three of which are shown at 1248, 1250 and 1252.

FIGS 60*a–h*

Referring to FIGS. 60*a* and 60*b*, mid-portion connector 1248 is illustrated. First and second floor panels 1256 and 1258 are shown butted together end to end, in a horizontal plane. Similarly, third and fourth floor panels 1260 and 1262 are butted together end to end in a vertical plane. Plate portions 1264 and 1266 of the first and second floor panels 1256 and 1258 are bent at respective right angles to lie flat against respective undersides of the first and second floor panels. This allows respective edges 1268 and 1270 of the third and fourth panels to lie immediately adjacent the undersides of the first and second floor panels, respectively. In this configuration, respective flanges 1272 and 1274 and parallel members 1276 and 1278 abut with a relatively large top gap 1280 being formed between end edges 1282 and 1284 of the first and second floor panels, respectively. Opposite portions 1286 and 1288 of the plate portions are left to project vertically upward.

Similarly, parallel members 1290 and 1292 and flanges 1294 and 1296 on the third and fourth panels 1260 and 1262 abut, leaving a side gap 1298 and plate portions 1300 and 1302 projecting horizontally outward from the panels.

Referring to FIG. 60*c*, a top, middle wooden member 1304 is pre-notched to rest on the flanges (1272 and 1274 of FIG. 60*a* and FIG. 60*b*) such that a top surface 1306 thereof is approximately flush with the adjacent outer surfaces 1308 and 1310 of the first and second floor panels 1256 and 1258 and such that an end surface 1312 thereof is approximately flush with the parallel members 1276 and 1278. The plate portions 1286 and 1288 are then bent at right angles to overlap and secure the wooden member 1304 in the top gap.

A similar procedure is followed with a side middle wooden member 1314 such that an outer surface 1316 thereof is approximately flush with adjacent outer surfaces 1318 and 1320 of the third and fourth panels 1260 and 1262. The plate portions 1300 and 1302 are then bent at right angles to overlap and secure the side middle wooden member inside the side gap.

Referring to FIG. 60*d*, first and second plate portions 1322 and 1324 are secured across the top and side gaps, to the first and second floor panels 1256 and 1258 and to the third and fourth floor panels 1260 and 1262 respectively. Preferably, pre-threaded openings (not shown) are provided in the respective portions of the first and second floor panels, respectively, to receive bolts 1326 for securing plate portion 1322 to floor panels 1256 and 1258 and for securing plate portion 1324 to floor panels 1260 and 1262. The plates rigidly secure the floor panels together.

Referring to FIGS. 60*e* and 60*f*, the first container corner is shown generally at 1232. The corner is formed by the first and third panels 1256 and 1262 which are 8'×16'× floor panels. These panels are connected to a fifth floor panel 1328 having a square shape and measuring 8'×8'. The fifth floor panel acts as an end portion of the container. A first plate portion 1330 of the first panel is bent parallel to the underside of the floor panel to permit an edge 1332 of the third panel 1262 to lie closely adjacent to the underside of the first floor panel 1256. A second plate portion 1334 is left upstanding.

Similarly, a first plate portion of the third panel 1262 is bent as shown generally at 1336, in broken outline. The first plate portion is bent to extend parallel to an inside surface of the third panel 1262, while a second plate portion 1338 of the third panel 1262 is permitted to extend outwardly. In this configuration, respective parallel members 1340 and 1342 and respective flange members 1344 and 1346 are spaced apart and do not interfere with each other.

The fifth floor panel 1328 has first and second plate portions, the first plate portion being shown in broken outline at 1348 in FIG. 60*e* and the second plate portion being shown in solid outline at 1350 in FIGS. 60*e* and 60*f*. The first plate portion 1348 extends under the first panel 1256 while the second plate portion 1350 extends outwardly. The panel also has a parallel member 1352 and a flange member 1354 which project vertically upwardly relative to an edge 1356 of the panel 1328. Thus, a top edge gap 1358 and a side edge gap 1360 are formed at respective interfaces of the first and fifth panels 1256 and 1328 and the third and fifth panels 1262 and 1328.

Referring to FIG. 60*g*, the top edge gap is filled by a wooden top edge member 1362 suitably notched to accommodate the parallel and flange members (1340, 1344 and 1352, 1354 of FIGS. 60*e* and 60*f*) of the first and fifth panels, respectively. This permits first and second sides 1364 and 1366 of the top wooden member 1362 to lie flush with respective surfaces 1308 and 1368 of the first and fifth panels and permits an end face 1370 thereof to lie flush with the edge surface 1372 of the first panel 1256. The second plate portions 1334 and 1350 are then bent over the wooden member 1362 to secure it in place.

Similarly, a wooden side edge member 1374 is suitably notched (not shown) to accommodate the parallel and flange members 1342 and 1346 shown in FIG. 60*f*, such that first and second side surfaces 1376 and 1378 thereof lie generally flush with adjacent surfaces 1380 and 1382 respectively when placed in the edge gap 1360 shown in FIG. 60*e*. Referring back to FIG. 60*g*, the second plate portion 1338 is bent over the wooden side edge member 1374 to secure it in position.

Referring to FIG. 60*h*, a comer connector is shown generally at 1384. The corner connector is installed over the corner portion of the container after preparing the corner portion as shown in FIG. 60*g*. The comer connector includes a first right angled member 1386 and a top plate member 1388 to which is welded a crane adapter 1390. The first right angled member 1386 has first and second portions designated at 1392 and 1394 respectively. The first and second portions 1392 and 1394 are oriented at right angles to each other such that the first portion 1392 is operable to extend parallel to surface 1366 while the second portion is operable to extend parallel to surface 1372. The first and second members are secured to their respective adjacent surfaces by lag bolts 1400 extending into the nearby wooden member and by carriage bolts 1402 threaded into preformed threaded openings (not shown) in the edge surface 1372 and into preformed threaded openings in the fifth panel 1328 and in the third panel 1262.

The top plate member 1388 has first and second portions 1404 and 1406 which rest on the wooden surface 1364 and on panel surface 1310, respectively. The first portion 1404 is secured to the wooden surface 1364 by lag bolts 1408 while the second portion is secured to the first panel by carriage bolts 1410 cooperating with threaded openings (not shown) in a frame members (such as 1412 shown in broken outline) of the panel 1256. The right angled crane adapter 1390 has portions extending parallel to the surfaces 1366, 1310 and edge surface 1372 and allows a conventional container lifting crane found in most shipping ports to engage the corner.

Referring back to FIG. 59 it will be appreciated that the remaining container corners 1234, 1236, 1238, 1240, 1242 and 1244 (and the one not shown) are formed in the same manner as described above with respect to corner 1232. Similarly, the remaining mid-portion connectors 1250, 1252 (and the one not shown) are formed as described above with respect to mid-portion connector 1248. Thus, the floor panels of the house are effectively connected together to form a shipping container capable of holding all of the components necessary to build the house. The floor panels which are used to form the container are also used in building the house, after straightening or cutting off the bent plate portions 1264, 1266, 1286, 1288, 1300 and 1302 in FIG. 60*c* and 1334, 1336, 1338 and 1350 in FIG. 60*e*.

Referring back to FIG. 59, the container thus forms an open "box" into which the various other panels and components necessary to form the house are placed as indicated by the following list of components:

Floors

2001. floor, underside of container
2002. floor c/w plumbing connections, underside of container
2003. floor, topside of container
2004. floor, topside of container
1256. floor, side of container
1258. patio, side of container
1260. patio, side of container
1262. front porch, side of container
1328. deck, end of container
2010. deck, end of container Exterior Walls

2011. back left corner c/w window
2012. back left c/w glass doors
2013. back centre
2014. back right c/w window
2015. back right corner c/w window
2016. front left corner c/w window
2017. front left c/w window
2018. front centre c/w frosted window and door
2019. front right c/w window
2020. front right corner c/w window
2021. left back c/w window
2022. left centre c/w window
2023. left front c/w window
2024. right back c/w glass doors
2025. right centre c/w window
2026. right front c/w window Roof

2027. gable end left back
2028. middle left
2029. gable end left front
2030. gable end right back
2031. middle right
2032. gable and right front Interior Walls and Partitions

2033. full height wall
2034. 8' high wall c/w door
2035. wall above 2034. & 2101.
2036. full height wall
2037. full height wall c/w door
2038. full height wall
2039. 8' high partition c/w door
2040. (a & b) partition above 2101.
2041. full height wall
2042. full height wall
2043. (a & b) partition above 2101.
2044. 8' high partition c/w closet doors
2044. t. top of closet
2045. 8' high partition c/w closet doors
2045. t. top of closet Cabinets and Equipment

2100. Kitchen Unit
2101. Bathroom Unit
2102. Refrigerator/Freezer
2103. Washer Dryer
2104. Hot Water Heater The container thus contains all of the components required to build the house. The crane adapters 1390 on each corner permit the container to be handled using conventional container handling equipment as commonly found on the docks of major shipping ports and therefore act as means for cooperating with a handling crane for lifting the container. As the containers themselves are formed from panels comprising a steel frame and concrete interior portions, a plurality of containers may be stacked, one upon the other, on the deck or in the shipping hold of an ocean going vessel without fear of damaging the containers due to listing of the vessel during a voyage. Typically, the foundation members for the house are shipped separately or manufactured near the job site on which the house is to be installed.

FIGS. 61 and 62

When a container as shown in FIG. 59 is received on a job site, the components inside the container and the panels forming the container are assembled to form a house according to the invention. In the embodiment disclosed herein, the house provides more than 800 square feet of living space using 6 inch floor panels, 4.75 inch exterior wall panels, 7 inch roof panels, 3 inch interior wall panels and 2 inch interior partitions.

Assuming the foundation members have already been shipped and installed on site, the house is assembled as described above. As best seen in the plan view of FIG. 61, the floor, sides, ends and top (2001–2010) of the shipping container form the floor (2001–2005), patio (2006 and 2007), front porch (2008) and deck (2009) of the house while the components which were inside the container form the house itself. The invention thus provides a shipping container capable of holding all components necessary to build a house with the components of the container itself also forming components of the house in the final assembly thereof. Thus, efficient use of materials and space is provided while at the same time providing a convenient, strong shipping container for the house components.

The projecting portions on each panel act as connecting means for connecting each of the panels to a co-operating connecting means of an adjacent panel. As described above, these projecting portions are operable to deform elastically under severe forces imposed on the panel.

Alternatives

FIG. 63

Referring to FIG. 63, an alternative finish to the smooth finish imparted to the concrete, described above, is formed using a plurality of pre-formed conventional rectangular marble tiles, one of which is shown at 3000. The tiles are pre-fitted with a plurality of hooks shown generally at 3002 which are secured to the adhesive side of the conventional marble tile. Each hook has a flat backing surface portion 3004 which is glued to the adhesive or backing side of the tile. A projecting portion 3006 extends normal to the flat surface portion, away from the tile. The projecting portion is terminated in a hook portion 3008 which is arranged to project downward, toward the floor when the tile is used on a wall panel. The hook 3002 is preformed such that the distance between the adhesive side of the tile and the hook portion 3008 is equal to the approximate thickness of the concrete, designated in FIG. 63 as 3010.

To use the marble tiles, the tiles are pre-fitted with hooks 3002. Then, after the concrete 3010 has been poured over the mesh 3012 of the panel, but before the concrete cures, the tiles are placed on the concrete such that the hook portions 3008 project into the uncured concrete until the backing surface rests on the surface of the uncured concrete. In this position the hooks engage with the mesh 3012, while the adhesive side of the tile contacts the uncured concrete. The panel is then left undisturbed while the concrete cures. The cured concrete firmly sets about the hooks and secures the hooks 3002 to the mesh 3012 and the tiles are securely fixed to the panel. It will be appreciated that the tiles need not necessarily be marble but may be of any suitable architectural finish such as rock, granite, slate, wood siding etc.

FIG. 64

In the embodiment described above the panels were stated to measure 8'×8'. Similar benefits to those available using an 8'×8' panel, as described above are available in panels of various other dimensions. Examples of panels with other dimensions are shown in FIG. 64.

All of the panels shown in FIG. 64 measure 8' in height. The smallest practical panel (a) able to achieve the stated benefits is 6" wide and includes only vertical tension cables. The 12" and 18" panels (b) and (c) are similar. The 2' through 3'6" panels (d,e,f,g,) each include diagonal portions of tension cable although each forms a reverse "K" form rather than an "X" form as described in the embodiment described above. The remaining panels each include at least one "X" form of diagonal cables with some panels including a combination of an "X" form and a "K" form (m,n,q,s,u,w). The indicated forms are preferable for the panel dimensions indicated in order to achieve the structural, seismic and wind benefits described above.

Curved Foundation and Panels

FIG. 65

Referring to FIG. 65, a curved foundation portion is shown generally at 4000. To use the curved foundation portion, an end foundation adapter portion 4002 and a side foundation adapter portion 4004 are used. The end foundation adapter portion 4002 includes a length of end foundation similar to the foundation portion designated 42 in FIG. 3, but with first and second upstanding connecting portions 4008 and 4010 extending vertically upward, adjacent the curved foundation portion 4000. The first and second upstanding connecting portions 4008 and 4010 are similar to the vertically extending duct portions 74 and 76 on the side member 40 of FIG. 3 and thus have respective plates 4012 and 4014 having respective conduit and threaded openings 4016, 4018 and 4020, 4022, respectively.

The side foundation adapter 4004 is similar to the side foundation member 40 of FIG. 3 with the exception that it does not have the right angled end portion 48 shown in FIG. 3. Rather, the side foundation adapter 4004 has a straight end portion 4024 which has first and second upstanding channel portions 4026 and 4028, respectively. The first and second upstanding channel portions extend vertically upwards relative to the end portion 4024, the channel portions being similar to channel portions 4008 and 4010 just described.

The first and second channel portions 4026 and 4028 are terminated in respective plates 4030 and 4032. Each plate has a respective conduit and threaded opening 4034, 4036 and 4038, 4040.

The curved foundation member 4000 extends through 90 degrees, following an arc of a circle of radius 5 feet. The member has first and second end portions 4042 and 4044 which mate flush with respective end portions of the end foundation adapter portion 4002 and the side foundation adapter portion 4004. Adjacent end portions are connected together using respective mating connectors 4046 and 4048 similar to connecting flanges 86 shown in FIG. 3.

Referring to FIG. 65, the end foundation adapter portion 4002, curved foundation member 4000 and side foundation adapter 4004 each has a respective conduit 4001, 4003 and 4005 which is in communication with the conduits (as shown at 56 in FIG. 3) of adjacent foundation members. Thus, electrical service cables can be routed in the conduits of the various foundation members and can be accessed through openings 4016, 4020, 4034, 4038. Electrical service can, therefore, be provided to panels connected to plates 4012, 4014, 4030 and 4032.

Floor Panel With Curved Corner

FIG. 66

Referring to FIG. 66, a plurality of frame members of a floor panel with a curved corner portion are shown generally at 5000. The plurality of frame members includes first, second, third, fourth, fifth and sixth frame members 5002, 5004, 5006, 5008, 5010 and 5012, respectively. Frame members 5002, 5004 and 5006 are similar to frame members 150, 152 and 153 of FIG. 4 and therefore are not described further. Frame members 5008 and 5010 are straight frame members while frame member 5012 is curved longitudinally to extend through 90° of an arc of a circle having a radius 5014 of 5 feet to match the radius of curvature of the curved foundation member 4000 shown in FIG. 65.

Referring back to FIG. 66, frame member 5012 has first and second end faces 5016 and 5018 disposed at right angles to each other. Each end portion has a respective radially extending opening 5020 and 5022, respectively for receiving co-operating pins 5024 and 5026 on adjacent frame members 5008 and 5010. The adjacent frame members also have respective flat end faces 5028 and 5030 which abut the first and second end faces 5016 and 5018, respectively when the frame members are assembled together.

Adjacent frame member 5008 has first, second, third and fourth connecting flanges 5032, 5034, 5036 and 5038 which are used to connect the finished panel to the foundation shown in FIG. 65. The first connecting flange 5032 is similar to the connecting flange 172 of FIGS. 5, 6 and 7 and projects outwardly of the panel, along the longitudinal axis 5040 of frame member 5008. The second, third and fourth connecting flanges 3034, 3036 and 3038 have structure similar to the first connecting flange but extend transversely to the longitudinal axis 5040. The second connecting flange is disposed adjacent the first connecting flange while the third and fourth connecting flanges are disposed adjacent each other and adjacent the third frame member 5006.

The fifth frame member 5010 also has connecting flanges 5044 and 5046 extending transversely thereto and has an inside face with a plurality of spaced apart chair bolster hooks 5048, similar to those indicated at 204 in FIG. 4.

Frame members 5002, 5008 and 5012 also have a plurality of spaced part tension cable hooks 5050 similar to those indicated at 196 in FIG. 4.

FIG. 67

Referring now to FIG. 67, the frame members 5002–5012 are assembled together to form first and second interior portions 5052 and 5054, respectively. The interior portions include respective slabs of preformed styrofoam 5056 and 5058 similar to the slabs on the interior portion of the panel shown at 270 and 272 in FIG. 11. Slab 5056 is virtually identical to the slab shown on interior portion 270 and therefore will not be described further. Slab 5058 is similar to the slab on interior portion 272 with the exception of a rounded corner portion 5060. Slab 5058 has longitudinal, transverse and curved recess portions, the longitudinal portions being indicated at 5062, the transverse portions being indicated at 5064 and the curved recess portion being indicated at 5066. The slab also has first and second intersecting diagonal recess portions 5068 and 5070, respectively. The first diagonal recess portion extends between the curved recess portion and an opposite corner, the second diagonal recess portion extends between opposite corners, transversely to the first diagonal recessed portion.

FIG. 68

Referring to FIG. 68, a first resiliently extendable flexible tension cable 5072 is routed in the recessed portions of the first slab 5056 in a manner similar to that shown in FIG. 11 and serves to bias the frame portions inwardly. A second resiliently extendable flexible tension cable 5074 is routed in recessed portions 5062, 5064, 5066, 5068 and 5070 and serves to hold frame members 5002, 5008, 5010 and 5012 together. As with the floor panel described in FIG. 14, the portions of the tension cable which are routed in a longitudinal and transverse recesses lie in a first plane whereas the portions which are routed in the diagonal recesses lie in a second plane, spaced apart from the first plane, similar to the routing of cables described with respect to FIG. 11.

FIG. 69

Referring to FIG. 69, first and second layers of mesh material 5076 and 5078 are tensioned and connected to the bolster hooks 5048 facing respective first and second inner portions of the panel. The first layer of mesh material is similar to wire mesh 330 shown in FIG. 16. The second layer is also similar to wire mesh 330 of FIG. 16 with the exception that it has a rounded corner portion 5080 to match the curvature of frame member 5012. The first and second layers of mesh material lie in a third plane, above the second plane in which the diagonally extending portions of tension cable are routed. Concrete (not shown) is then poured over the mesh material such that the transverse, longitudinal and diagonal recesses are filled and the concrete is finished to have a smooth planar surface. The reverse side of the panel is finished in a similar manner and includes third and fourth tension cables, third and fourth layers of mesh and a second finished side of concrete.

FIG. 70

Referring to FIG. 70, a finished panel according to the invention is shown generally at 5082 and has a finished interior surface 5084 and protruding connecting flanges 5032, 5034, 5036, 5038, 5042, 5044, 5046 and 5086 which mate with corresponding connecting flanges 124, 124, 4012, 4014, 80, 4032, 4030, 80 and 134, respectively, shown in FIG. 65, the connecting flanges protruding from the panel and the flanges protruding from the foundation act as co-operating connecting means which are operable to deform elastically under seismic forces imposed on the foundation or panel.

Curved Exterior Wall Panel

FIG. 71

Referring to FIG. 71 a plurality of frame members for forming a curved exterior wall panel is shown generally at 5088. The plurality of frame members includes first and second curved frame members 5090 and 5092, first and second end members 5094 and 5096 and first, second, third and fourth intermediate frame members 5098, 5100, 5102 and 5104.

The end members 5094 and 5096 are similar to members 420 and 432 of FIG. 22 while the intermediate frame members 5098, 5100, 5102 and 5104 are similar to member 5006 shown in FIG. 66. These members therefore require no further description. The first and second curved frame members 5090 and 5092 are mirror images of each other and therefore only the first curved frame member 5090 will be described.

FIG. 72

Referring to FIG. 72, the first curved frame member 5090 has an interior facing face 5106 having first, second, third, fourth and fifth panel portions 5108, 5110, 5112, 5114 and 5116, respectively which are spaced apart by first, second, third and fourth intermediate portions 5118, 5120, 5122 and 5124, respectively. The frame member 5090 also has first and second opposite end portions 5126 and 5128, respectively.

Each end portion 5126 and 5128 has an opening 5130 and 5132, respectively for receiving respective pins 5134 and 5136 on mating end portions of corresponding end members 5094 and 5096, respectively (of FIG. 71). Similarly, each intermediate portion 5118, 5120, 5122 and 5124 has a respective pair of openings 5138, 5140, 5142 and 5144 for mating with respective pairs of pins 5146, 5148, 5150 and 5152 on the end portions of the corresponding intermediate members 5098, 5100, 5102 and 5104, respectively (of FIG. 71). The pins are permitted to move axially in the openings thereby permitting the curved end member to move in a direction parallel to the intermediate members and end members.

The panel portions 5108, 5110, 5112, 5114 and 5116 are similar and therefore only panel portion 5108 will be described. Panel portion 5108 includes first and second spaced apart tension cable hooks 5154 and 5156, respectively, the hooks being similar to those shown at 5050 in FIG. 66. Between the tension cable hooks 5154 and 5156 are located three spaced apart chair bolster hooks 5158, 5160 and 5162, arranged in a line.

FIG. 73

Referring to FIG. 73, a curved slab of styrofoam 5164 is formed with the same curvature as the curved frame members 5090 and 5092 of FIG. 71 and has a web portion 5166, a plurality of longitudinally extending recessed portions 5170 and a plurality of rib portions 5168.

FIG. 74

Referring to FIG. 74, the manufacture of the curved panel is begun with a sheet of mesh material 5172 which is laid flat on the manufacturing floor. A water impermeable membrane such as tar paper 5174 is laid flat on the mesh material 5172 and the curved styrofoam slab 5164 is laid on the tar paper 5174.

Referring to FIG. 75, the end and intermediate frame members 5094, 5096, 5098, 5100, 5102 and 5104 are laid in the recessed portions 5170 and the curved frame members 5090 and 5092 are placed against them such that the pins of respective members (such as 5134 and 5136) are received in corresponding openings (such as 5130 and 5132) in the curved end frame members. The tar paper 5174 and mesh material 5172 are then bent upwards to follow the shape of the curved styrofoam and the edges of the membrane and mesh are bent over the end members to embrace the end members 5094 and 5096 and the curved frame members 5090 and 5092.

FIGS. 76 and 77

Referring to FIGS. 71, 72 and 76, a single resiliently extendable flexible tension cable 5176 is routed between the tension cable hooks 5154 and 5156 of each panel portion and is tensioned using a turnbuckle 5157 such that the curved frame members 5090 and 5092 are held snugly against the end members 5094 and 5096 and the intermediate members 5098–5104.

A further layer of mesh material 5178 is then connected between the end members 5094 and 5096 and the curved frame members 5090 and 5092 such that a curved inner plane 5180 is defined by the mesh material, as best seen in FIG. 77. A concrete retaining edge 5182, shown best in FIG. 76, is preformed to conform to the curved inner plane 5180 and is riveted, welded or screwed to adjacent frame members to form an edge defining a perimeter of an inner surface of the panel.

FIG. 78

Concrete is then poured over the mesh material 5178 such that it flows into the recessed portions 5170 of the styrofoam slab to form concrete ribs 5184 therein with concrete web portions 5186 extending between the ribs 5184. The concrete of the ribs thus extends about the intermediate members 5098, 5100, 5102 and 5104 and the tension cable 5176 while the web portions 5186 extend about the mesh material 5178. The concrete is left undisturbed to cure, whereupon a smoothly curved inner surface 5188 is formed. A smoothly curved outer surface 5190 is formed by the first mesh material 5172 and may be smoothly finished using any conventional finish such as stucco or the like.

FIG. 79

Referring to FIG. 79, a finished curved panel according to the invention is shown generally at 5192. The panel has projecting connecting portions 5194, 5196, 5198, 5200 which extend outwards from respective corners thereof. The connecting portions are similar to connecting portions 642, 646, 648 and 650 shown in FIG. 31, and thus each has a respective opening for routing of utility service conduits and each has a threaded opening 5201 for securing the panel to an adjacent panel or foundation member.

FIG. 80

Referring to FIG. 80, a floor panel is shown immediately prior to assembly on the curved foundation member 4000, end foundation adapter portion 4002 and side foundation adapter 4004.

The floor panel is lowered onto the foundation members such that flanges 5032, 5034, 5036, 5038, 5046, 5044, 5042 and 5086 mate with corresponding connecting flanges 124, 4012, 4014, 4030, 4032, 80 and 134, respectively. The curved corner portion 4052 is located adjacent the curved foundation member 4000.

Next, first, second, third and fourth adapter connecting flanges 5202, 5204, 5206 and 5208 are laid upon connecting flanges 5034, 5036/5038 5046/5044 and 5042, respectively. The curved wall panel 5000 is then placed upon the foundation such that connecting portions 5200 and 5198 mate with connecting flanges 5204 and 5206, respectively. First and second adjacent wall panels 5203 and 5205, each having a length of 3 feet are then installed on the connecting flanges 5202, 5204, 5206 and 5208 in a similar manner to complete the corner portion of the structure.

The wall panel connecting portions 5198 and 5200, flanges 5202, 5204, 5206, 5208, floor panel connecting flanges 5034, 5036, 5038, 5042, 5044, 5046, 5086 and corresponding foundation connecting flanges 124, 124, 4012, 4014, 80, 4032, 4030, 80 and 134, respectively, are then connected together using bolts to rigidly secure the panels to the foundation. The connection of the panels and foundation in this manner creates a three dimensional space frame wherein the individual frame members of each panel act as structural members in the space frame. The connectors projecting from the foundation and panel members respectively act as elastically deformable connections which are capable of absorbing and distributing dynamic forces.

Finally, it will be appreciated that the wall, floor or roof panels may be made in virtually any geometric shape and are not limited to flat planar or curved planar forms.

While specific embodiments of the invention have been described and illustrated such embodiments are not considered to limit the invention as construed in accordance with the accompanying claims.

What is claimed is:

1. A building structure foundation member, the foundation member comprising:

a) a solidified castable material formed to include a footing portion for resting on the ground and a support portion for supporting a building structure;

b) a hollow conduit member extending lengthwise in at least one of said footing portion and said support portion, said conduit member being connectable to an adjacent similar conduit member to form a deformable joint;

c) openings in said support portion for permitting access to said hollow conduit member; and d) connecting means co-operating with said hollow conduit member for connecting said foundation member to an adjacent similar member, the connecting means being operable to deform elastically when seismic forces are imposed on the foundation member.

2. A building structure foundation member as claimed in claim 1 wherein the foundation member has engaging faces for mating with similar engaging faces of respective adjacent foundation members.

3. A building structure foundation member as claimed in claim 2 wherein the hollow conduit member includes a unitary length of structural tubing having first and second end openings accessible at said engaging faces respectively.

4. A building structure foundation member as claimed in claim 3 wherein said connecting means includes at least one elastically deformable flange rigidly connected to said structural tubing and protruding from said solidified castable material, for engaging with a co-operating flange on an adjacent member.

5. A building structure foundation member as claimed in claim 4 wherein said flange is bolted to said flange on said adjacent member.

6. A building structure foundation member as claimed in claim 1 wherein said footing portion includes a hollow conduit containing insulating material to provide insulating properties to the foundation member.

7. A foundation for a building structure, the foundation including:

a) a plurality of foundation members each comprising:

i) a solidified castable material formed to include a footing portion for resting on the ground and a support portion for supporting a building structure;

ii) a hollow conduit member extending lengthwise in at least one of said footing portion and said support portion for holding utility service provisions, said conduit member being connectable to an adjacent similar conduit member to form a deformable joint;

iii) openings in said support portion for permitting access to said hollow conduit and said utility service provisions;

iv) connecting means co-operating with said hollow conduit member for connecting said member to an adjacent similar member, the connecting means being operable to deform elastically when forces are imposed on the foundation member; and b) a plurality of connectors co-operating with respective connecting means on each member to secure adjacent members together.

8. A foundation for a building structure as claimed in claim 7 wherein said hollow conduit members are in communication with each other.

9. A foundation for a building structure as claimed in claim 8 wherein the connecting means on each of the foundation members is rigidly connected to a respective hollow conduit member and wherein the connecting together of the foundation members forms a space frame with said hollow conduit members of each of the foundation members acting as space frame members.

10. A foundation for a building structure as claimed in claim 9 wherein the space frame lies in a flat plane.

11. A building structure foundation member, the member comprising:

a) a solidified castable material formed to include a footing portion for resting on the ground and a support portion for supporting a building structure;

b) a hollow conduit member extending lengthwise in at least one of said footing portion and said support portion, said hollow conduit member including a unitary length of structural tubing having first and second end openings;

c) openings in said footing portion or said support portion for permitting access to said hollow conduit member;

d) engaging faces for mating with similar engaging faces of respective adjacent foundation members, said first and second end openings of said structural tubing being accessible at said engaging faces respectively; and e) connecting means for connecting said foundation member to an adjacent similar foundation member, the connecting means being operable to deform elastically when seismic forces are imposed on said foundation member, the connecting means including at least one elastically deformable flange rigidly connected to said structural tubing and protruding from said solidified castable material, for engaging with a co-operating flange on an adjacent foundation member.

12. A building structure foundation member as claimed in claim 11 wherein said flange is bolted to said flange on said adjacent foundation member.

13. A building structure foundation member, the foundation member comprising:

a) a solidified castable material formed to include a footing portion for resting on the ground and a support portion for supporting a building structure;

b) a hollow conduit member extending lengthwise in at least one of said footing portion and said support portion;

c) openings in said support portion for permitting access to said hollow conduit member;

d) a connector secured to said conduit member, for connecting said conduit member to an adjacent similar conduit member to form a deformable joint; and e) said connector being operable to deform elastically when seismic forces are imposed on the foundation member.

14. A building structure foundation member as claimed in claim 1, further including a plurality of upstanding structural tubing members secured generally at right angles to and in communication with said conduit member, said upstanding tubing members projecting through said openings in said support portion and being operable to be secured to a building member mounted thereon.

* * * * *